US005882841A

United States Patent [19]

Ezoe et al.

[11] Patent Number: 5,882,841

[45] Date of Patent: Mar. 16, 1999

[54] SILVER HALIDE PHOTOGRAPHIC LIGHT-SENSITIVE MATERIAL AND METHOD FOR PROCESSING THEREOF

[75] Inventors: Toshihide Ezoe; Kouta Fukui; Kohzaburoh Yamada, all of Kanagawa, Japan

[73] Assignee: Fuji Photo Film Co., Ltd., Kanagawa, Japan

[21] Appl. No.: 998,389

[22] Filed: Dec. 24, 1997

[30] Foreign Application Priority Data

Dec. 26, 1996 [JP] Japan ..... 8-348976

[51] Int. Cl.[6] ..... G03C 5/29

[52] U.S. Cl. ..... 430/264; 430/436; 430/438; 430/439; 430/440; 430/446; 430/447; 430/627

[58] Field of Search ..... 430/264, 436, 430/438, 439, 440, 446, 447, 627

[56] References Cited

U.S. PATENT DOCUMENTS

| | | | |
|---|---|---|---|
| 5,212,045 | 5/1993 | Koga et al. | 430/264 |
| 5,770,344 | 6/1998 | Yamada et al. | 430/264 |
| 5,789,139 | 8/1998 | Yamada et al. | 430/264 |

FOREIGN PATENT DOCUMENTS

| | | | |
|---|---|---|---|
| 0649047A1 | 4/1995 | European Pat. Off. . | |
| 0726579A2 | 8/1996 | European Pat. Off. . | |
| 2-948 | 1/1990 | Japan | G03C 1/06 |
| 4-16938 | 1/1992 | Japan | G03C 5/29 |
| 5-197091 | 8/1993 | Japan | G03C 5/29 |
| WO9516936 | 6/1995 | WIPO . | |

OTHER PUBLICATIONS

Patent Abstracts of Japan vol.010, No. 048 (P–431), Feb. 25, 1986 & JP 60 192915 (Sharp KK) Oct. 1, 1985.

Patent Abstracts of Japan vol. 010, No. 026 (P–425) Jan. 31, 1986 & JP 60 178424 A (Sharp KK), Sep. 12, 1985.

*Primary Examiner*—Hoa Van Le

*Attorney, Agent, or Firm*—Sughrue, Mion, Zinn, Macpeak & Seas, PLLC

[57] ABSTRACT

A silver halide photographic light-sensitive material comprising a support having thereon at least one light-sensitive silver halide emulsion layer, wherein at least one of the silver halide emulsion layer and other hydrophilic colloid layers comprises fine polymer particles containing at least one hydrazine compound represented by the following general formula (NB):

$$A—(B)_m \qquad \text{(NB)}$$

wherein A represents a connecting group; m represents an integer of from 2 to 6; and B represents a group containing a hydrazine structure. The sliver halide photographic light-sensitive material exhibits an ultrahigh contrast, an excellent storage stability and an excellent processing stability and is prevented from the occurrence of processing unevenness. A method for processing the silver halide photographic light-sensitive material is also disclosed.

15 Claims, No Drawings

SILVER HALIDE PHOTOGRAPHIC LIGHT-SENSITIVE MATERIAL AND METHOD FOR PROCESSING THEREOF

FIELD OF THE INVENTION

The present invention relates to a silver halide photographic light-sensitive material and a method for processing thereof. More particularly, the present invention relates to an ultrahigh contrast silver halide photographic light-sensitive material for use in photomechanical process and a method for processing thereof.

BACKGROUND OF THE INVENTION

In recent years, in the art of photomechanical process, it has been desired to use a photographic light-sensitive material excellent in original reproducibility and a processing system which can operate with a reduced amount of waste liquid to be disposed so as to cope with diversification and complexity of printed matters and the increase in environmental awareness.

In order to obtain good reproduction of a halftone image in continuous gradation or of a line work, an image formation system exhibiting an ultrahigh contrast (particularly having a γ value of 10 or more) photographic property is required.

For forming a high contrast image, a lithographic development system employing a so-called "infectious development effect" has been commonly used. However, the lithographic development system is disadvantageous in that the developer is too unstable to be used. An image forming system has been desired in which the photographic light-sensitive material is developed with a processing solution having a good storage stability to obtain an ultrahigh contrast. Examples of such an image forming system are described in U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836 and 5,650,746. In this image forming system, a surface latent image type silver halide photographic light-sensitive material comprising a hydrazine derivative incorporated therein is developed with a stable MQ or PQ developer having a Ph value of from 11.0 to 12.3 to obtain an ultrahigh negative image having a γ value of more than 10. In accordance with the method, an ultrahigh contrast and a high photographic sensitivity can be obtained. Further, since a sulfite can be added to the developer in a high concentration, the developer thus obtained exhibits a remarkably improved stability against air oxidation as compared with the conventional lith developers.

The above described method makes it possible to use a sulfite preservative in a high concentration to increase the stability of the developer. However, in order to obtain an ultrahigh contrast photographic image, it is necessary to employ a developer having a relatively high pH value. Such a developer having a relatively high pH value is liable to air oxidation. Thus, it is necessary that the developer be replenished at a high rate. Therefore, some attempts have been made in order to realize an ultrahigh contrast photographic image forming system comprising the nucleation development with a hydrazine compound by using a developer having a lower pH value.

U.S. Pat. No. 4,269,929 (corresponding to JP-A-61-267759 (the term "JP-A" as used herein means an "unexamined published Japanese patent application")), U.S. Pat. No. 4,737,452 (corresponding to JP-A-60-179734), U.S. Pat. Nos. 5,104,769, 4,798,780, 4,998,604 and 4,994,365, JP-A-1-179939, JP-A-1-179940 and JP-A-8-272023 describe a process which comprises the use of a hydrazine nucleating agent having high activity and a nucleation accelerator in order to obtain an ultrahigh image with a stable developer having a pH value of less than 11.0. It is also described that a chemically-sensitized silver halide emulsion having a high silver chloride content has high nucleation activity.

However, another problem encountered when the above described highly active hydrazine nucleating agent, highly active nucleation accelerator or highly active emulsion is employed is the occurrence of a so-called processing unevenness which is density unevenness caused in outputting at defined dot area.

Also, the photographic light-sensitive material containing the highly active hydrazine nucleating agent described above is troublesome in the preservation thereof for a long period of time since the highly active hydrazine nucleating agent is disadvantageously liable to decompose.

Further, although the amount of replenishment for developer and the amount of waste liquid in processing decrease to a certain extent using the stable developer having a pH value of less than 11.0, still further reduction is required. Therefore, a photographic light-sensitive material having higher processing stability, which has less change in photographic properties due to fluctuation of pH of a developer has been desired.

The incorporation of a hydrazine nucleating agent into fine polymer particles to add to a coating solution is described in JP-A-2-948. However, a purpose of the technique is prevention of deposition of the hydrazine nucleating agent.

SUMMARY OF THE INVENTION

It is therefore an object of the present invention to provide a silver halide photographic light-sensitive material which exhibits an ultrahigh contrast, an excellent storage stability and an excellent processing stability and which is prevented from the occurrence of processing unevenness.

Another object of the invention is to provide a method for processing the silver halide photographic light-sensitive material.

Other objects and effects of the present invention will become apparent from the following description.

These objects of the present invention have been achieved by providing a silver halide photographic light-sensitive material comprising a support having thereon at least one light-sensitive silver halide emulsion layer, wherein at least one of the silver halide emulsion layer and other hydrophilic colloid layers comprises fine polymer particles containing at least one hydrazine compound represented by the following general formula (NB):

$$A\text{-}(B)_m \qquad \text{(NB)}$$

wherein A represents a connecting group; m represents an integer of from 2 to 6; and B represents a group represented by the following general formula (B-1):

$$-(L_2-Ar_2)_n-L_1-Ar_1-NHNH-G_1-R_1 \qquad \text{(B-1)}$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an —$SO_2$— group, an —SO— group, a

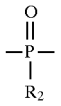

group, a —CO—CO— group, a thiocarbonyl group or an iminomethylene group; $R_2$ represents a group selected from those defined above for $R_1$, and may be different from $R_1$.

DETAILED DESCRIPTION OF THE INVENTION

The hydrazine compound for use in the present invention is described in detail below.

In the present invention, the hydrazine compound represented by the following general formula (NB) is used.

$$A\text{-}(B)_m \qquad \text{(NB)}$$

wherein A represents a connecting group; B represents a group represented by the following general formula (B-1); and m represents an integer of from 2 to 6:

$$-(L_2-Ar_2)_n-L_1-Ar_1-NHNH-G_1-R_1 \qquad \text{(B-1)}$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an —$SO_2$— group, an —SO— group, a

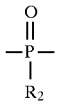

group, a —CO—CO— group, a thiocarbonyl group or an iminomethylene group; $R_2$ represents a group selected from those defined above for $R_1$, and may be different from $R_1$.

In general formula (B-1), the aromatic group represented by $Ar_1$ or $Ar_2$ includes monocyclic and bicyclic aryl groups such as a benzene ring and a naphthalene ring. The aromatic heterocyclic group represented by $Ar_1$ or $Ar_2$ includes monocyclic and bicyclic, aromatic heterocyclic groups which may be condensed with an aryl group. Examples thereof include a pyridine ring, a pyrimidine ring, an imidazole ring, a pyrazole ring, a quinoline ring, an isoquinoline ring, a benzimidazole ring, a thiazole ring and a benzothiazole ring.

$Ar_1$ and $Ar_2$ each is preferably the aromatic group, particularly preferably a phenylene group.

$Ar_1$ and $Ar_2$ each may be substituted, and suitable examples of the substituent include an alkyl group (including an active methine group), an alkenyl group, an alkynyl group, an aryl group, a heterocyclic group, a heterocyclic group containing a quaternarized nitrogen atom (e.g., pyridinio group), a hydroxyl group, an alkoxy group (including a group containing an ethyleneoxy group or a propyleneoxy group as a repeating unit), an aryloxy group, an acyloxy group, an acyl group, an alkoxycarbonyl group, an aryloxycarbonyl group, a carbamoyl group, a urethane group, a carboxyl group (including a salt thereof), an imido group, an amino group, a carbonamido group, a sulfonamido group, a ureido group, a thioureido group, a sulfamoylamino group, a semicarbazido group, a thiosemicarbazido group, a hydrazino group, a quaternary ammonio group, a mercapto group, an (alkyl, aryl or heterocyclic)thio group, an (alkyl or aryl)sulfonyl group, an (alkyl or aryl)sulfinyl group, a sulfo group (including a salt thereof), a sulfamoyl group, an acylsulfamoyl group, an (alkyl or aryl)sylfonylureido group, an (alkyl or aryl)-sulfonylcarbamoyl group, a halogen atom, a cyano group, a nitro group, a phosphoric amido group, a group containing a phosphoric acid ester structure, an acylureamido group, a group containing a selenium atom or a tellurium atom, a group having a tertiary sulfonium structure or a quaternary sulfonium structure, and a group containing a quaternarized phosphorus atom. These substituents may be further substituted with one or more of these substituents.

Of these examples, preferred substituents include an alkyl group having from 1 to 20 carbon atoms, an aralkyl group, a heterocyclic group, a substituted amino group, an acylamino group, a sulfonamido group, a ureido group, a sulfamoylamino group, an imido group, a thioureido group, a phosphoric amido group, a hydroxyl group, an alkoxy group, an aryloxy group, an acyloxy group, an acyl group, an alkoxycarbonyl group, an aryloxycarbonyl group, a carbamoyl group, a carboxyl group (including a salt thereof), an (alkyl, aryl or heterocyclic)thio group, a sulfo group (including a salt thereof), a sulfamoyl group, a halogen atom, a cyano group, and a nitro group.

The group represented by $Ar_1$ is particularly preferably an unsubstituted phenylene group.

In general formula (B-1), the alkyl group represented by $R_1$ is preferably an alkyl group having from 1 to 10 carbon atoms, and the aryl group represented by $R_1$ is preferably a monocyclic or bicyclic aryl group, e.g., an aryl group containing a benzene ring.

The heterocyclic group represented by $R_1$ is preferably a 5-membered or 6-membered ring compound containing at least one nitrogen, oxygen or sulfur atom. Examples thereof include an imidazolyl group, a pyrazolyl group, a triazolyl group, a tetrazolyl group, a pyridyl group, a pyridinio group, a quinolinio group and a quinolinyl group. A particularly preferred group is a pyridyl group and a pyridinio group.

The alkoxy group represented by $R_1$ is preferably an alkoxy group having from 1 to 8 carbon atoms. The aryloxy group represented by $R_1$ is preferably a monocyclic aryloxy group. The amino group represented by $R_1$ is preferably an unsubstituted amino group, an alkylamino group having from 1 to 10 carbon atoms, an arylamino group or a saturated or unsaturated heterocyclic amino group.

$R_1$ may be substituted, and examples of the substituent include those set forth above as a substituent for $Ar_1$ and $Ar_2$.

If $G_1$ is a —CO— group, preferred examples of the group represented by $R_1$ include a hydrogen atom, an alkyl group (e.g., methyl, trifluoromethyl, difluoromethyl, 2-carboxytetrafluoroethyl, pyridiniomethyl, 3-hydroxypropyl, 3-methanesulfonamidopropyl, or phenylsulfonylmethyl), an aralkyl group (e.g., o-hydroxybenzyl) and an aryl group (e.g., phenyl, 3,5-dichlorophenyl, o-methanesulfonamido-phenyl, o-carbamoylphenyl, 4-cyanophenyl, or 2-hydroxymethylphenyl). A particularly preferred group is a hydrogen atom and an alkyl group.

If $G_1$ is an —$SO_2$— group, preferred examples of the group represented by $R_1$ include an alkyl group (e.g., methyl), an aralkyl group (e.g., o-hyroxybenzyl), an aryl group (e.g., phenyl) and a substituted amino group (e.g., dimethylamino).

If $G_1$ is a —COCO— group, preferred examples of the group represented by $R_1$ include an alkoxy group, an aryloxy group and an amino group. Particularly, an alkylamino group, an arylamino group, a heterocyclic amino group (including a heterocyclic group containing a quaternarized nitrogen atom) are preferred. Examples thereof include 2,2,6,6-tetra-methylpiperidin- 4-ylamino, propylamino, anilino, o-hydroxy-anilino, 5-benzotriazolylamino, N-benzyl-3-pyridinioamino.

Alternatively, $R_1$ may be a group which allows the $G_1$–$R_1$ moiety to be split from the rest of the molecule to cause a cyclization reaction that produces a cyclic structure containing atoms constituting the $G_1$–$R_1$ moiety. Examples of such a group include those described in JP-A-63-29751.

The compound represented by general formula (NB) may comprise an adsorptive group incorporated therein which is adsorbed by silver halide. Examples of such an adsorptive group include groups described in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246, such as an alkylthio group, an arylthio group, a thiourea group, a thioamido group, a mercaptoheterocyclic group and a triazole group. These adsorptive groups for silver halide may be in the form of a precursor. Examples of the precursor include those described in JP-A-2-285344.

The connecting groups represented by $L_1$ and $L_2$ in general formula (B-1) comprises —O—, —S—, —N($R_N$)— (wherein $R_N$ represents a hydrogen atom, an alkyl group or an aryl group), —CO—, —C(=S)—, —$SO_2$—, —SO—, —P(=O)— and an alkylene group, singly or in combination of two or more thereof. Specific examples of the group comprising the combination of the above described groups include —CON($R_N$)—, $SO_2$N($R_N$)—, —COO—, —N($R_N$)CON($R_N$)—, —N($R_N$)CSN($R_N$)—, —N($R_N$)$SO_2$N($R_N$)—, —$SO_2$N($R_N$)CO—, —$SO_2$N($R_N$)CON($R_N$)—, —N($R_N$)COCON($R_N$)—, —CON($R_N$)CO—, —S—(alkylene group)—CONH—, —O—(alkylene group)—CONH— and —O—(alkylene group)—NHCO—. These connecting groups may be connected to the rest of the group represented by general formula (B-1) either on the left or right side thereof.

In general formula (B-1), if the connecting group represented by $L_1$ or $L_2$ contains a group having a valence of 3 or more, $L_1$ may be connected to two or more groups represented by —$Ar_1$—NHNH—$G_1$—$R_1$ in general formula (B-1), and $L_2$ may be connected to two or more groups represented by —$Ar_2$—$L_1$—$Ar_1$—NHNH—$G_1$—$R_1$ in general formula (B-1).

In such a case, the connecting group having a valence of 3 or more contained in $L_1$ and $L_2$ is an amino group or an alkylene group having a tertiary carbon atom.

In general formula (B-1), $L_1$ is preferably —$O_2$NH—, —NHCONH—, —NHC(=S)NH—, —O—, —S—, —N($R_N$)— or an active methine group, particularly preferably —$SO_2$NH—. $L_2$ is preferably a —CON($R_N$)—, —$SO_2$N($R_N$)—, —COO—, —N($R_N$)CON($R_N$)— or —N($R_N$)CSN($R_N$)—.

In general formula (NB), the connecting group represented by A is a divalent to hexavalent connecting group capable of connecting with 2 to 6 groups represented by B. The connecting group A is a single bond or comprises —O—, —S—, —N($R_N$')— (wherein $R_N$' represents a hydrogen atom, an alkyl group or an aryl group), —$N^+$($R_N$')$_2$— (wherein two $R_N$' groups may be the same or different or may be connected to each other to form a ring), —CO—, —C(=S)—, —$SO_2$—, —SO—, —P(=O)—, an alkylene group, an cycloalkylene group, an alkenylene group, an alkynylene group, an arylene group and a heterocyclic group, singly or in combination or two or more thereof. The heterocyclic group may be a heterocyclic group containing a quaternarized nitrogen atom such as a pyridinio group.

The connecting group represented by A in general formula (NB) may be substituted, and examples the substituent include those set forth above as a substituent for $Ar_1$ and $Ar_2$ in general formula (B-1).

When n is 0, the connecting group represented by A preferably contains at least one of a benzene ring, a naphthalene ring, a saturated or unsaturated heterocyclic group, a heterocyclic group containing a quaternarized nitrogen atom (e.g., pyridinio group), a quaternarized nitrogen atom such as an ammonio group, and a cycloalkylene group.

When n is 1, the connecting group represented by A preferably contains at least one of a single bond, a benzene ring, a naphthalene ring, a saturated or unsaturated heterocyclic group, a heterocyclic group containing a quaternarized nitrogen atom (e.g., pyridinio group), a quaternarized nitrogen atom such as an ammonio group, and a cycloalkylene group.

In general formula (NB), n represents an integer of from 2 to 6, preferably from 2 to 4, particularly preferably 2 or 3.

Specific examples of the compound represented by general formula (NB) are shown below, but the present invention should not be construed as being limited thereto.

| | | R = | | | |
|---|---|---|---|---|---|
| | | —H | —$CF_2H$ | 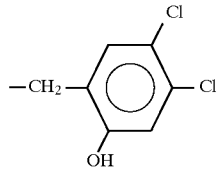 | —$CF_3$ |
| 1 | 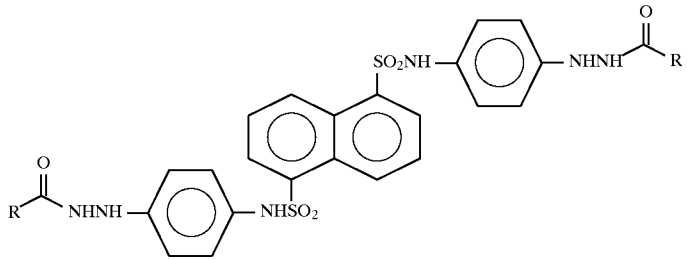 | 1a | 1e | 1k | 1l |
| 2 | 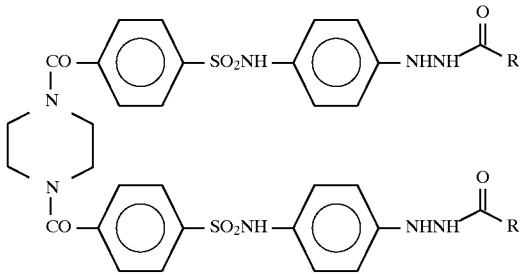 | 2a | 2e | 2k | 2l |
| 3 | 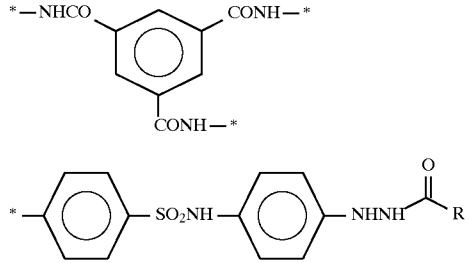 | 3a | 3e | 3k | 3l |

-continued
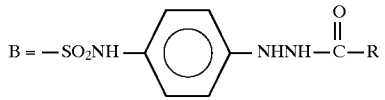
| | | R = | | | |
|---|---|---|---|---|---|
| | | —H | —$CF_2H$ | —$CF_3$ | —$CF_2SCH_3$ |
| 4 | 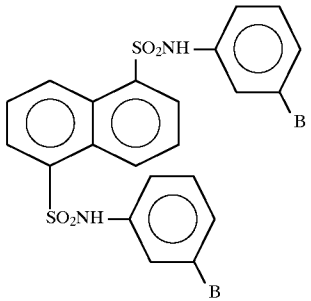 | 4a | 4e | 4c | 4r |
| 5 | 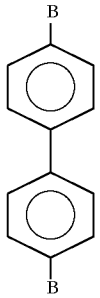 | 5a | 5e | 5c | 5r |
| 6 | 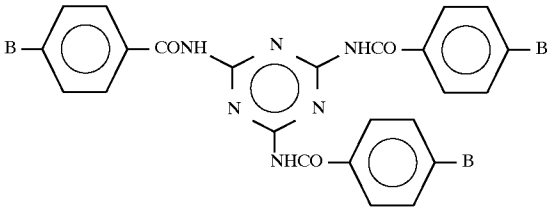 | 6a | 6e | 6c | 6r |

-continued
| | | | | | |
|---|---|---|---|---|---|
| 7 | 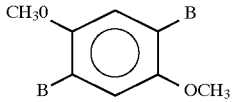 | 7a | 7e | 7c | 7r |
| 8 | 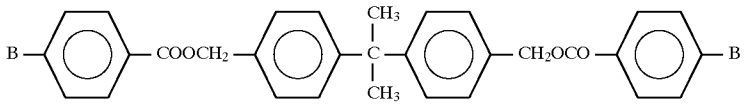 | 8a | 8e | 8c | 8r |
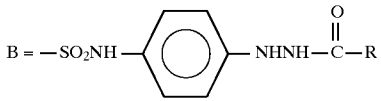
| | R = | | | |
|---|---|---|---|---|
| | −H | $-CF_2H$ | $-CONHCH_3$ | $-CF_2OCH_3$ |
| 9 | 9a | 9e | 9p | 9b |
| 10 | 10a | 10e | 10p | 10b |
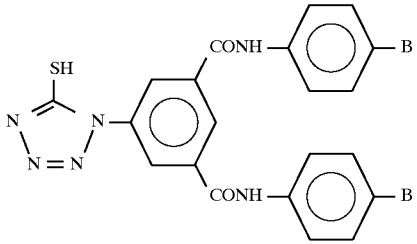
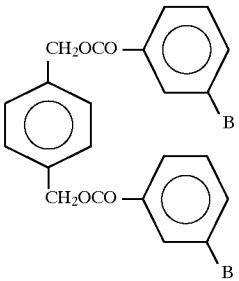

-continued
| | | R = | | | |
|---|---|---|---|---|---|
| | | —H | —$CF_2H$ | $HOCH_2$ | —CONH NH |
| 11 | 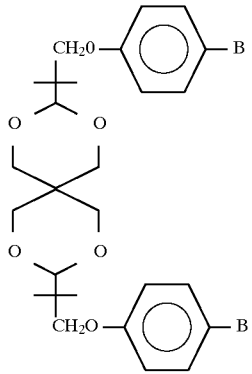 | 11a | 11e | 11f | 11g |
B' = 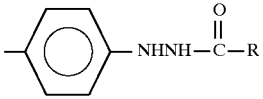
| | | R = | | | |
|---|---|---|---|---|---|
| | | —H | —$CF_2H$ | —CONH OH | —CONH NH |
| 12 | 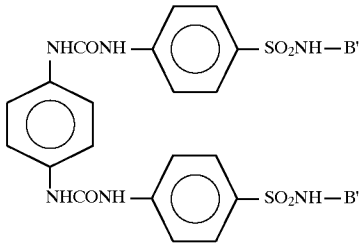 | 12a | 12e | 12s | 12g |

-continued
| | | | | | |
|---|---|---|---|---|---|
| 13 | 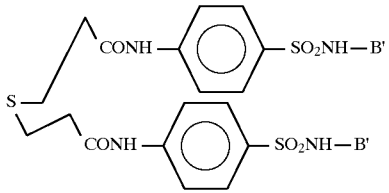 | 13a | 13e | 13s | 13g |
| 14 | 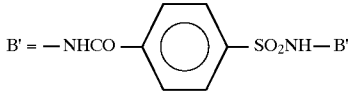 | 14a | 14e | 14s | 14g |
| 15 | 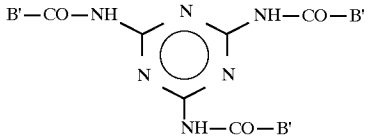 | 15a | 15e | 15s | 15g |
| | 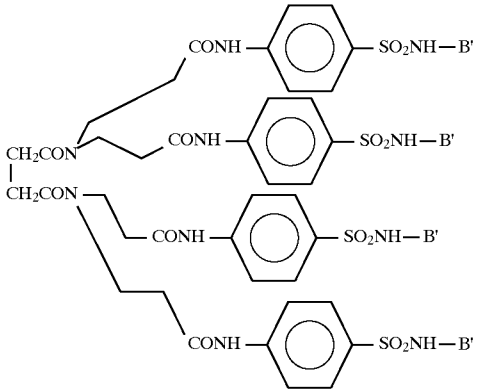 | 16a | 16e | 16s | 16g |
| | 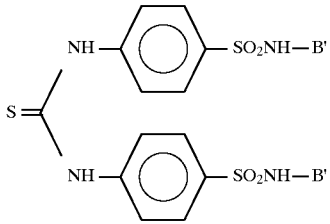 | 17a | 17e | 17s | 17g |

-continued
18
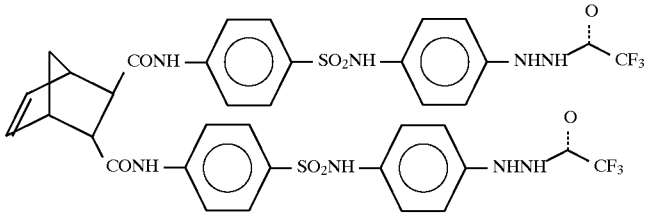
19
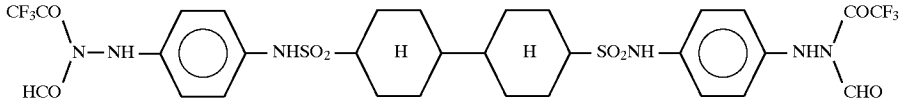
20
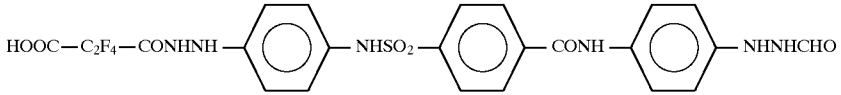
21
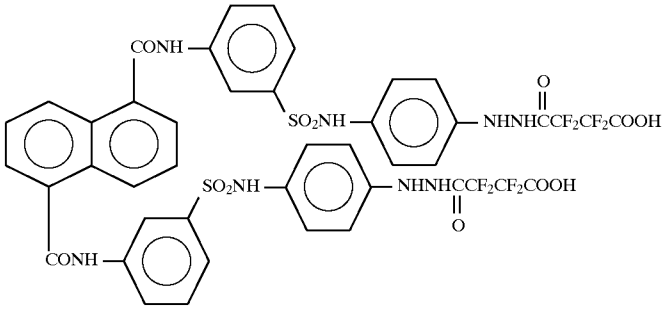
22
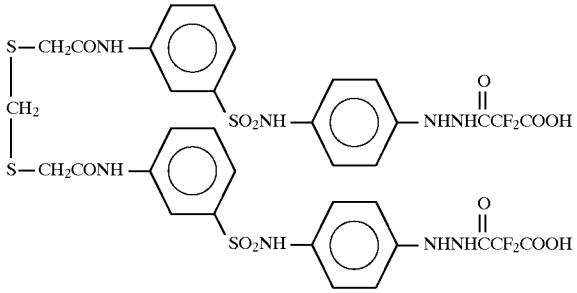

-continued
B' = 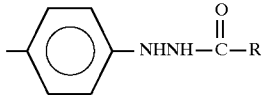
| | | R = | | | | |
|---|---|---|---|---|---|---|
| | | —H | —$CF_3$ | —$CF_2H$ | 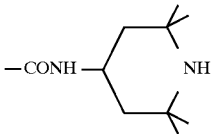 | 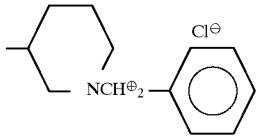 |
| 23 | 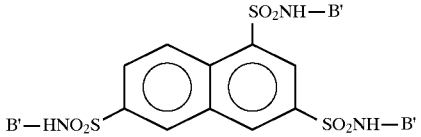 | 23a | 23c | 23e | 23g | 23d |
| 24 | 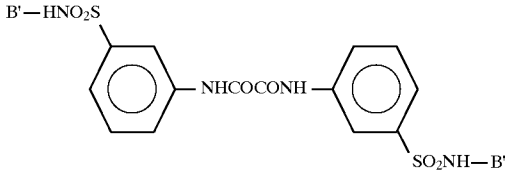 | 24a | 24c | 24e | 24g | 24d |
| 25 | 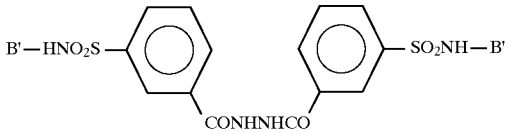 | 25a | 25c | 25e | 25g | 25d |
| 26 | 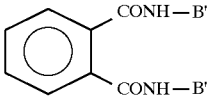 | 26a | 26c | 26e | 26g | 26d |

-continued
B' = 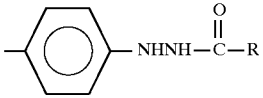
| | R = | | | | | |
|---|---|---|---|---|---|---|
| | —H | —$CF_3$ | —$CF_2H$ | —$CONHCH_3$ | $CH_2OH$ | —$C_2F_4COOH$ |
| 27 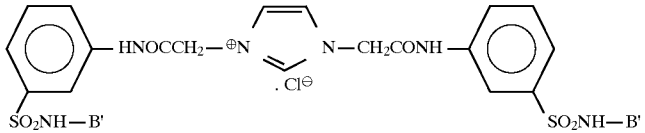 | 27a | 27c | 27e | 27p | 27f | 27t |
| 28 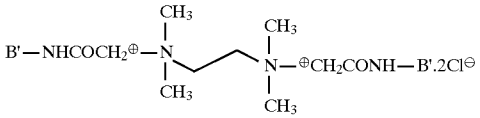 | 28a | 28c | 28e | 28p | 28f | 28t |
| 29 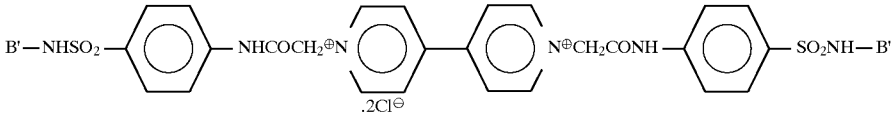 | 29a | 29c | 29e | 29p | 29f | 29t |
| 30 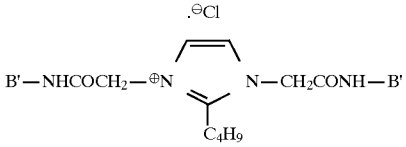 | 30a | 30c | 30e | 30p | 30f | 30t |

The hydrazine compound of the present invention may be incorporated into any of the silver halide emulsion layer or other hydrophilic colloid layers, which are provided on the silver halide emulsion layer side of the support, but is preferably incorporated into the silver halide emulsion layer or the hydrophilic colloid layer adjacent thereto.

The addition amount of the hydrazine compound is preferably from $1\times10^{-6}$ to $1\times10^{-2}$ mol, more preferably from $1\times10^{-5}$ to $5\times10^{-3}$ mol, most preferably from $2\times10^{-5}$ to $5\times10^{-3}$ mol per mol of silver halide.

A polymer constituting the fine polymer particles for use in the present invention is described in detail below.

The polymer for use in the present invention is preferably a water-insoluble and organic solvent-soluble polymer, and the examples thereof include those enumerated below, but the present invention should not be construed as being limited to these polymers.

(A) Vinyl polymers

Examples of the monomers for forming the vinyl polymer for use in the present invention include an acrylic acid ester, a methacrylic acid ester, a vinyl ester, an acrylamide, a methacrylamide, an olefin, a styrene, a vinyl ether and other vinyl monomers.

Specific examples of the acrylic acid ester include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate (molar number of addition: n=9), 1-bromo-2-methoxyethyl acrylate, 1,1-dichloro-2-ethoxyethyl acrylate, etc.

Specific examples of the methacrylic acid ester include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (molar number of addition: n=6), allyl methacrylate, dimethylaminoethyl methacrylate methyl chloride salt, etc.

Specific examples of the vinyl ester include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.

Specific examples of the acrylamide include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl) acrylamide, diacetonacrylamide, tert-octylacrylamide, etc.

Specific examples of the methacrylamide include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)methacrylamide, etc.

Specific examples of the olefin include dicyclopentadiene, ethylene, propylene, 1-butene, 1-pentene, vinyl chloride, vinylidene chloride, isoprene, chloroprene, butadiene, 2,3-dimenthylbutadiene, etc.

Specific examples of the styrene include styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, methyl vinyl benzoate, etc.

Specific examples of the vinyl ether include methyl vinyl ether, butyl vinyl ether, hexyl vinyl ether, methoxyethyl vinyl ether, dimethylaminoethyl vinyl ether, etc.

Specific examples of other vinyl monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, methacrylonitrile, methylene malononitrile, vinylidene, etc.

Two or more kinds of monomers (for example, those as described above) can be used in combination to prepare the polymer for use in the present invention depending on various purposes (for example, improvement in the solubility thereof). Further, for adjusting solubility of the polymer, a monomer having an acid group as illustrated below can be optionally used as a comonomer as long as the resulting copolymer remains water-insoluble.

Specific examples of such monomers having an acid group include acrylic acid; methacrylic acid; itaconic acid; maleic acid; a monoalkyl itaconate (for example, monomethyl itaconate, monoethyl itaconate, monobutyl itaconate); a monoalkyl maleate (for example, monomethyl maleate, monoethyl maleate, monobutyl maleate); citraconic acid; styrene sulfonic acid; vinylbenzylsulfonic acid; vinylsulfonic acid; an acryloyloxyalkylsulfonic acid (for example, acryloyloxymethylsulfonic acid, acryloyloxyethylsulfonic acid, acryloyloxypropylsulfonic acid); a methacryloyloxyalkylsulfonic acid (for example, methacryloyloxymethylsulfonic acid, methacryloyloxyethylsulfonic acid, methacryloyloxypropylsulfonic acid); an acrylamidoalkylsulfonic acid (for example, 2-acrylamide-2-methylethanesulfonic acid, 2-acrylamide-2-methylpropanesulfonic acid, 2-acrylamide-2-methylbutanesulfonic acid); a methacrylamidoalkylsulfonic acid (for example, 2-methacrylamido-2-methylethanesulfonic acid, 2-methacrylamido-2-methylpropanesulfonic acid, 2-methacrylamido-2-methylbutanesulfonic acid); etc.

The acid may be in the form of a salt of an alkali metal (for example, sodium, potassium) or an ammonium ion.

In the case where a hydrophilic monomer (the "hydrophilic monomer" used herein means one forms a water-soluble homopolymer when homopolymerized) among the above described vinyl monomers for use in the present invention and the above described other vinyl monomers is used as a comonomer in combination, a ratio of the hydrophilic monomer contained in the copolymer is not strictly limited as long as the copolymer does not become water-soluble. Usually, the ratio of the hydrophilic monomer is preferably not more than 40 mol %, more preferably not more than 20 mol %, and further more preferably not more than 10 mol %.

Further, when a hydrophilic comonomer for use in a copolymerization with the monomer of the present invention has an acid group, a ratio of the comonomer having an acid group contained in the copolymer is usually not more than 20 mol %, and preferably not more than 10 mol %. In the most preferred case the copolymer does not contain such a monomer.

Preferred monomers constituting the polymer for use in the present invention are methacrylate type monomers, acrylamide type monomers and methacrylamide type monomers. Particularly preferred monomers are acrylamide type monomers and methacrylamide type monomers.

Also, polymers obtained by a condensation polymerization or polyaddition reaction, cellulose derivatives and polyesters or polyamides obtained by ring opening polymerization as described on pages 13 and 14 of JP-A-2-948 are employed.

Two or more kinds of the polymer according to the present invention may be used in combination.

The term "water-insoluble" as used herein with respect to the polymer means that a weight of the polymer soluble in 100 g of distilled water is not more than 3 g, preferably not more than 1 g.

It is preferred that the water-insoluble (organic solvent-soluble) polymer for use in the present invention contains a component having a molecular weight of not more than 40,000 in an amount of from 30 to 70%.

Specific examples of the polymer for use in the present invention are set forth below, but the present invention should not be construed as being limited to these polymers.

| Example | Polymer |
|---|---|
| P-1 | Polyvinylacetate |
| P-2 | Polyvinylpropionate |
| P-3 | Polymethylmethacrylate |
| P-4 | Polyethylmethacrylate |
| P-5 | Polyethylacrylate |
| P-6 | Copolymer of vinylacetate-vinylalcohol (95:5) |
| P-7 | Poly(n-butylacrylate) |
| P-8 | Poly(n-butylmethacrylate) |
| P-9 | Poly(iso-butylmethacrylate) |
| P-10 | Poly(iso-propylmethacrylate) |
| P-11 | Poly(decylmethacrylate) |
| P-12 | Copolymer of n-butylacrylate-acrylamide (95:5) |
| P-13 | Poly(chloromethylacrylate) |
| P-14 | 1,4-Butanediol-adipic acid polyester |
| P-15 | Ethyleneglycol-sebacic acid polyester |
| P-16 | Polycaprolactone |
| P-17 | Poly(2-tert-butylphenyl acrylate) |

-continued

| Example | Polymer |
|---|---|
| P-18 | Poly(4-tert-butylphenyl acrylate) |
| P-19 | Copolymer of n-butylmethacrylate-N-vinyl-2-pyrrolidone (90:10) |
| P-20 | Copolymer of methylmethacrylate-vinyl chloride (70:30) |
| P-21 | Copolymer of methylmethacrylate-styrene (90:10) |
| P-22 | Copolymer of methylmethacrylate-ethylacrylate (50:50) |
| P-23 | Copolymer of n-butylmethacrylate-methylmethacrylate-styrene (50:30:20) |
| P-24 | Copolymer of vinylacetate-acrylamide (85:15) |
| P-25 | Copolymer of vinyl chloride-vinylacetate (65:35) |
| P-26 | Copolymer of methylmethacrylate-acrylonitrile (65:35) |
| P-27 | Copolymer of diacetoneacrylamide-methylmethacrylate (50:50) |
| P-28 | Copolymer of vinylmethylketone-isobutylmethacrylate (55:45) |
| P-29 | Copolymer of ethylmethacrylate-n-butylacrylate (70:30) |
| P-30 | Copolymer of diacetoneacrylamide-n-butylacrylate (60:40) |
| P-31 | Copolymer of methylmethacrylate-cyclohexylmethacrylate (50:50) |
| P-32 | Copolymer of n-butylacrylate-styrenemethacrylate-diacetoneacrylamide (70:20:10) |
| P-33 | Copolymer of N-tert-butylmethacrylamide-methylmethacrylate-acrylic acid (60:30:10) |
| P-34 | Copolymer of methylmethacrylate-styrene-vinylsulfonamide (70:20:10) |
| P-35 | Copolymer of methylmethacrylate-phenylvinylketone (70:30) |
| P-36 | Copolymer of n-butylacrylate-methylmethacrylate-n-butylmethacrylate (35:35:30) |
| P-37 | Copolymer of n-butylmethacrylate-pentylmethacrylate-N-vinyl-2-pyrrolidone (38:38:24) |
| P-38 | Copolymer of methylmethacrylate-n-butylmethacrylate-isobutylmethacrylate-acrylic acid (37:29:25:9) |
| P-39 | Copolymer of n-butylmethacrylate-acrylic acid (95:5) |
| P-40 | Copolymer of methylmethacrylate-acrylic acid (95:5) |
| P-41 | Copolymer of methylmethacrylate-acrylic acid (90:10) |
| P-42 | Copolymer of n-butylmethacrylate-methylmethacrylate-benzylmethacrylate-acrylic acid (35:35:25:5) |
| P-43 | Copolymer of n-butylmethacrylate-methylmethacrylate-benzylmethacrylate (35:35:30) |
| P-44 | Poly(3-pentylacrylate) |
| P-45 | Copolymer of cyclohexylmethacrylate-methylmethacrylate-n-propylmethacrylate (37:29:34) |
| P-46 | Poly(pentylmethacrylate) |
| P-47 | Copolymer of methylmethacrylate-n-butylmethacrylate (65:35) |
| P-48 | Copolymer of vinylacetate-vinylpropionate (75:25) |
| P-49 | Copolymer of n-butylmethacrylate-sodium-3-acryloxybutane-1-sulfonate (97:3) |
| P-50 | Copolymer of n-butylmethacrylate-methylmethacrylate acrylamide (35:35:30) |
| P-51 | Copolymer of n-butylmethacrylate-methylmethacrylate-vinyl chloride (37:36:27) |
| P-52 | Copolymer of n-butylmethacrylate-styrene (90:10) |
| P-53 | Copolymer of methylmethacrylate-N-vinyl-2-pyrrolidone (90:10) |
| P-54 | Copolymer of n-butylmethacrylate-vinylchloride (90:10) |
| P-55 | Copolymer of n-butyl methacrylate-styrene (70:30) |
| P-56 | Poly(N-sec-butylacrylamide) |
| P-57 | Poly(N-tert-butylacrylamide) |
| P-58 | Copolymer of diacetoneacrylamide-methylmethacrylate (62:38) |
| P-59 | Copolymer of cyclohexylmethacrylate-methylmethacrylate (60:40) |
| P-60 | Copolymer of N-tert-butylacrylamide-methylmethacrylate (60:40) |
| P-61 | Poly(N-n-butylacrylamide) |
| P-62 | Copolymer of tert-butylmethacrylate-N-tert-butylacrylamide (50:50) |
| P-63 | Copolymer of tert-butylmethylacrylate-methylmethacrylate (70:30) |
| P-64 | Poly(N-tert-butylmethacrylamide) |

-continued

| Example | Polymer |
|---|---|
| P-65 | Copolymer of N-tert-butylacrylamide-methyl methacrylate (60:40) |
| P-66 | Copolymer of methylmethacrylate-acrylonitrile (70:30) |
| P-67 | Copolymer of methylmethacrylate-vinylmethylketone (38:62) |
| P-68 | Copolymer of methylmethacrylate-styrene (75:25) |
| P-69 | Copolymer of ethylmethacrylate-hexylmethacrylate (70:30) |
| P-70 | Poly(benzylacrylate) |
| P-71 | Poly(4-biphenylacrylate) |
| P-72 | Poly(4-butoxycarbonylphenylacrylate) |
| P-73 | Poly(sec-butylacrylate) |
| P-74 | Poly(tert-butylacrylate) |
| P-75 | Poly[3-chloro-2,2-bis(chloromethyl)-propylacrylate] |
| P-76 | Poly(2-chlorophenylacrylate) |
| P-77 | Poly(4-chlorophenylacrylate) |
| P-78 | Poly(pentachlorophenylacrylate) |
| P-79 | Poly(4-cyanobenzylacrylate) |
| P-80 | Poly(cyanoethylacrylate) |
| P-81 | Poly(4-cyanophenylacrylate) |
| P-82 | Poly(4-cyano-3-thiabutylacrylate) |
| P-83 | Poly(cyclohexylacrylate) |
| P-84 | Poly(2-ethoxycarbonylphenylacrylate) |
| P-85 | Poly(3-ethoxycarbonylphenylacrylate) |
| P-86 | Poly(4-ethoxycarbonylphenylacrylate) |
| P-87 | Poly(2-ethoxyethylacrylate) |
| P-88 | Poly(3-ethoxypropylacrylate) |
| P-89 | Poly(1H,1H,5H-octafluoropentylacrylate) |
| P-90 | Poly(heptylacrylate) |
| P-91 | Poly(hexadecylacrylate) |
| P-92 | Poly(hexylacrylate) |
| P-93 | Poly(iso-butylacrylate) |
| P-94 | Poly(iso-propylacrylate) |
| P-95 | Poly(3-methoxybutylacrylate) |
| P-96 | Poly(2-methoxycarbonylphenylacrylate) |
| P-97 | Poly(3-methoxycarbonylphenylacrylate) |
| P-97 | Poly(3-methoxycarbonylphenylacrylate) |
| P-98 | Poly(4-methoxycarbonylphenylacrylate) |
| P-99 | Poly(2-methoxyethylacrylate) |
| P-100 | Poly(4-methoxyphenylacrylate) |
| P-101 | Poly(3-methoxypropylacrylate) |
| P-102 | Poly(3,5-dimethyladamanthylacrylate) |
| P-103 | Poly(3-dimethylaminophenylacrylate) |
| P-104 | Poly(vinyl tert-butyrate) |
| P-105 | Poly(2-methylbutylacrylate) |
| P-106 | Poly(3-methylbutylacrylate) |
| P-107 | Poly(1,3-dimethylbutylacrylate) |
| P-108 | Poly(2-methylpentylacrylate) |
| P-109 | Poly(2-naphtylacrylate) |
| P-110 | Poly(phenylmethacrylate) |
| P-111 | Poly(propylacrylate) |
| P-112 | Poly(m-tolylacrylate) |
| P-113 | Poly(o-tolylacrylate) |
| P-114 | Poly(p-tolylacrylate) |
| P-115 | Poly(N,N-dibutylacrylamide) |
| P-116 | Poly(iso-hexylacrylamide) |
| P-117 | Poly(iso-octylacrylamide) |
| P-118 | Poly(N-methyl-N-phenylacrylamide) |
| P-119 | Poly(adamanthylmethacrylate) |
| P-120 | Poly(benzylmethacrylate) |
| P-121 | Poly(2-bromoethylmethacrylate) |
| P-122 | Poly(2-N-tert-butylaminoethylmethacrylate) |
| P-123 | Poly(sec-butylmethacrylate) |
| P-124 | Poly(tert-butylmethacrylate) |
| P-125 | Poly(2-chloroethylmethacrylate) |
| P-126 | Poly(2-cyanoethylmethacrylate) |
| P-127 | Poly(2-cyanomethylphenylmethacrylate) |
| P-128 | Poly(4-cyanophenylmethacrylate) |
| P-129 | Poly(cyclohexylmethacrylate) |
| P-130 | Poly(dodecylmethacrylate) |
| P-131 | Poly(diethylaminoethylmethacrylate) |
| P-132 | Poly(2-ethylsulfinylethylmethacrylate) |
| P-133 | Poly(hexadecylmethacrylate) |
| P-134 | Poly(hexylmethacrylate) |
| P-135 | Poly(2-hydroxypropylmethacrylate) |
| P-136 | Poly(4-methoxycarbonylphenylmethacrylate) |
| P-137 | Poly(3,5-dimethyladamanthylmethacrylate) |

-continued

| Example | Polymer |
|---|---|
| P-138 | Poly(dimethylaminoethylmethacrylate) |
| P-139 | Poly(3,3-dimethylbutylmethacrylate) |
| P-140 | Poly(3,3-dimethyl-2-butylmethacrylate) |
| P-141 | Poly(3,5,5-trimethylhexylmethacrylate) |
| P-142 | Poly(octadecylmethacrylate) |
| P-143 | Poly(tetradecylmethacrylate) |
| P-144 | Poly(4-butoxycarbonylphenylmethacrylamide) |
| P-145 | Poly(4-carboxyphenylmethacrylamide) |
| P-146 | Poly(4-ethoxycarbonylphenylmethacrylamide) |
| P-147 | Poly(4-methoxycarbonylphenylmethacrylamide) |
| P-148 | Poly(butylbutoxycarbonylmethacrylate) |
| P-149 | Poly(butylchloroacrylate) |
| P-150 | Poly(butylcyanoacrylate) |
| P-151 | Poly(cyclohexylchloroacrylate) |
| P-152 | Poly(chloroethylacrylate) |
| P-153 | Poly(ethylethoxycarbonylmethacrylate) |
| P-154 | Poly(ethylmethacrylate) |
| P-155 | Poly(fluoroethylmethacrylate) |
| P-156 | Poly(hexylhexyloxycarbonylmethacrylate) |
| P-157 | Poly(chloroisobutylacrylate) |
| P-158 | Poly(isopropylchloroacrylate) |
| P-159 | Trimethylenediamine-glutaric acid polyamide |
| P-160 | Hexamethylenediamine-adipic acid polyamide |
| P-161 | Poly(α-pyrrolidone) |
| P-162 | Poly(ε-caprolactam) |
| P-163 | Hexamethylenediisocyanate-1,4-butanediol polyurethane |
| P-164 | p-Phenylenediisocyanate-ethylene glycol polyurethane |
| P-165 | Poly(vinyl hydrogenated phthalate) |
| P-166 | Poly(vinyl acetal phthalate) |
| P-167 | Poly(vinyl acetal) |
| P-168 | 2-Hydroxypropyl methyl cellulose hexahydrophthalate (2-hydroxypropyl group: 0.28, methyl group: 1.65, hexahydrophthalyl group: 0.60) |
| P-169 | 2-Hydroxypropyl methyl cellulose hexahydrophthalate (2-hydroxypropyl group: 0.33, methyl group: 1.60, hexahydrophthalyl group: 0.69) |
| P-170 | 2-Hydroxypropyl methyl cellulose hexahydrophthalate (2-hydroxypropyl group: 0.22, methyl group: 1.81, hexahydrophthalyl group: 0.84) |
| P-171 | Cellulose acetate hexahydrophthalate (acetyl group: 1.23, hexahydrophthalyl group: 0.67) |
| P-172 | 2-Hydroxypropyl-4-hydroxybutyl methyl cellulose hexahydrophthalate (2-hydroxypropyl group: 0.28, 4-hydroxybutyl group: 0.06, methyl group: 1.53, hexahydrophthalyl group: 0.39) |

These compounds can be prepared according to known methods such as methods described, for example, in U.S. Pat. No. 3,392,022 and JP-B-49-17367 (the term "JP-B" as used herein means an "examined Japanese patent publication").

In order to incorporate the hydrazine compound according to the present invention into the fine polymer particles, there are (1) method wherein the hydrazine compound is dissolved in a water-miscible organic solvent, the solution thus obtained is mixed with a loadable polymer latex and the hydrazine compound is loaded on the polymer, and (2) method wherein the hydrazine compound and the polymer are dissolved in a low boiling point organic solvent which is insoluble in water (wherein the solubility of the solvent in water at room temperature is not more than 30%) and the resulting solution is emulsified and dispersed in an aqueous phase using an emulsifying aid such as a surfactant or gelatin, if desired. In either case, removal of the organic solvent after the hydrazine compound has been incorporated into the fine polymer particles is desirable in view of storage stability. Further, the method (1) above does not require much effort for incorporation of the hydrazine compound into the fine polymer particles, but it is difficult to introduce a large amount of the hydrazine compound into the polymer. On the other hand, the method (2) above requires much effort for the emulsification and dispersion of the hydrazine compound into the fine polymer particles, but a large amount of the hydrazine compound can be incorporated into the polymer. Moreover, the reactivity of the hydrazine compound may be adjusted by varying the size of the polymer particles. It is also possible to incorporate, in an appropriate proportion and in a uniform manner, a plurality of hydrazine compounds having different photographic effects into the fine polymer particles. Hence, the method (2) above has some advantages over the method (1) above and so it is the preferred method for incorporation.

A dispersion of fine polymer particles containing the hydrazine compound for use in the present invention is preferably prepared as follows.

The hydrazine compound and the polymer of the present invention are first completely dissolved in a low boiling point organic solvent. The resulting solution is then emulsification-dispersed as fine particles in water, preferably in an aqueous hydrophilic colloid solution, and more preferably in an aqueous gelatin solution, using a dispersing aid such as a surfactant, if desired, by means of ultrasonic, a colloid mill or a dissolver, for example, to prepare the fine polymer particles containing the hydrazine compound.

Removal of the low boiling point organic solvent from the dispersion thus obtained is desirable, because it is effective with respect to the stability of the dispersion, and especially for preventing the precipitation of the hydrazine compound during storage. A method for the removal of the low boiling point organic solvent includes heating and distillation under a reduced pressure, heating and distillation at a normal pressure under an atmosphere of nitrogen or argon, noodle washing and ultrafiltration.

The term "low boiling point organic solvent" as used herein means an organic solvent which is useful in forming an emulsified dispersion, which is finally removed substantially from the photographic light-sensitive material during the drying step after coating or by the above-described method, and which is an organic solvent having a low boiling point or a solvent having a certain extent of solubility in water and removable by washing with water.

Specific examples of the low boiling point organic solvent include ethyl acetate, butyl acetate, ethyl propionate, sec-butyl alcohol, methyl ethyl ketone, methyl isobutyl ketone, β-ethoxyethyl acetate, methyl cellosolve acetate, and cyclohexanone.

Further, an organic solvent which is fully miscible with water, for example, methyl alcohol, ethyl alcohol, acetone, or tetrahydrofuran may be partially employed together, if desired.

Two or more such organic solvents can be used in combination.

It is preferred that a pH of the emulsified dispersion is within from a neutral to acidic range in view of the stability of the hydrazine compound and the stability of the emulsified dispersion per se. When gelatin is used for the emulsified dispersion, the pH is preferably controlled at least 0.3 higher, more preferably at least 0.5 higher than the isoelectric point of the gelatin used for preventing the occurrence of a so-called syneresis which is a phenomenon wherein a gel separates the liquid and shrinks during storage. In order to control the pH of the emulsified dispersion, an organic acid, for example, citric acid, oxalic acid, acetic acid, tartaric acid, succinic acid or malic acid is preferably employed.

In the present invention, it is particularly preferred to use a melting point decreasing agent at the time of incorporation of the hydrazine compound into the polymer particles.

The melting point decreasing agent for use in the present invention is a substantially water-insoluble organic compound which exhibits a function of decreasing a melting point of the hydrazine compound which is substantially non-diffusible and an organic solvent-soluble, when mixed with the hydrazine compound.

The melting point decreasing agent which can be preferably used in the present invention includes compounds represented by general formula (II) described on page 18 and compounds represented by general formula (II') described on page 20 of JP-A-2-948 (specifically, Compounds II-1 to II-14 and Compounds II'-1 to II'-10 described on pages 19 to 21).

The average particle size of the fine polymer particles in the emulsified dispersion thus prepared is preferably from 0.02 μm to 2 μm, more preferably form 0.04 μm to 0.4 μm. The particle size of the fine polymer particles can be determined using an appropriate measuring apparatus, for example, Nanosizer (manufactured by Coalter Co., England).

Various photographically useful hydrophobic substances can also be incorporated into the fine polymer particles in the emulsified dispersion of the present invention to the extent that the hydrazine compound still achieves its intended purpose.

Examples of photographically useful hydrophobic substance which can be incorporated into the fine polymer particles of the present invention include high boiling point organic solvents, colored couplers, non-color-forming couplers, developing agents, developing agent precursors, development inhibitors, development inhibitor precursors, ultraviolet absorbers, development accelerators, gradation controlling agents such as hydroquinones, dyes, dye releasing agents, antioxidants, fluorescent whitening agents and antifogging agents. Further more, these hydrophobic substances can be used jointly.

In accordance with the present invention, the hydrazine compound may be used singly or in a combination of two or more thereof.

The melting point decreasing agent described above is preferably used in a range of from 10 to 200% by weight, particularly from 20 to 100% by weight with respect to the weight of the hydrazine compound in the present invention.

In the present invention, the polymer described above is preferably used in a range of from 10 to 400% by weight, particularly from 20 to 300% by weight with respect to the weight of the hydrazine compound.

The photographic light-sensitive material of the present invention preferably contains a nucleation accelerator.

The nucleation accelerator for use in the present invention includes an amine derivative, an onium salt, a disulfide derivative and a hydroxymethyl derivative. Examples thereof are enumerated below.

Compounds described in JP-A-7-77783, page 48, lines 2 to 37 (specifically, compounds A-1) to A-73) described on pages 49 to 58 thereof); compounds represented by Chemical Formula 21, Chemical Formula 22, and Chemical Formula 23 described in JP-A-7-84331 (specifically, compounds described on pages 6 to 8 thereof); compounds represented by general formula [Na] and general formula [Nb] described in JP-A-7-104426 (specifically, compounds Na-1 to Na-22 and Nb-1 to Nb-12 described on pages 16 to 20 thereof); compounds represented by general formula (1), general formula (2), general formula (3), general formula (4), general formula (5), general formula (6) and general formula (7) described in JP-A-8-272023 (specifically, Compounds 1-1 to 1-19, Compounds 2-1, to 2-22, Compounds 3-1, to 3-36, Compounds 4-1 to 4-5, Compounds 5-1 to 5-41, Compounds 6-1 to 6-58 and Compounds 7-1 to 7-38); and nucleation accelerator compounds described in Japanese Patent Application No. 8-70908.

In the present invention, onium salt compounds represented by general formulas (A-1), (A-2), (A-3) and (A-4) shown below are most preferably used as the nucleation accelerator.

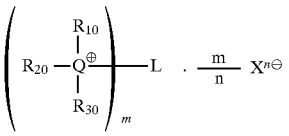

(A-1)

wherein $R_{10}$, $R_{20}$ and $R_{30}$ each represents an alkyl group, a cycloalkyl group, an aralkyl group, an aryl group, an alkenyl group, a cycloalkenyl group, an alkynyl group or a heterocyclic group; Q represents a nitrogen atom or a phosphorus atom; L represents an m-valent organic group bonded to $Q^+$ with its carbon atom, wherein m represents an integer of from 1 to 4; and $X^{n-}$ represents an n-valent counter anion, wherein n represents an integer of from 1 to 3, providing that when $R_{10}$, $R_{20}$, $R_{30}$ or L has an anion group in its substituent to form an internal salt with $Q^+$, $X^{n-}$ is not needed;

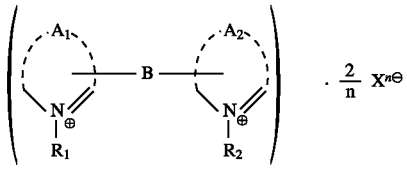

(A-2)

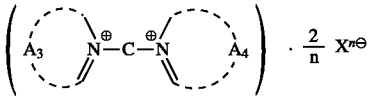

(A-3)

wherein $A_1$, $A_2$, $A_3$ and $A_4$ each represents an organic residue which contains a quaternized nitrogen atom and is for completing a substituted or unsubstituted unsaturated heterocyclic ring; B and C each represents a divalent connecting group; $R_1$ and $R_2$ each represents an alkyl group or an aralkyl group; and $X^{n-}$ represents an n-valent counter anion, wherein n represents an integer of from 1 to 3, providing that when an internal salt can be formed, $X^{n-}$ is not needed; and

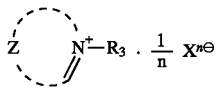

(A-4)

wherein Z represents an organic residue which contains a quaternized nitrogen atom and is for completing a substituted or unsubstituted unsaturated heterocyclic ring; $R_3$ represents an alkyl group, an alkenyl group, an alkynyl group or an aralkyl group; and $X^{n-}$ represents an n-valent counter anion, wherein n represents an integer of from 1 to 3, providing that when an internal salt can be formed, $X^{n-}$ is not needed.

The onium salts are described in more detail below.

First, the onium salt represented by general formula (A-1) is described in more detail below.

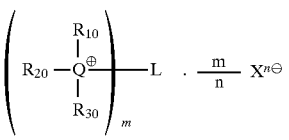

(A-1)

In general formula (A-1), $R_{10}$, $R_{20}$ and $R_{30}$ each represents an alkyl group, a cycloalkyl group, an aralkyl group, an aryl group, an alkenyl group, a cycloalkenyl group, an alkynyl group or a heterocyclic group, which may further have a substituent group, or $R_{10}$ , $R_{20}$ and $R_{30}$ may combine with each other to form a ring.

Q represents a nitrogen atom or a phosphorus atom.

L represents an m-valent organic group bonded to $Q^+$ with its carbon atom, wherein m represents an integer of from 1 to 4. $X^{n-}$ represents an n-valent counter anion, wherein n represents an integer of from 1 to 3. However, when $R_{10}$, $R_{20}$, $R_{30}$ or L has an anion group in its substituent to form an internal salt together with $Q^+$, $X^{n-}$ is not needed.

Examples of the groups represented by $R_{10}$, $R_{20}$ and $R_{30}$ include a straight chain or branched chain alkyl group such as methyl, ethyl, propyl, isopropyl, butyl, isobutyl, sec-butyl, tert-butyl, octyl, 2-ethylhexyl, dodecyl, hexadecyl or octadecyl; an aralkyl group such as a substituted or unsubstituted benzyl; a cycloalkyl group such as cyclopropyl, cyclopentyl or cyclohexyl; an aryl group such as phenyl, naphthyl or phenanthryl; an alkenyl group such as allyl, vinyl or 5-hexenyl; a cycloalkenyl group such as cyclopentenyl or cyclohexenyl; an alkynyl group such as phenylethynyl; and a heterocyclic group such as pyridyl, quinolyl, furyl, imidazolyl, thiazolyl, thiadiazolyl, benzotriazolyl, benzothiazolyl, morpholyl, pyrimidyl or pyrrolidyl.

Examples of the substituent substituted on these groups include a halogen atom such as a fluorine, chlorine, bromine or iodine atom, a nitro group, an (alkyl or aryl)amino group, an alkoxyl group, an aryloxy group, an (alkyl or aryl)thio group, a carbonamido group, a carbamoyl group, a sulfonamido group, a sulfamoyl group, a hydroxyl group, a sulfoxy group, a sulfonyl group, a carboxyl group (including a carboxylate), a sulfonic acid group (including a sulfonate), a cyano group, an oxycarbonyl group and an acyl group, as well as the groups represented by $R_{10}$, $R_{20}$ and $R_{30}$.

Examples of the group represented by L include the same groups as set forth for $R_{10}$, $R_{20}$ and $R_{30}$, when m represents 1. When m represents an integer of 2 or more, they include a polymethylene group such as trimethylene, tetramethylene, hexamethylene, pentamethylene, octamethylene or dodecamethylene; an arylene group such as phenylene, biphenylene or naphthylene group; a multivalent alkylene group such as trimethylenemethyl or tetramethylenemethyl; a multivalent arylene group such as phenylene-1,3,5-toluyl or phenylene-,1,2,4,5-tetrayl; a group formed by combining these groups with —$SO_2$—, —SO—, —O—, —S—, —N($R_N$)—, —C(=O)— or =P(=O)— (wherein $R_N$ has the same meaning as defined above), for example, an alkylene or arylene group interrupted with a group of —COO—, —OCOO—, —NHCONH—, —CONH—, —$SO_2$—, —O—, —CONHCO— or —O—.

Examples of the counter anion represented by $X^{n-}$ include a halogen ion such as a chlorine, bromine or iodine ion; a carboxylate ion such as an acetate, oxalate, fumarate or benzoate ion; a sulfonate ion such as a p-toluenesulfonate, methanesulfonate, butanesulfonate or benzenesulfonate ion; a sulfuric acid ion; a perchloric acid ion; a carbonic acid ion; and a nitric acid ion.

In general formula (A-1), $R_{10}$, $R_{20}$ and $R_{30}$ each is preferably a group having 20 or less carbon atoms. When Q represents a phosphorus atom, an aryl group having 15 or less carbon atoms is particularly preferred, and when Q represents a nitrogen atom, an alkyl, aralkyl or aryl group having 15 or less carbon atoms is particularly preferred. m is preferably 1 or 2. When m represents 1, L is preferably a group having 20 or less carbon atoms, and particularly preferably an alkyl, aralkyl or aryl group having 15 or less carbon atoms. When m represents 2, the divalent organic group represented by L is preferably an alkylene group, an arylene group, an aralkylene group, or a divalent group formed by combining these groups with a group of —CO—, —O—, N(NR')— (wherein NR' represents a hydrogen atom or the same group as defined for $R_{10}$, $R_{20}$ and $R_{30}$, and when a plurality of NR' groups are present in a molecule, they may be the same or different, and may combine with each other), —S—, —SO— or —$SO_2$—. When m represents 2, L is preferably a divalent group having 20 or less carbon atoms bonded to $Q^+$ at its carbon atom. When m represents an integer of 2 or more, $R_{10}$, $R_{20}$ and $R_{30}$ each is plurally present, and each of plural $R_{10}$, plural $R_{20}$ and plural $R_{30}$ may be the same or different.

The counter anion represented by $X^{n-}$ is preferably a halogen ion, a carboxylate ion, a sulfonate ion or a sulfuric acid ion, and n is preferably 1 or 2.

Many of the compounds represented by general formula (A-1) of the present invention are known and commercially available as reagents. When Q is a phosphorus atom, a general synthesis method includes a method of reacting a phosphinic acid derivative with an alkylating agent such as an alkyl halide or sulfonate, and a method of exchanging a counter anion of a phosphonium salt in a conventional manner. When Q is a nitrogen atom, there is a method of reacting a primary, secondary or tertiary amino compound with an alkylating agent such as an alkyl halide or sulfonate.

Specific examples of the compound represented by general formula (A-1) are shown below, but the present invention should not be construed as being limited thereto.

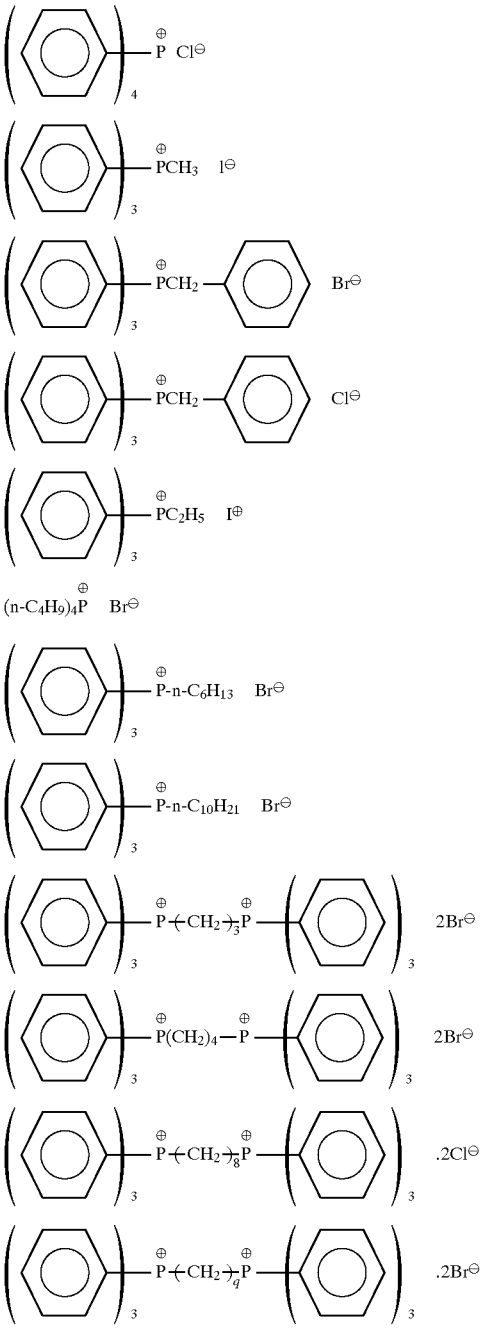

-continued
A-13
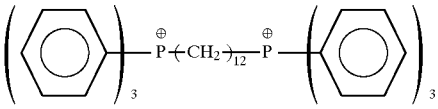
A-14
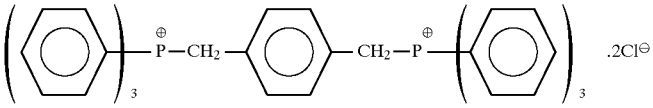
A-15
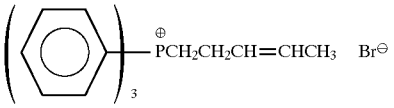
A-16
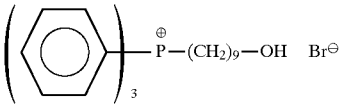
A-17
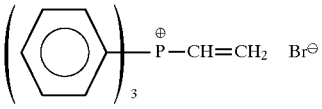
A-18
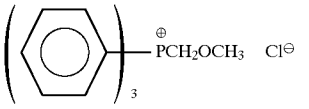
A-19
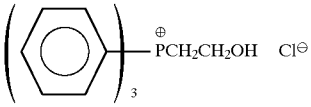
A-20
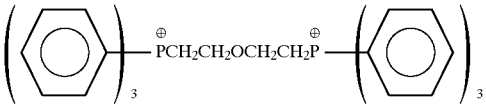
A-21
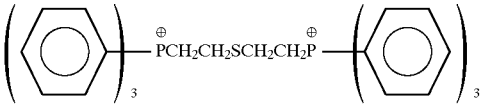
A-22
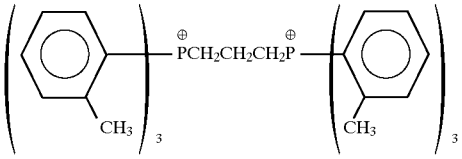
A-23
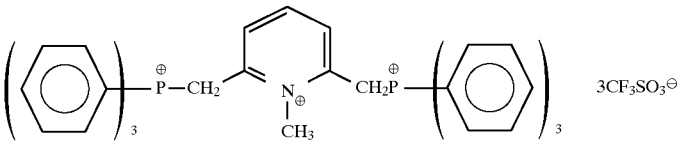
A-24
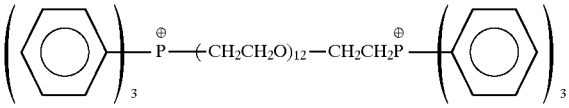
A-25
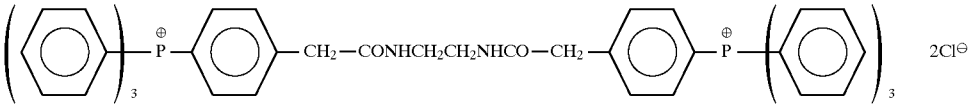
A-26
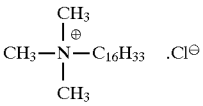

-continued
A-27
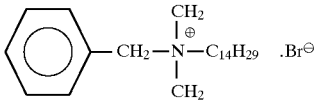
A-28
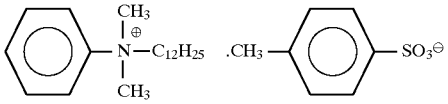
A-29
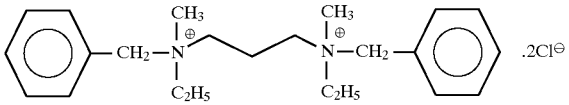
A-30
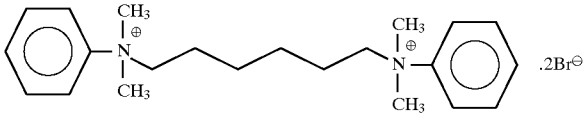
A-31
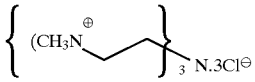
A-32
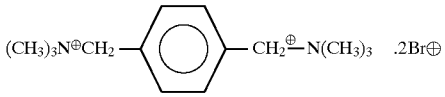
A-33
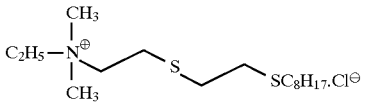
A-34
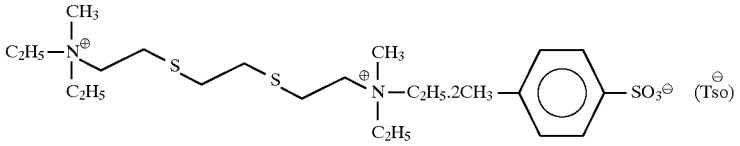
A-35
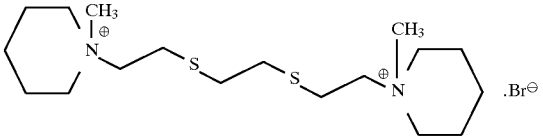
A-36
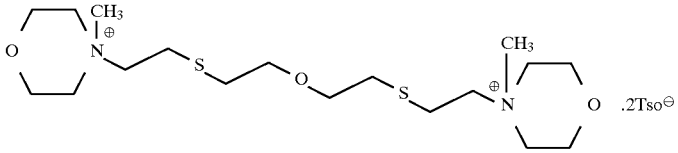
A-37
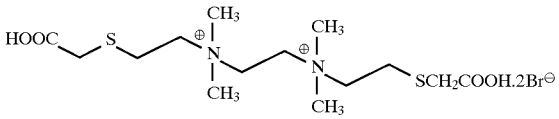
A-38
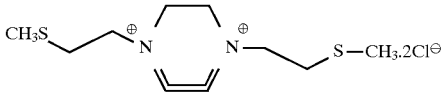
A-39
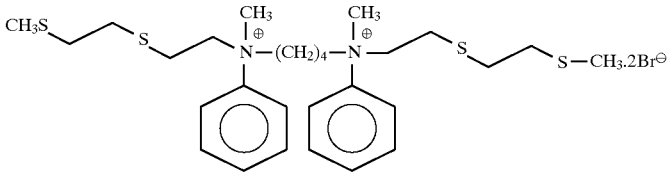

-continued

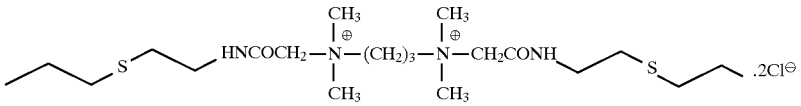

A-40

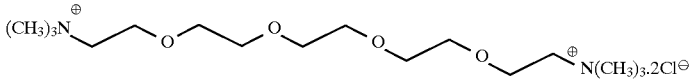

A-41

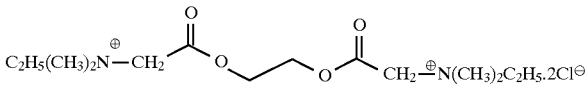

A-42

Then, the onium salt represented by general formula (A-2) or (A-3) is described in more detail below.

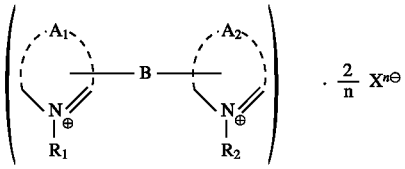

(A-2)

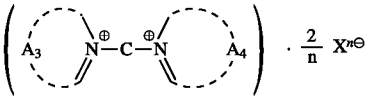

(A-3)

In the above formulae, $A_1$, $A_2$, $A_3$ and $A_4$ each represents an organic residue containing a quaternized nitrogen atom, for completing a substituted or unsubstituted unsaturated heterocyclic ring, and they may contain a carbon atom, a hydrogen atom, an oxygen atom, a nitrogen atom or a sulfur atom, and further may be condensed with a benzene ring. Examples of the unsaturated heterocyclic rings formed by $A_1$, $A_2$, $A_3$ and $A_4$ include a pyridine, quinoline, isoquinoline, imidazole, thiazole, thiadiazole, benzotriazole, benzothiazole, pyrimidine or pyrazole ring. Of these, a pyridine, quinoline or isoquinoline ring is particularly preferred.

The divalent groups represented by B and C each is preferably an alkylene, arylene, alkenylene, alkynylene, —$SO_2$—, —SO—, —O—, —S—, —N($R_N$)—, —C(=O)— or —P(=O)— group, which may be alone or a combination of two or more thereof, wherein $R_N$ represents an alkyl group, an aralkyl group, an aryl group or a hydrogen atom. Particularly preferred examples thereof include an alkylene, arylene, —C(=O)—, —O—, —S— or —N($R_N$)— group, which may be alone or a combination of two or more thereof.

$R_1$ and $R_2$, which may be the same or different, each is preferably an alkyl group having from 1 to 20 carbon atoms or an aralkyl group. The groups represented by $R_1$ and $R_2$ may be substituted by a substituent. Examples thereof include a halogen atom (for example, chlorine or bromine), a substituted or unsubstituted alkyl group (for example, methyl or hydroxyethyl), a substituted or unsubstituted aryl group (for example, phenyl, tolyl or p-chlorophenyl), a substituted or unsubstituted acyl group (for example, benzoyl, p-bromobenzoyl or acetyl), an (alkyl or aryl) oxycarbonyl group, a sulfo group (including a sulfonate), a carboxyl group (including a carboxylate), a mercapto group, a hydroxy group, an alkoxyl group (for example, methoxy or ethoxy), an aryloxy group, a carbonamido group, a sulfonamido group, a sulfamoyl group, a carbamoyl group, a ureido group, a thioureido group, an (alkyl or aryl)amino group, a cyano group, a nitro group, an alkylthio group and an arylthio group.

Particularly preferably, $R_1$ and $R_2$ are each an alkyl group having from 1 to 10 carbon atoms or an aralkyl group. Preferred examples of the substituent include a carbamoyl, oxycarbonyl, acyl, aryl, sulfo (including a sulfonate), carboxyl (including a carboxylate) or hydroxyl group.

The unsaturated heterocyclic ring formed by $A_1$, $A_2$, $A_3$ and $A_4$ together with the quaternized nitrogen atom may have a substituent. The substituent for use herein is selected, for example, from the substituents described above as the substituent for the group represented by $R_1$ or $R_2$. Preferred examples of the substituent include an aryl, alkyl, carbamoyl, (alkyl or aryl)amino, oxycarbonyl, alkoxyl, aryloxy, (alkyl or aryl)thio, hydroxy, carbonamido, sulfonamido, sulfo (including sulfonate) and carboxyl (including carboxylate) group, each of which has 0 to 10 carbon atoms.

The counter anion represented by $X^{n-}$ is the same as that in general formula (A-1), and preferred examples thereof are also the same.

While the compound for use in the present invention represented by general formula (A-2) or (A-3) can be easily synthesized by a generally well-known method, *Quart. Rev.*, 16, 163 (1962) provides useful information.

Specific examples of the compound represented by general formula (A-2) or (A-3).are shown below, but the present invention should not be construed as being limited thereto.

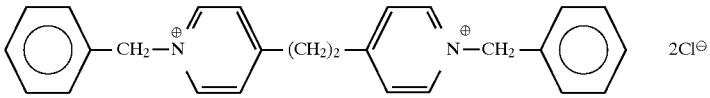

B-1

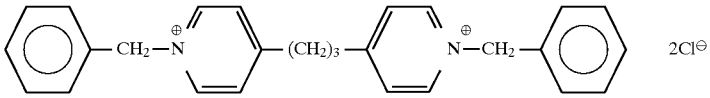

B-2

-continued
B-3
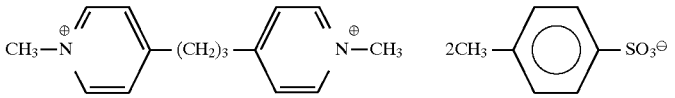
B-4
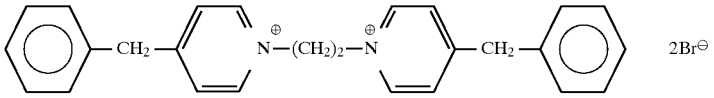
B-5
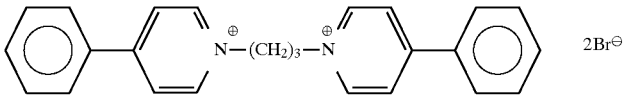
B-6
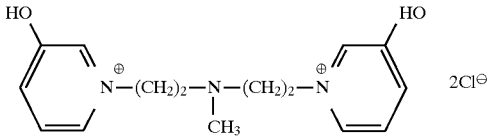
B-7
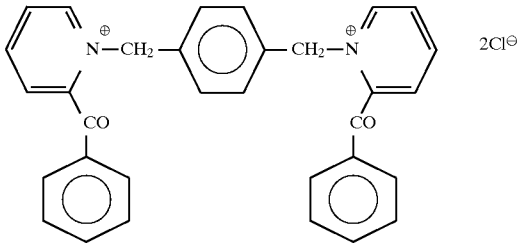
B-8
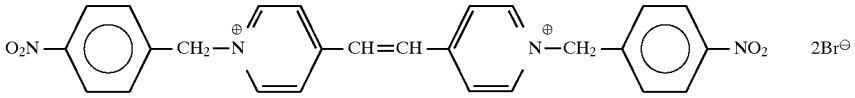
B-9
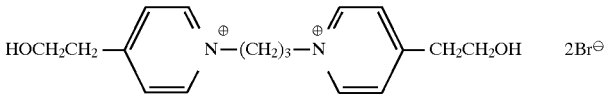
B-10
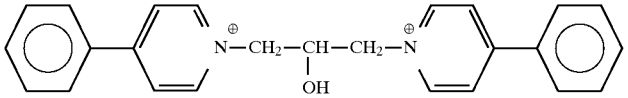
B-11
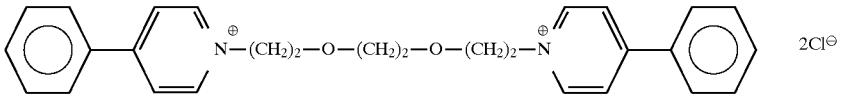
B-12
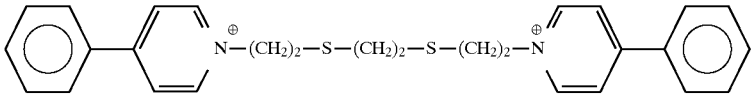
B-13
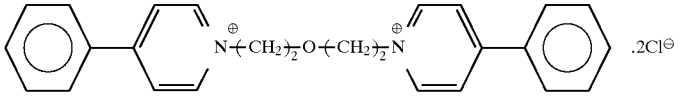
B-14
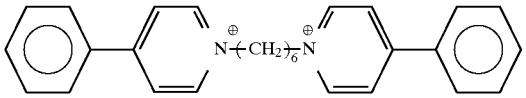
B-15
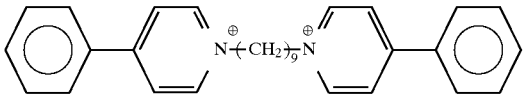

-continued
B-16
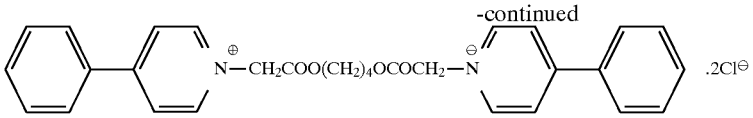
B-17
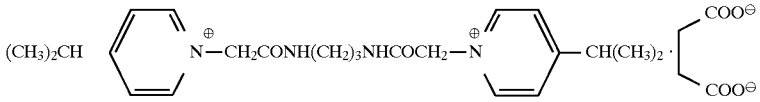
B-18
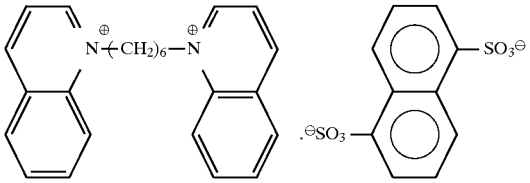
B-19
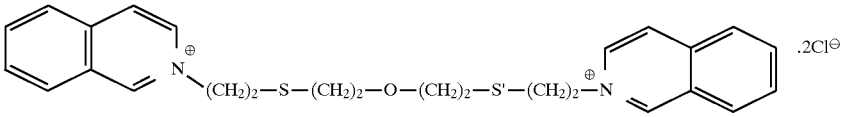
B-20
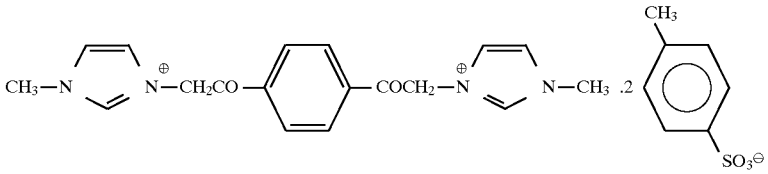
B-21
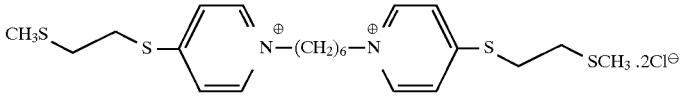
B-22
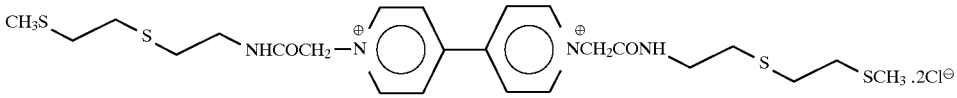
B-23
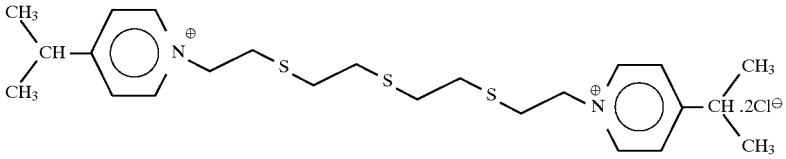
B-24
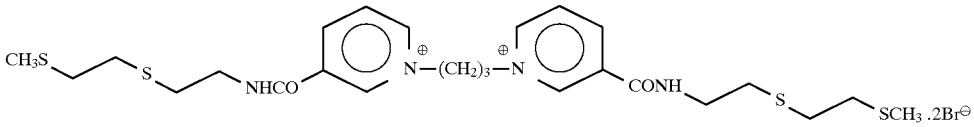
B-25
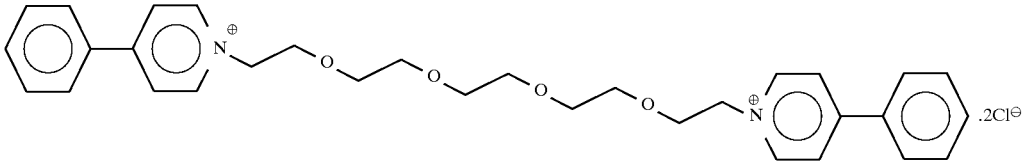
B-26
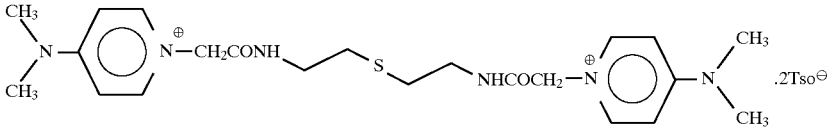
B-27
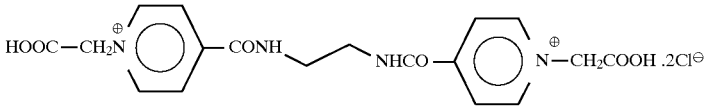

-continued

B-28

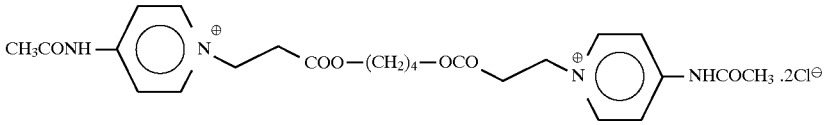

The onium salt represented by general formula (A-4) is described in more detail below.

(A-4)

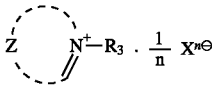

The nitrogen-containing unsaturated heterocyclic ring containing Z may further contain a carbon atom, a hydrogen atom, an oxygen atom or a sulfur atom in addition to the nitrogen atom, and further may be condensed with a benzene ring. Furthermore, the nitrogen-containing unsaturated heterocyclic ring may have a substituent. Examples of the heterocyclic ring formed include the nitrogen-containing unsaturated heterocyclic rings formed by $A_1$, $A_2$, $A_3$ or $A_4$ in general formula (A-2) or (A-3), and preferred examples thereof are also the same. A pyridine, quinoline or isoquinoline ring is preferred.

When the nitrogen-containing unsaturated heterocyclic ring containing Z has a substituent, examples of the substituent include those set forth as the substituent for the nitrogen-containing unsaturated heterocyclic ring formed by $A_1$, $A_2$, $A_3$ or $A_4$ in general formula (A-2) or (A-3), and preferred examples thereof are also the same.

$R_3$ represents an alkyl group, an alkenyl group, an alkynyl group or an aralkyl group, which has 1 to 20 carbon atoms, may be substituted or unsubstituted, and may be straight chain, branched chain or cyclic. Examples of the substituent include those set forth as the substituent for the group represented by $R_1$ or $R_2$ of general formula (A-2), and preferred examples thereof are also the same.

The counter anion represented by $X^{n-}$ is the same as that in general formula (A-1), and preferred examples thereof are also the same.

While the compound for use in the present invention represented by general formula (A-4) can be easily synthesized by a generally well-known method, *Quart. Rev.,* 16, 163 (1962) provides useful information.

Specific examples of the compound represented by general formula (A-4) are shown below, but the present invention should not be construed as being limited thereto.

C-1

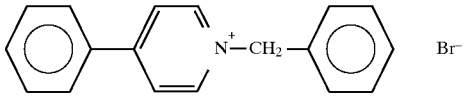

C-2

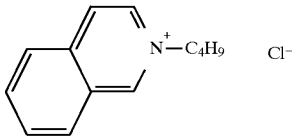

C-3

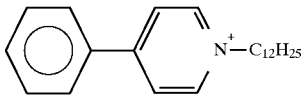

C-4

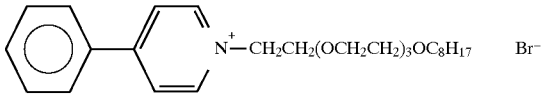

C-5

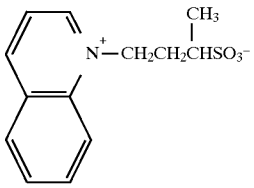

C-6

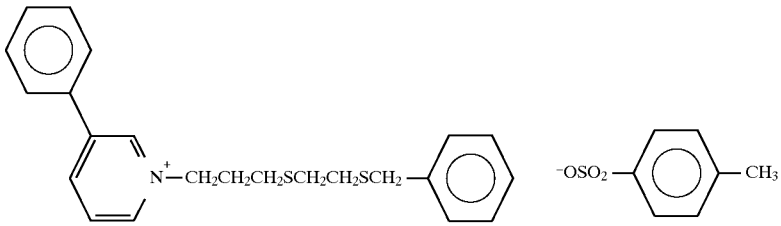

-continued

C-7

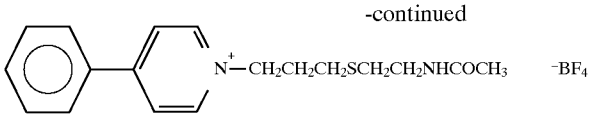

C-8

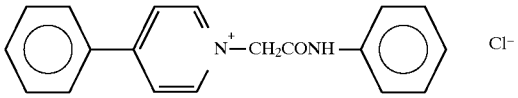

C-9

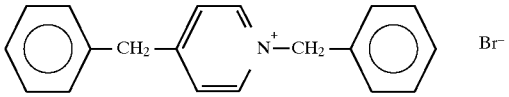

C-10

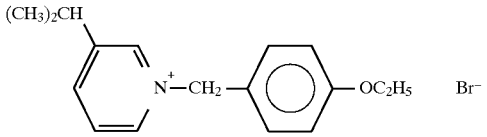

C-11

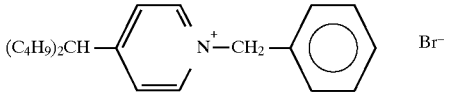

C-12

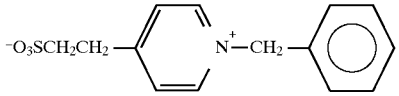

C-13

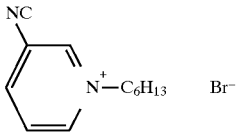

C-14

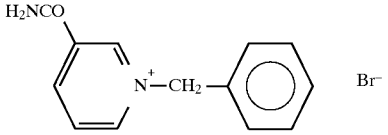

The nucleation accelerator for use in the present invention may be dissolved in an appropriate water-miscible organic solvent such as an alcohol (e.g., methanol, ethanol, propanol or a fluorinated alcohol), a ketone (e.g., acetone or methyl ethyl ketone), dimethylformamide, dimethylsulfoxide or methyl cellosolve in order to use.

Alternatively, the nucleation accelerator may be used in the form of an emulsified dispersion which is prepared by dissolving the nucleation accelerator according to a well known emulsion dispersion method using an oil such as dibutyl phthalate, tricresyl phosphate, glyceryl triacetate or diethylphthalate, or using an auxiliary solvent such as ethyl acetate or cyclohexanone and mechanically emulsifying and dispersing. Further, powder of the nucleation accelerator may be dispersed in water according to a method known as a solid dispersion method by means of a ball mill, a colloid mill or ultrasonic waves and then used.

The nucleation accelerator may be incorporated into the fine polymer particles containing the hydrazine compound for use in the present invention. When the nucleation accelerator is incorporated into the fine polymer particles for use in the present invention, the amount of the polymer used is preferably from 10 to 2000% by weight, particularly preferably from 20 to 1000% by weight, with respect to the weight of the nucleation accelerator.

The nucleation accelerator for use in the present invention may be added to any of silver halide emulsion layer(s) and other hydrophilic colloid layers provided on the silver halide emulsion layer side of the support, however, it is preferably added to the silver halide emulsion layer or a hydrophilic colloid layer adjacent thereto.

The nucleation accelerator of the present invention is preferably used in an amount of from $1\times10^{-6}$ to $2\times10^{-2}$ mol, more preferably from $1\times10^{-5}$ to $2\times10^{-2}$ mol, most preferably from $2\times10^{-5}$ to $1\times10^{-2}$ mol, per mol of silver halide.

Any of silver chloride, silver bromide, silver chlorobromide, silver chloroiodobromide and silver iodobromide may be used as silver halide in the silver halide emulsion according to the present invention. However, a silver chloride content in the silver halide emulsion is preferably not less than 30 mol %, more preferably not less than 50 mol %. On the other hand, a silver iodide content is not more than 5 mol %, more preferably not more than 2 mol %.

The form of silver halide grain may be any of a cubic tetradecahedral, octahedral, amorphous and plate-like form, but a cubic or plate-like form is preferred.

The photographic emulsion for use in the present invention can be prepared using a method described in P. Glafkides, *Chimie et Physique Photographique*, Paul Montel (1967); G. F. Duffin, *Photographic Emulsion Chemistry*, The Focal Press (1966); and V. L. Zelikman et al, *Making and Coating Photographic Emulsion*, The Focal Press (1964).

Specifically, any of an acidic process and a neutral process may be used. Also, a soluble silver salt may be reacted with a soluble halogen salt by any of a single jet method, a double jet method and a combination thereof.

A method of forming grains in the presence of excessive silver ions (so-called reverse mixing process) may also be used. As one of the double jet method, a method of maintaining the pAg constant in the liquid phase where silver halide is produced, that is, a so-called controlled double jet method may be used. Further, it is preferred to form grains using a so-called silver halide solvent such as ammonia, thioether or tetra-substituted thiourea, more preferably using a tetra-substituted thiourea compound as described in JP-A-53-82408 and JP-A-55-77737. Preferred examples of the thiourea compound include tetramethyl thiourea and 1,3-dimethyl-2-imidazolidinethione.

While an amount of the silver halide solvent to be added may be varied depending on the kind of the silver halide solvent used and the grain size and halide composition of silver halide to be desired, a range of from $10^{-5}$ to $10^{-2}$ mol per mol of silver halide is preferred.

According to the controlled double jet method or the method of forming grains using a silver halide solvent, a silver halide emulsion comprising regular crystal form grains and having a narrow grain size distribution can be easily prepared, and these methods are useful for preparing the silver halide emulsion for use in the present invention.

In order to achieve a uniform grain size, it is preferred to rapidly grow grains within the range of not exceeding the critical saturation degree, using a method of changing the addition rate of silver nitrate or alkali halide according to the grain growth rate as described in British Patent 1,535,016, JP-B-48-36890 and JP-B-52-16364, or a method of changing the concentration of the aqueous solution as described in U.S. Pat. No. 4,242,445 and JP-A-55-158124.

The emulsion for use in the present invention is preferably a monodisperse emulsion having a coefficient of variation thereof represented by the equation {(standard deviation of grain size/average grain size)×100} of not more than 20, more preferably not more than 15.

The average grain size of silver halide emulsion grain is preferably not more than 0.5 $\mu$m, more preferably from 0.1 to 0.4 $\mu$m.

The silver halide emulsion used in the present invention may contain a metal belonging to Group VIII. It is preferred to contain a rhodium compound, an iridium compound or a ruthenium compound in order to achieve high contrast and low fog. Also, an iron compound is incorporated into the silver halide emulsion for increasing its sensitivity.

The rhodium compound for use in the present invention is a water-soluble rhodium compound. Examples thereof include rhodium(III) halide compounds and rhodium complex salts having a halogen, an amine or an oxalato as a ligand, such as hexachlororhodium(III) complex salt, hexabromorhodium(III) complex salt, hexaaminerhodium (III) complex salt and trioxalatorhodium(III) complex salt. The rhodium compound is dissolved in water or an appropriate solvent prior to use and a method commonly used for stabilizing the rhodium compound solution, that is, a method of adding an aqueous solution of hydrogen halide (e.g., hydrochloric acid, hydrobromic acid or hydrofluoric acid) or an alkali halide (e.g., KCl, NaCl, KBr or NaBr) may be used. In place of using a water-soluble rhodium, separate silver halide grains which have been previously doped with rhodium may be added and dissolved at the time of preparation of silver halide.

Rhenium, ruthenium and osmium for use in the present invention are added in the form of a water-soluble complex salt as described, for example, in JP-A-63-2042, JP-A-1-285941, JP-A-2-20852 and JP-A-2-20855. Particularly preferred compounds are complexes having six ligands represented by the following formula:

$$[ML_6]^{n-}$$

wherein M represents Ru, Re or Os, and n represents 0, 1, 2, 3 or 4.

Herein, counter ions are not important and ammonium or alkali metal ions are used.

Examples of preferred ligands include a halide ligand, a cyanide ligand, a cyanate ligand, a nitrosyl ligand and a thionitrosyl ligand. Specific examples of the complexes for use in the present invention are shown below but the present invention should not be construed as being limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ | $[RuCl_5(NO)]^{2-}$ |
| $[RuBr_5(NS)]^{2-}$ | $[Ru(CN)_6]^{4-}$ | $[Ru(CO)_3Cl_3]^{2-}$ |
| $[Ru(CO)Cl_5]^{2-}$ | $[Ru(CO)Br_5]^{2-}$ | $[Os(NO)(CN)_5]^{2-}$ |
| $[OsCl_6]^{3-}$ | $[OsCl_5(NO)]^{2-}$ | $[Os(O)_2(CN)_4]^{4-}$ |
| $[Os(NS)Br_5]^{2-}$ | $[Os(CN)_6]^{4-}$ | |

The addition amount of these compounds is preferably from $1\times10^{-9}$ mol to $1\times10^{-5}$ mol, and particularly preferably from $1\times10^{-8}$ mol to $1\times10^{-6}$ mol, per mol of the silver halide.

The iridium compound used in the present invention includes hexachloroiridium, hexabromoiridium and hexaammineiridium. The ruthenium compound used in the present invention includes hexachlororuthenium and pentachloronitrosylruthenium. The iron compound used in the present invention includes potassium hexacyanoferrate(II) and ferrous thiocyanate.

The silver halide emulsion used in the present invention is preferably subjected to chemical sensitization. The chemical sensitization may be performed using a known method such as sulfur sensitization, selenium sensitization, tellurium sensitization or noble metal sensitization, and these sensitization methods may be used individually or in combination. When these sensitization methods are used in combination, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as a thiosulfate, a thiourea, a thiazole and a rhodanine. Preferred sulfur compounds are a thiosulfate and a thiourea compound. The addition amount of the sulfur sensitizer varies depending upon various conditions such as the pH and the temperature at the time of chemical ripening and the size of silver halide grain, however, it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, and JP-A-4-25832, JP-A-4-109240 and JP-A-4-324855.

Particularly, the compounds represented by general formulae (VIII) and (IX) of JP-A-4-324855 are preferably used.

The tellurium sensitizer for use in the present invention is a compound which forms silver telluride presumed to be a sensitization nucleus, on the surface or in the inside of a silver halide grain. The formation rate of silver telluride in a silver halide emulsion can be determined according to the method described in JP-A-5-313284.

Specific examples of the tellurium sensitizer include the compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), S. Patai (Ed.), *The Chemistry of Organic Selenium and Tellurium Compounds*, Vol. 1 (1986), and ibid., Vol. 2 (1987). The compounds represented by formulae (II), (III) and (IV) of JP-A-5-313284 are particularly preferred.

The amount of the selenium sensitizer or the tellurium sensitizer for use in the present invention varies depending upon silver halide grains used or chemical ripening conditions, however, it is usually approximately from $10^{-8}$ to $10^{-2}$ mol, preferably approximately from $10^{-7}$ to $10^{-3}$ mol, per mol of silver halide. The conditions for chemical sensitization in the present invention are not particularly limited, however, the pH is generally from 5 to 8, the pAg is generally from 6 to 11, preferably from 7 to 10, and the temperature is generally from 40° to 95° C., preferably from 45° to 85° C.

Examples of the noble metal sensitizer for use in the present invention include gold, platinum, palladium and iridium, and gold sensitization is particularly preferred. Specific examples of the gold sensitizer for use in the present invention include chloroauric acid, potassium chlorate, potassium aurithiocyanate and gold sulfide, and the gold sensitizer is used in an amount of approximately from $10^{-7}$ to $10^{-2}$ mol per mol of silver halide.

In the silver halide emulsion for use in the present invention, a cadmium salt, a sulfite, a lead salt or a thallium salt may be present during formation or physical ripening of silver halide grain.

In the present invention, reduction sensitization may be used. Examples of the reduction sensitizer which can be used include a stannous salt, an amine, formamidinesulfinic acid and a silane compound.

To the silver halide emulsion of the present invention, a thiosulfonic acid compound may be added according to the method described in European Unexamined Patent Publication EP-293917 A.

In the photographic light-sensitive material for use in the present invention, one kind of silver halide emulsion may be used or two or more kinds of silver halide emulsions (for example, those having different average grain sizes, different halogen compositions, different crystal habits, different chemical sensitization conditions or different sensitivities) may be used in combination. In order to obtain high contrast, it is preferred to provide an emulsion layer having higher sensitivity closer to a support as described in JP-A-6-324426.

The light-sensitive silver halide emulsion for use in the present invention may be spectrally sensitized using a sensitizing dye to a relatively long wavelength blue light, green light, red light and infrared light. Sensitizing dyes such as a cyanine dye, a merocyanine dye, a complex cyanine dye, a complex merocyanine dye, a holopolar cyanine dye, a styryl dye, a hemicyanine dye, an oxonol dye and a hemioxonol dye can be used.

Useful sensitizing dyes for use in the present invention are described in *Research Disclosure*, Vol. 176, No. 17643, Item IV-A, p. 23 (December, 1978), ibid., Vol. 183, No. 18341, Item X, p. 437 (August, 1979) or in the literatures referred to therein.

In particular, sensitizing dyes having spectral sensitivity suitable for spectral characteristics of light sources of various scanners, image setters and process cameras can be advantageously selected.

The following sensitizing dyes can be advantageously selected, for example, from A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, the compounds of Example 1 to Example 14 described in U.S. Pat. No. 2,161,331 and Compounds 1 to 7 described in West German Patent 936,071, B) for a helium-neon laser light source, Compounds I-1 to I-38 described in JP-A-54-18726, Compounds I-1 to I-35 described in JP-A-6-75322 and Compounds I-1 to I-34 described in JP-A-7-287338, C) for an LED light source, Dyes 1 to 20 described in JP-B-55-39818, Compounds I-1 to 1-37 described in JP-A-62-284343, and Compounds I-1 to I-34 described in JP-A-7-287338, D) for a semiconductor laser light source, Compounds I-1 to I-12 described in JP-A-59-191032, Compounds I-1 to I-22 described in JP-A-60-80841, Compounds I-1 to I-29 described in JP-A-4-335342 and Compounds I-1 to I-18 described in JP-A-59-192242, and E) for tungsten and xenon light sources for a process camera, Compounds (1) to (19) represented by general formula (I) described in JP-A-55-45015, Compounds I-1 to I-97 described in JP-A-9-160185 and Compounds 4-A to 4-S, 5-A to 5-Q and 6-A to 6-T described in JP-A-6-242547.

These sensitizing dyes may be used either alone or in combination thereof. A combination of sensitizing dyes is often used, in particular, for the purpose of supersensitization. There may be contained in a silver halide emulsion together with a sensitizing dye, a dye having no spectral sensitizing function per se or a material which does not substantially absorb visible light but exhibits supersensitization.

Examples of a combination of useful sensitizing dyes and dyes which exhibits supersensitization and examples of the material which exhibits supersensitization are described, for example, in *Research Disclosure* Vol. 176, No. 17643, page 23, Item IV-J (December, 1978), JP-B-49-25500, JP-B-43-4933, JP-A-59-19032 and JP-A-59-192242.

The sensitizing dyes for use in the present invention may be used in combination of two or more thereof. In order to incorporate the sensitizing dye into the silver halide emulsion of the present invention, it may be directly dispersed in the emulsion, or it may be dissolved in a single or mixed solvent, for example, of water, methanol, ethanol, propanol, acetone, methyl cellosolve, 2,2,3,3-tetra-fluoropropanol, 2,2,2-trifluoroethanol, 3-methoxy-1-propanol, 3-methoxy-1-butanol, 1-methoxy-2-propanol, N,N-dimethylformamide, and then added to the emulsion.

In addition, various methods can be used for the incorporation of the sensitizing dye into the emulsion, for example, a method in which the sensitizing dye is dissolved in a volatile organic solvent, the solution is dispersed in water or a hydrophilic colloid and the resulting dispersion is added to the emulsion as described in U.S. Pat. No. 3,469,987, a method in which the sensitizing dye is dissolved in acid and the solution is added to the emulsion, or the sensitizing dye is added to the emulsion as an aqueous solution coexisting with an acid or a base as described in JP-B-44-23389, JP-B-44-27555 and JP-B-57-22091, a method in which the sensitizing dye is added to the emulsion as an aqueous solution or a colloidal dispersion coexisting with a surfactant as described in U.S. Pat. Nos. 3,822,135 and 4,006,025, a method in which the sensitizing dye is directly dispersed in a hydrophilic colloid and the dispersion is added to the emulsion as described in JP-A-53-102733 and JP-A-58-105141, or a method in which the sensitizing dye is dissolved and the solution is added to the emulsion as described in JP-A-51-74624 can be used. Further, ultrasonic waves can be used for dissolution.

The time of the addition of the sensitizing dye for use in the present invention to the silver halide emulsion for use in the present invention may be at any stage of the preparation of the emulsion which is recognized as useful hitherto. For example, the sensitizing dye may be added at any stage if it is before coating, i.e., before grain formation stage of silver halide grains or/and before desalting stage, during desalting stage and/or after desalting and before beginning of chemical sensitization, as described in U.S. Pat. Nos. 2,735,766, 3,628,960, 4,183,756, 4,225,666, JP-A-58-184142 and JP-A-60-196749, or immediately before or during chemical ripening, after chemical ripening and before coating as described in JP-A-58-113920. Also, as described in U.S. Pat. No. 4,225,666 and JP-A-58-7629, the sensitizing dye can be used as a single compound alone or in combination with a compound having a different structure, and it can be divided and added separately, for example, one part of it is added during grain formation stage and the remaining is added during chemical ripening or after the completion of chemical ripening, otherwise one part is added prior to chemical ripening or during ripening stage and the remaining after completion of chemical ripening. The kinds of compounds separately added and combinations of compounds may be varied.

The addition amount of the sensitizing dye for use in the present invention is varied depending on the shape, size and halide composition of silver halide grain, the method and degree of chemical sensitization and the kind of antifoggant, but they can be used in an amount of from $4\times10^{-6}$ to $8\times10^{-3}$ mol per mol of the silver halide. For example, when the grain size of the silver halide grain is from 0.2 to 1.3 $\mu$m, the addition amount is preferably from $2\times10^{-7}$ to $3.5\times10^{-6}$ mol and more preferably from $6.5\times10^{-7}$ to $2.0\times10^{-6}$ mol per $m^2$ of the surface of the silver halide grain.

There is no particular limitation on various additives for use in the photographic light-sensitive material of the present invention and, for example, those described in the following can preferably be used.

Polyhydroxybenzene compound

Compounds described from line 11, right lower column, page 10 to line 5, left lower column, page 12 of JP-A-3-39948, specifically, Compounds (III)-1 to (III)-25 described therein.

Compound-which substantially does not have absorption maximum in visible region

Compounds represented by general formula (I) described in JP-A-1-118832, specifically, Compounds I-1 to I-26 described therein.

Antifoggant

Compounds described from line 19, right lower column, page 17 to line 4, right upper column, page 18 of JP-A-2-103536.

Polymer latex

Polymer latexes described from line 12, left lower column, page 18 to line 20, left lower column, the same page of JP-A-2-103536, polymer latexes having an active methylene group represented by general formula (I) described in JP-A-9-179228, specifically, Compounds I-1 to I-16 described therein, polymer latexes having a core/shell structure described in JP-A-9-179228, specifically, Compounds P-1 to P-55, and acidic polymer latexes described from line 1, left column, page 14 to line 30, right column, the same page of JP-A-7-104413, specifically, Compounds II-1 to II-9 described on page 15 thereof.

Matting agent, sliding agent and plasticizer

Compounds described from line 15, left upper column, page 19 to line 15, right upper column, the same page of JP-A-2-103536.

Hardening agent

Compounds described from line 5, right upper column, page 18 to line 17, right upper column, the same page of JP-A-2-103536.

Compound having acid radical

Compounds described from line 6, right lower column, page 18 to line 1, left upper column, page 19 of JP-A-2-103536.

Conductive material

Conductive materials described from line 13, left lower column, page 2 to line 7, right upper column, page 3 of JP-A-2-18542, specifically, metal oxides described from line 2, right lower column, page 2 to line 10, right lower column, the same page, and conductive polymer compounds P-1 to P-7 described therein.

Water-soluble dye

Water-soluble dyes described from line 1, right lower column, page 17 to line 18, right upper column, the same page of JP-A-2-103536.

Solid dispersion dye

Solid dispersion dyes represented by general formula (FA), general formula (FA1), general formula (FA2) and general formula (FA3) described in JP-A-9-179243, specifically, Compounds F1 to F34 described therein, Compounds (II-2) to (II-24), Compounds (III-5) to (III-18) and Compounds (IV-2) to (IV-7) described in JP-A-7-152112, and solid dispersion dyes described in JP-A-2-294638 and JP-A-5-11382.

Surfactant

Surfactants described from line 7, right upper column, page 9 to line 3, right lower column, the same page of JP-A-2-12236, PEG-based surfactants described from line 4, left lower column, page 18 to line 7, left lower column, the same page of JP-A-2-103536, and fluorine-containing surfactants described from line 6, left lower column, page 12 to line 5, right lower column, page 13 of JP-A-3-39948, specifically, Compounds VI-1 to VI-15 described therein.

Redox compound

Redox compounds capable of releasing a development inhibitor by oxidation described in JP-A-5-274816, preferably redox compounds represented by general formula (R-1), general formula (R-2) and general formula (R-3) described therein, specifically, Compounds R-1 to R-68 described therein.

Binder

Binders described from line 1 to line 20, right lower column, page 3 of JP-A-2-18542.

As a support of the photographic light-sensitive material for use in the present invention, for example, baryta paper, polyethylene-laminated paper, polypropylene synthetic paper, glass sheet, cellulose acetate, cellulose nitrate, and a polyester film, e.g., polyethylene terephthalate can be exemplified. The support is appropriately selected depending on the intended use of the silver halide photographic light-sensitive material.

Also, a support comprising a styrene polymer having a syndiotactic structure described in JP-A-7-234478 is preferably used.

Processing chemicals such as a developing solution and a fixing solution and processing methods according to the present invention are described below, but the present invention should not be construed as being limited to the following description and specific examples.

A developing agent for use in a developing solution (hereinafter, a developing starter and a developing replenisher are collectively referred to as a developing solution) of the present invention is not particularly limited, but it is preferred to contain a dihydroxybenzene, an ascorbic acid derivative and a hydroquinonemonosulfonate, alone or in combination.

In a preferred embodiment, the developing solution contains an ascorbic acid derivative developing agent and is substantially free from a dihydroxybenzene developing agent. The term "substantially free from" used herein means that the concentration of a dihydroxybenzene compound in the developing solution is not more than 0.1 g/liter of the developing solution.

In another preferred embodiment, the developing solution contains a dihydroxybenzene developing agent.

Further, from the viewpoint of developing capability, combinations of a dihydroxybenzene compound or an ascorbic acid compound with an 1-phenyl-3-pyrazolidone compound, or combinations of a dihydroxybenzene compound or an ascorbic acid compound with a p-aminophenol compound are preferred.

The dihydroxybenzene developing agent for use in the present invention includes hydroquinone, chlorohydroquinone, isopropylhydroquinone and methylhydroquinone, and hydroquinone is particularly preferred.

The ascorbic acid derivative developing agent which is preferably used in the present invention is a compound represented by the following general formula (1):

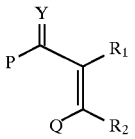

(1)

wherein $R_1$ and $R_2$ each represents a hydroxy group, an amino group, an acylamino group, an alkylsulfonylamino group, an arylsulfonylamino group, an alkoxycarbonylamino group, a mercapto group or an alkylthio group; P and Q each represents a hydroxy group, a hydroxyalkyl group, a carboxy group, a carboxyalkyl group, a sulfo group, a sulfoalkyl group, an amino group, an aminoalkyl group, an alkyl group, an alkoxy group or a mercapto group, or P and Q represent atomic groups which are connected to each other to form a 5- to 7-membered ring with the two vinyl carbon atoms on which $R_1$ and $R_2$ are substituted and the carbon atom on which Y is substituted; and Y represents ═O or ═N—$R_3$ wherein $R_3$ represents a hydrogen atom, a hydroxy group, an alkyl group, an acyl group, a hydroxyalkyl group, a sulfoalkyl group or a carboxyalkyl group.

In general formula (1), $R_1$ and $R_2$ each represents a hydroxy group, an amino group (including a group containing, as a substituent, an alkyl group having from 1 to 10 carbon atoms such as methyl, ethyl, n-butyl or hydroxyethyl), an acylamino group (e.g., acetylamino or benzoylamino), an alkylsulfonylamino group (e.g., methanesulfonylamino), an arylsulfonylamino group (e.g., benzenesulfonylamino or p-toluenesulfonylamino), an alkoxycarbonylamino group (e.g., methoxycarbonylamino), a mercapto group or an alkylthio group (e.g., methylthio or ethylthio). Preferred examples of $R_1$ and $R_2$ include a hydroxy group, an amino group, an alkylsulfonylamino group and an arylsulfonylamino group.

P and Q each represents a hydroxy group, a hydroxyalkyl group, a carboxy group, a carboxyalkyl group, a sulfo group, a sulfoalkyl group, an amino group, an aminoalkyl group, an alkyl group, an alkoxy group or a mercapto group, or P and Q represent atomic groups which are necessary to form a 5- to 7-membered ring when connected to each other with the two vinyl carbon atoms on which $R_1$ and $R_2$ are substituted and with the carbon atom on which Y is substituted. Specific examples of the ring structure include those comprising a combination of —O—, —C($R_4$)($R_5$)—, —C($R_6$)═, —C(═O)—, —N($R_7$)— and —N═, wherein $R_4$, $R_5$, $R_6$ and $R_7$ each represents a hydrogen atom, an alkyl group having from 1 to 10 carbon atoms which may be substituted (examples of the substituent include a hydroxy group, a carboxy group and a sulfo group), a hydroxy group or a carboxy group. Further, the 5- to 7-membered ring may be condensed to form a saturated or unsaturated ring.

Examples of the 5- to 7-membered ring include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring and a uracil ring, Preferred examples of these rings are a dihydrofuranone ring, a cyclopentenone ring, a cyclohexenone ring, a pyrazolinone ring, an azacyclohexenone ring and a uracil ring.

Y is a group composed of ═O or ═N—$R_3$, wherein $R_3$ represents a hydrogen atom, a hydroxy group, an alkyl group (e.g., methyl or ethyl), an acyl group (e.g., acetyl), a hydroxyalkyl group (e.g., hydroxymethyl or hydroxyethyl), a sulfoalkyl group (e.g., sulfomethyl or sulfoethyl) or a carboxyalkyl group (e.g., carboxymethyl or carboxyethyl).

Specific examples of the compound represented by general formula (I) are shown below, but the present invention should not be construed as being limited thereto.

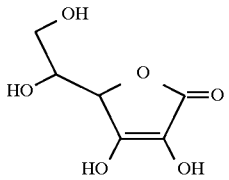

1-1

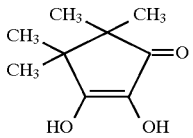

1-2

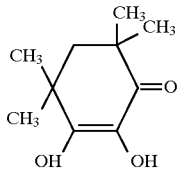

1-3

-continued
1-4
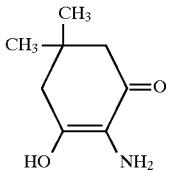
1-5
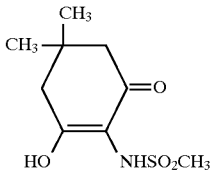
1-6
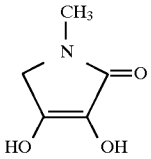
1-7
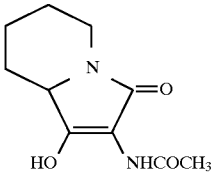
1-8
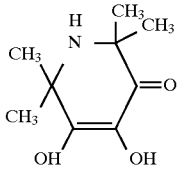
1-9
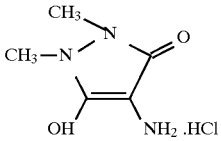
1-10
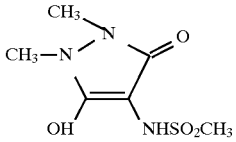
1-11
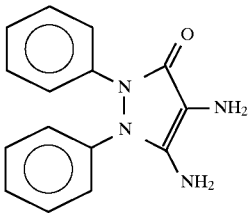
1-12
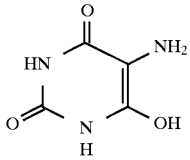
-continued
1-13
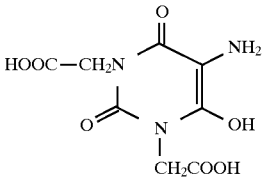
1-14
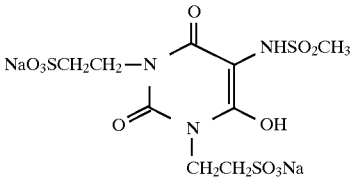
1-15
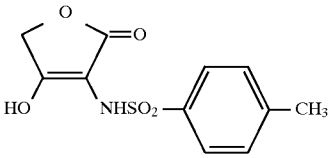
1-16
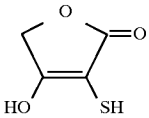
1-17
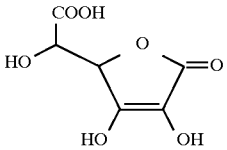
1-18
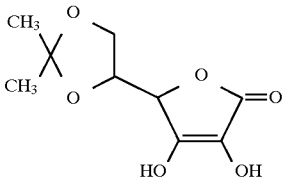
1-19
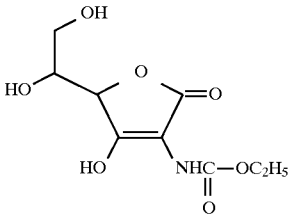
1-20
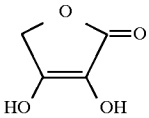
1-21
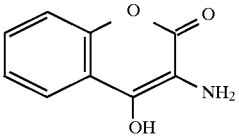
1-22
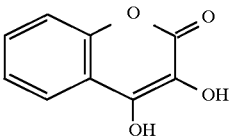

-continued 1-23

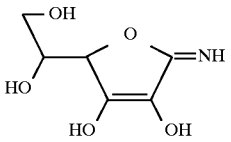

1-24

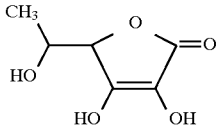

1-25

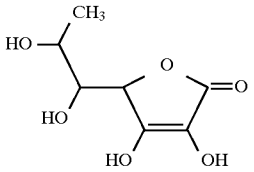

1-26

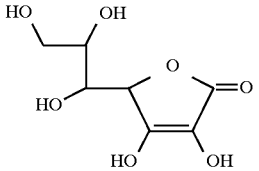

1-27

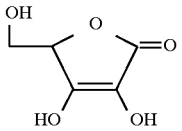

1-28

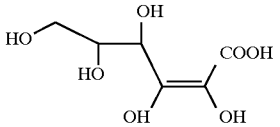

1-29

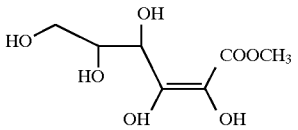

1-30

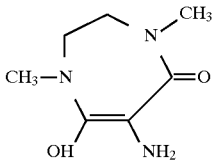

1-31

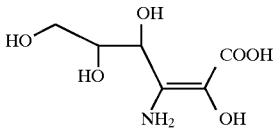

Among these compounds, ascorbic acid or erythorbic acid (diasteromer of ascorbic acid) is preferred.

The ascorbic acids used in the developer according to the present invention include conventionally known endiol form, enaminol form, endiamin form, thiol-enol form and enamin-thiol form. Examples of these compounds are described in U.S. Pat. No. 2,688,549 and JP-A-62-237443. Synthesis methods of the ascorbic acids are also well known and described, for example, in Tsugio Nomura and Hirohisa Kimura, *Reductone no Kagaku (Chemistry of Reductone)*, Uchidaroukakuenshinsha (1969).

The ascorbic acids may be used in the form of alkali metal salt such as lithium salt, sodium salt or potassium salt according to the present invention.

The 1-phenyl-3-pyrazolidone or a derivative thereof for use in the present invention as a developing agent includes 1-phenyl-3-pyrazolidone, 1-phenyl-4,4-dimethyl-3-pyrazolidone and 1-phenyl-4-methyl-4-hydroxymethyl-3-pyrazolidone.

The p-aminophenol developing agent for use in the present invention includes N-methyl-p-aminophenol, p-aminophenol, N-(m-hydroxyphenyl)-p-aminophenol, N-(4-hydroxyphenyl)glycine, o-methoxy-p-(N,N-dimethylamino)phenol, o-methoxy-p-(N-methylamino) phenol, N-methyl-p-aminophenol and aminophenols described in Japanese Patent Application Nos. 8-70908 and 8-70935. A p-aminophenol represented by the following general formula (A) is particularly preferred.

(A)

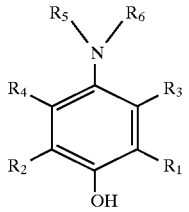

wherein $R_1$, $R_2$, $R_3$ and R4, which may be the same or different, each represents a hydrogen-atom or a substituent, and $R_5$ and $R_6$, which may be the same or different, each represents an alkyl group, an aryl group, an aralkyl group or a heterocyclic group.

The p-aminophenol represented by general formula (A) is described in detail below.

In general formula (A), $R_1$, $R_2$, $R_3$ and $R_4$ may be the same or different, and each represents a hydrogen atom or a substituent. Examples of the substituent include an alkyl group, an aryl group, an aralkyl group, a heterocyclic group, a halogen atom, a cyano group, a nitro group, a mercapto group, a hydroxy group, an alkoxy group, an aryloxy group, an alkylthio group, an arylthio group, an acyloxy group, an amino group, an alkylamino group, a carbonamido group, a sulfonamido group, a sulfamoylamino group, a ureido group, an acyl group, an oxycarbonyl group, a carbamoyl group, a sulfonyl group, a sulfinyl group, a sulfamoyl group, a carboxy group (including a salt thereof) and a sulfo group (including a salt thereof).

These groups each may be substituted with an alkyl group, an alkenyl group, an alkynyl group, an aryl group, a halogen atom, a cyano group, a nitro group, a hydroxy group, an alkoxy group, an alkylthio group, an amino group, an alkylamino group, an ammonio group, a carbonamido group, a sulfonamido group, a sulfamoylamino group, a ureido group, a carbamoyl group, a sulfamoyl group, a carboxy group (including a salt thereof), a sulfo group (including a salt thereof) or other substituents formed by an oxygen atom, a nitrogen atom, a sulfur atom or a carbon atom.

Examples of the substituent represented by $R_1$, $R_2$, $R_3$ or $R_4$ are described in more detail below. The alkyl group is a linear, branched or cyclic alkyl group having from 1 to 10 carbon atoms, and examples thereof include methyl, ethyl, propyl, isopropyl, t-butyl, cyclopentyl, cyclohexyl, benzyl, hydroxymethyl, 2-hydroxyethyl, 3-hydroxypropyl, 2,3-dihydroxypropyl and 2-methoxyethyl.

The aryl group is an aryl group having from 6 to 10 carbon atoms and examples thereof include phenyl, naphthyl and p-methoxyphenyl. The aralkyl group is an aralkyl group having from 7 to 10 carbon atoms and examples thereof include benzyl. The heterocyclic group is a 5- or 6-membered, saturated or unsaturated heterocyclic group constituted by a carbon atom, a nitrogen atom, an oxygen atom or a sulfur atom, in which the number of the hetero atom and the kind of the element may be single or in plurality, and examples thereof include 2-furyl, 2-pyrrolyl, 2-imidazolyl, 1-pyrazolyl, 2-pyridyl, 2-pyrimidyl and 2-thienyl. Examples of the halogen atom include fluorine and chlorine. The alkoxy group is an alkoxy group having from 1 to 10, preferably from 1 to 6 carbon atoms, and examples thereof include methoxy, ethoxy, propoxy, isopropoxy, 2-hydroxyethoxy, 3-hydroxypropoxy, 2-methoxyethoxy, hydroxyethoxyethoxy, 2,3-dihydroxypropoxy, 2-hydroxypropoxy and 2-methanesulfonylethoxy. The aryloxy group is an aryloxy group having from 6 to 10 carbon atoms and examples thereof include phenoxy, p-carboxyphenoxy and o-sulfophenoxy. The alkylthio group is an alkylthio group having from 1 to 10, preferably from 1 to 6 carbon atoms, and examples thereof include methylthio and ethylthio. The arylthio group is an arylthio group having from 6 to 10 carbon atoms and examples thereof include phenylthio and 4-methoxyphenylthio. The acyloxy group is an acyloxy group having from 1 to 10, preferably from 1 to 6 carbon atoms, and examples thereof include acetoxy and propanoyloxy.

The alkylamino group is an alkylamino group having from 1 to 10, preferably from 1 to 6 carbon atoms, and examples thereof include methylamino, diethylamino and 2-hydroxyethylamino. The carbonamido group is a carbonamido group having from 1 to 10, preferably from 1 to 6 carbon atoms, and examples thereof include acetamido and propionamido. The sulfonamido group is a sulfonamido group having from 1 to 10, preferably from 1 to 6 carbon atoms, and examples thereof include methanesulfonamido. The sulfamoylamino group is a sulfamoylamino group having from 0 to 10, preferably from 0 to 6 carbon atoms, and examples thereof include methylsulfamoylamino and dimethylsulfamoylamino. The ureido group is a ureido group having from 1 to 10, preferably from 1 to 6 carbon atoms, and examples thereof include ureido, methylureido and N,N-dimethylureido. The acyl group is an acyl group having from 1 to 10, preferably from 1 to 6 carbon atoms, and examples thereof include acetyl and benzoyl. The oxycarbonyl group is an oxycarbonyl group having from 1 to 10, preferably from 1 to 6 carbon atoms, and examples thereof include methoxycarbonyl and ethoxycarbonyl. The carbamoyl group is a carbamoyl group having from 1 to 10, preferably from 1 to 6 carbon atoms, and examples thereof include carbamoyl, N,N-dimethylcarbamoyl and N-ethylcarbamoyl. The sulfonyl group is a sulfonyl group having from 1 to 10, preferably from 1 to 6 carbon atoms, and examples thereof include methanesulfonyl and ethanesulfonyl. The sulfinyl group is a sulfinyl group having from 1 to 10, preferably from 1 to 6 carbon atoms, and examples thereof include methanesulfinyl. The sulfamoyl group is a sulfamoyl group having from 0 to 10, preferably from 0 to 6 carbon atoms, and examples thereof include sulfamoyl and dimethylsulfamoyl.

$R_5$ and $R_6$ in general formula (A) may be the same or different, and each represents an alkyl group, an aryl group, an aralkyl group or a heterocyclic group. The details of the respective groups are the same as described in $R_1$, $R_2$, $R_3$ or $R_4$, respectively. However, when $R_5$ and $R_6$ each is an alkyl group, they may be combined to form a 5- or 6-membered ring together with the nitrogen atom, and examples of the heterocyclic ring formed include pyrrolidine, piperidine, piperazine and morpholine. When at least one of $R_5$ and $R_6$ is an alkyl group and at least one of $R_3$ and $R_4$ is an alkyl group or an alkoxy group, they may be combined to form a condensed heterocyclic ring together with the nitrogen atom and the benzene ring, and examples of the 5- or 6-membered ring condensed to the benzene ring include indole, indoline, dihydroquinoline, tetrahydroquinoline and benzoxazine.

Two kinds of the compounds represented by general formula (A) may be combined on any carbon atom to form a bis type structure.

Of the compounds represented by general formula (A), the compound represented by the following general formula (B) is preferred.

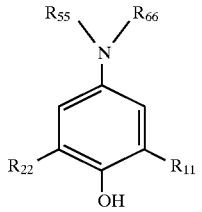

(B)

wherein $R_{11}$ and $R_{22}$ may be the same or different and each represents a hydrogen atom or a substituent; $R_{55}$ and $R_{66}$ may be the same or different and each represents an alkyl group, an aryl group, an aralkyl group or a heterocyclic group.

The preferred combination of $R_{11}$ or $R_{22}$ with $R_{55}$ or $R_{66}$ in general formula (B) is described below.

A preferred combination is such that $R_{11}$ and $R_{22}$ each is a hydrogen atom, an alkyl group, a hydroxy group, an alkoxy group, an amino group, an alkylamino group, a carbonamido group, a sulfonamido group, a sulfamoylamino group or a ureido group, and $R_{55}$ and $R_{66}$ each is an alkyl group. The alkyl group, the alkoxy group and the alkylamino group each includes those substituted with a substituent.

In the above-described combination, $R_{55}$ and $R_{66}$ each is more preferably an unsubstituted alkyl group or an alkyl group substituted with a water-soluble group. Examples of the water-soluble group includes a hydroxy group, an alkoxy group, an amino group, an alkylamino group, an ammonio group, a carbonamido group, a sulfonamido group, a sulfamoylamino group, a ureido group, a carbamoyl group, a sulfamoyl group, a carboxyl group (including a salt thereof) and a sulfo group (including a salt thereof).

More preferred compounds are compounds represented by general formula (B) wherein $R_{11}$ is a hydrogen atom, $R_{22}$ is an alkyl group, an alkoxy group, a carbonamido group, a sulfonamido group, a sulfamoylamino group or a ureido group, and $R_{55}$ and $R_{66}$ each is an alkyl group. The alkyl group, alkoxy group, carbonamido group, sulfonamido group, sulfamoylamino group and ureido group include those substituted with a hydroxy group, an alkoxy group, an amino group, an alkylamino group, an ammonio group, a carbonamido group, a sulfonamido group or a ureido group.

Still more preferred compounds are compounds represented by general formula (B) wherein $R_{11}$ is a hydrogen atom, $R_{22}$ is an alkyl group having from 1 to 3 carbon atoms, an alkoxy group having from 1 to 4 carbon atoms, a carbonamido group having from 1 to 3 carbon atoms, a sulfonamido group having from 1 to 3 carbon atoms or a ureido group having from 1 to 3 carbon atoms, and $R_{55}$ and $R_{66}$ each is an unsubstituted alkyl group. The alkyl group and alkoxy group represented by $R_{22}$ include those substituted with a hydroxy group, an alkoxy group, a carbonamido group or a sulfonamido group.

Most preferred compounds are compounds represented by general formula (B) wherein $R_{11}$ is a hydrogen atom, $R_{22}$ is an alkyl group having from 1 to 3 carbon atoms, an alkoxy group having from 1 to 4 carbon atoms, a carbonamido group having from 1 to 3 carbon atoms, a sulfonamido group having from 1 to 3 carbon atoms or a ureido group having from 1 to 3 carbon atoms, and $R_{55}$ and $R_{66}$ each is a methyl group. The alkyl group and alkoxy group represented by $R_{22}$ include those substituted with a hydroxy group or an alkoxy group.

Specific examples of the compound for use in the present invention are shown below, however, the present invention should not be construed as being limited thereto.

The compound represented by general formula (A) is very unstable when it is stored as a free amine, and in general, the compound is preferably produced and stored as an inorganic acid salt or an organic acid salt and, first, formed into a free amine upon the addition to the processing solution. Examples of the inorganic or organic acid for use in forming a salt of the compound represented by general formula (A) include hydrochloric acid, hydrobromic acid, sulfuric acid, p-toluenesulfonic acid, methanesulfonic acid and naphthalene-1,5-disulfonic acid. The compound is preferably formed into a salt of sulfuric acid or naphthalene-1,5-disulfonic acid.

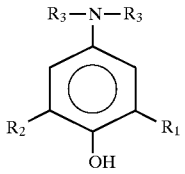

| No. | $R_1$ | $R_2$ | $R_3$ |
|---|---|---|---|
| A-1 | $-H$ | $-H$ | $-CH_3$ |
| A-2 | $-OCH_3$ | $-H$ | $-CH_3$ |
| A-3 | $-OCH_3$ | $-OCH_3$ | $-CH_3$ |
| A-4 | $-NHCOCH_3$ | $-H$ | " |
| A-5 | $-NHCOCH_3$ | $-NHCOCH_3$ | " |
| A-6 | $-NHCONHCH_3$ | $-H$ | " |
| A-7 | $-NHCONH_2$ | $-H$ | " |
| A-8 | $-CH_2OH$ | $-CH_2OH$ | " |
| A-9 | $-NHSO_2CH_2$ | $-H$ | " |
| A-10 | $-OH$ | $-H$ | " |
| A-11 | $-NH_2$ | $-H$ | " |
| A-12 | $-NHSO_2NH_2$ | $-H$ | " |
| A-13 | $-NHCH_3$ | $-H$ | $-CH_3$ |
| A-14 | $-NHSO_2N(CH_3)_2$ | " | " |
| A-15 | $-CH_3$ | $-CH_3$ | " |
| A-16 | $-CH_2\overset{\oplus}{N}(CH_3)_3\ Cl^{\ominus}$ | $-H$ | " |
| A-17 | $-H$ | " | $-C_2H_5$ |
| A-18 | $-OCH_3$ | " | " |
| A-19 | $-NHCONH_2$ | " | " |
| A-20 | $-NHCSNH_2$ | " | $-CH_3$ |
| A-21 | $-OCH_2CH_2NHSO_2CH_3$ | " | " |
| A-22 | $-OCH_2CH_2OH$ | " | " |
| A-23 | $-OCH_2CH_2OCH_3$ | " | " |
| A-24 | $-OCH_2CH_2CH_2OH$ | " | " |
| A-25 | $-OCH_2CH_2CH_2OCH_3$ | $-H$ | $-CH_3$ |
| A-26 | $-OCH_2CH(OH)CH_2OH$ | " | " |
| A-27 | $-OCH_2CH_2OCH_2HC_2OH$ | " | " |
| A-28 | $-OCH_2CH(OH)CH_3$ | " | " |
| A-29 | $-SC_2H_5$ | " | " |
| A-30 | $-SCH_2CH_2OH$ | " | " |
| A-31 | $-OCH(CH_3)_2$ | " | " |

-continued
| | | | |
|---|---|---|---|
| A-32 | $-Cl$ | " | " |
| A-33 | $-OC_2H_5$ | " | " |
| A-34 | $-OC_2H_4OCH_3$ | " | $-CH_2CH_2OCH_3$ |
| A-35 | $-NHCOCH_3$ | " | $-CH_2CH_2CH_2OH$ |
| A-36 | $-OC_2H_4OH$ | " | $-CH_2CH_2OH$ |
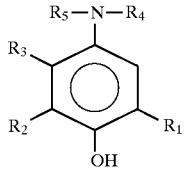
| No. | $R_1$ | $R_2$ | $R_3$ | $R_4$ | $R_5$ |
|---|---|---|---|---|---|
| A-37 | $-NHCOCH_3$ | $-H$ | $-H$ | 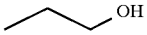 | 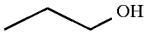 |
| A-38 | $-OCH_3$ | " | " | " | " |
| A-39 | " | $-OCH_3$ | " | " | " |
| A-40 | $-H$ | $-H$ | " | " | " |
| A-41 | " | " | $-CH_3$ | " | " |
| A-42 | $-OC_3H_6OH$ | " | $-H$ | $-CH_3$ | 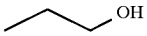 |
| A-43 | $-OCH_3$ | " | " | " | " |
| A-44 | $-NHCOCH_3$ | " | " | " | " |
| A-45 | $-NHCONH_2$ | " | " | " | 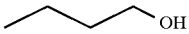 |
| A-46 | $-NHSO_2CH_3$ | " | " | " | " |
| A-47 | $-OC_2H_4OCH_3$ | " | " | " | " |
| A-48 | 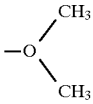 | " | " | 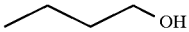 | 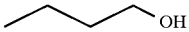 |
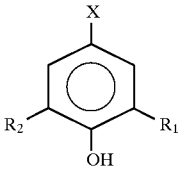
| No. | $R_1$ | $R_2$ | X |
|---|---|---|---|
| A-49 | $-H$ | $-HY$ | 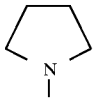 |
| A-50 | $-OCH_3$ | " | " |
| A-51 | $-OCH_3$ | $-OCH_3$ | 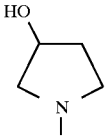 |
| A-52 | $-NHCONHCH_3$ | $-H$ | 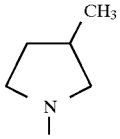 |

-continued
| | | | |
|---|---|---|---|
| A-53 | $-OCH_2CH_2OCH_3$ | $-H$ | 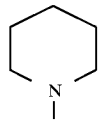 |
| A-54 | $-NHSO_2CH_3$ | $-H$ | 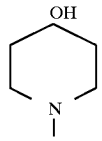 |
| A-55 | $-H$ | $-H$ | 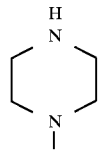 |
| A-56 | $-OCH_3$ | " | 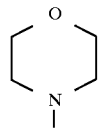 |
| A-57 | " | " | 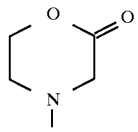 |
| A-58 | $-OC_3H_6OH$ | " | 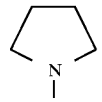 |
| A-59 | $-CH_2OH$ | $-CH_2OH$ | " |
| A-60 | $-H$ | $-H$ | 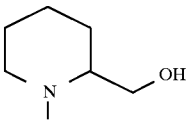 |
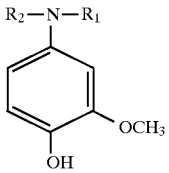
| No. | $R_1$ | $R_2$ |
|---|---|---|
| A-61 | $-CH_3$ | 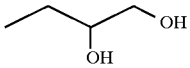 |
| A-62 | 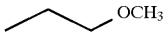 | 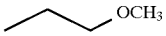 |
| A-63 | 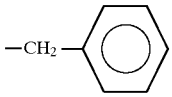 | 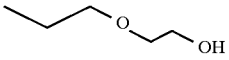 |
| A-64 | $-CH_3$ | 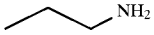 |

-continued
| | | | |
|---|---|---|---|
| A-65 | $-CH_3$ | | $NHSO_2CH_3$ |
| A-66 | $NHCOCH_3$ | | $NHCOCH_3$ |
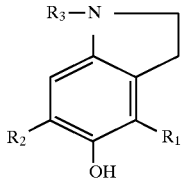
| No. | $R_1$ | $R_2$ | $R_3$ |
|---|---|---|---|
| A-67 | $-H$ | $-H$ | OH, OH |
| A-68 | $-OCH_3$ | " | " |
| A-69 | $-NHCONH_2$ | " | " |
| A-70 | " | $-NHSO_2CH_3$" | OH |
| A-71 | $-OCH_3$ | $-OCH_3$ | OH |
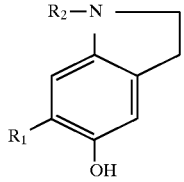
| No. | $R_1$ | $R_2$ |
|---|---|---|
| A-72 | $-H$ | OH |
| A-73 | $-OCH_3$ | " |
| A-74 | $-H$ | O, OH |
| A-75 | $-OCH_3$ | " |
| A-76 | $-H$ | O, O, $OCH_3$ |
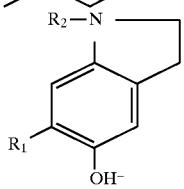
| No. | $R_1$ | $R_2$ |
|---|---|---|
| A-77 | $-H$ | OH |
| A-78 | $-N(CH_3)_2$ | " |
| A-79 | $CH_3$, O | " |
| A-80 | $-CO_2H$ | $-CH_3$ |

-continued
A-81
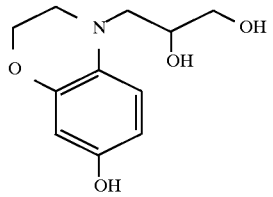
A-82
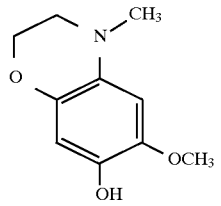
A-83
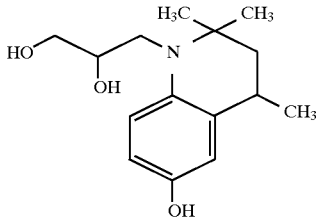
A-84
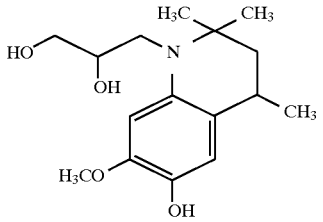
A-85
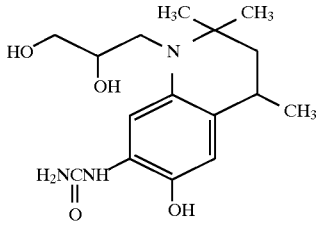
A-86
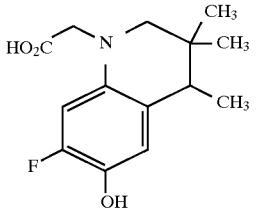
A-87
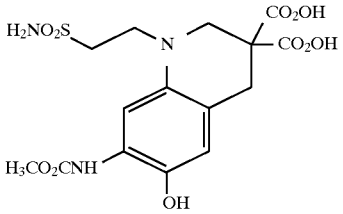

-continued
A-88
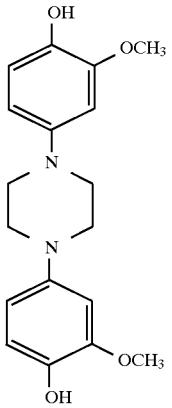
A-89
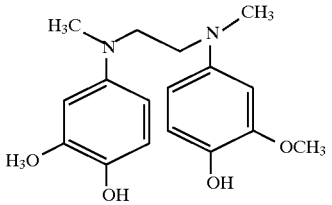
A-90
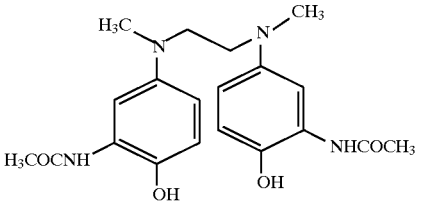
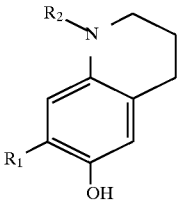
| No. | $R_1$ | $R_2$ |
|---|---|---|
| A-91 | $-OCH_3$ | $-CH_3$ |
| A-92 | $-H$ | 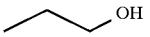 |
| A-93 | " | 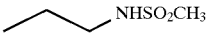 |
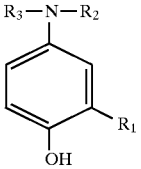
| No. | $R_1$ | $R_2$ | $R_3$ |
|---|---|---|---|
| A-94 | $-SH$ | 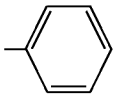 | 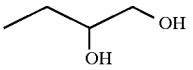 |
| A-95 | $-SCH_3$ | $-CH_3$ | $-C_3H_6-OH$ |

-continued

| | | | |
|---|---|---|---|
| A-96 | $-COOCH_3$ | 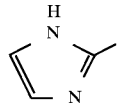 | " |
| A-97 | $-CONH_2$ | 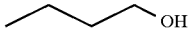 | " |
| A-98 | 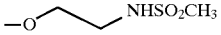 | $-CH_3$ | " |
| A-99 | $-CH_2OH$ | " | $-CH_3$ |
| A-100 | 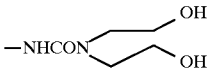 | " | " |
| A-101 | $-H$ | 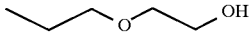 | 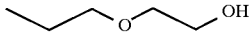 |
| A-102 | $-OCH_3$ | " | " |
| A-103 | $-COCH_3$ | $-CH_3$ | $-CH_3$ |
| A-104 | $-CONH_2$ | " | " |
| A-105 | 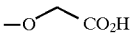 | " | " |

The compound represented by general formula (A) can be easily synthesized according to a general synthesis method described, for example, in *Photographic Science and Engineering,* 10, 306 (1966) and with reference to the synthesis example described in Japanese Patent Application No. 8-70908.

The dihydroxybenzene developing agent is, in general, preferably used in an amount of from 0.05 to 0.8 mol/liter. When the dihydroxybenzene is used in combination with the 1-phenyl-3-pyrazolidone or-the p-aminophenol, the amount of the former is preferably from 0.05 to 0.6 mol/liter, more preferably from 0.23 to 0.5 mol/liter, and that of the latter is preferably 0.06 mol/liter or less, more preferably from 0.03 to 0.003 mol/liter.

The ascorbic acid derivative developing agent is, in general, preferably used in an amount of from 0.01 to 0.5 mol/liter, more preferably from 0.05 to 0.3 mol/liter. Further, when the ascorbic acid derivative is used in combination with the 1-phenyl-3-pyrazolidone or p-aminophenol, the amount of the former is preferably from 0.01 to 0.5 mol/liter, and that of the latter is preferably from 0.005 mol/liter to 0.2 mol/liter.

A developing solution for processing the photographic light-sensitive material in the present invention can contain a conventionally used additive (e.g., a developing agent, an alkali agent, a pH buffer, a preservative or a chelating agent). Specific examples thereof are shown below but the present invention should not be construed as being limited thereto.

The buffer which is used in the developing solution for developing the photographic light-sensitive material in the present invention includes carbonate, boric acid described in JP-A-62-186259, saccharides (e.g., saccharose) described in JP-A-60-93433, oximes (e.g., acetoxime), phenols (e.g., 5-sulfosalicylic acid) and tertiary phosphates (e.g., sodium salt or potassium salt), and carbonates and boric acid are preferably used. The use amount of the buffer, in particular a carbonate, is preferably 0.1 mol/liter or more, particularly preferably from 0.2 to 1.5 mol/liter.

Examples of the preservatives which can be used in the developing solution for use in the present invention include sodium sulfite, potassium sulfite, lithium sulfite, ammonium sulfite, sodium bisulfite, potassium metabisulfite, and sodium formaldehyde bisulfite. Preferred amount of the sulfite preservative is 0.2 mol/liter or more, particularly preferably 0.3 mol/liter or more. However, when it is used in an excessive amount, silver contamination of the developing solution may occur, thus the upper limit is preferably 1.2 mol/liter, and particularly preferred addition amount is from 0.35 to 0.7 mol/liter.

A small amount of the ascorbic acid derivative may be used in combination with the sulfite as a preservative for dihydroxybenzene developing agent. The use of sodium erythorbate is preferred in view of cost. The amount thereof added is preferably from 0.03 to 0.12, particularly preferably from 0.05 to 0.10, in terms of molar ratio to dihydroxybenzene developing agent. When the ascorbic acid derivative is used as a preservative, it is preferred not to contain a boron compound in the developing solution.

Other additives than the above described compounds which can be used in the present invention include a development inhibitor such as sodium bromide or potassium bromide; an organic solvent such as ethylene glycol, diethylene glycol, triethylene glycol or dimethylformamide; a development accelerator such as an alkanolamine, e.g., diethanolamine or triethanolamine, an imidazole or a derivative thereof; and an inhibitor of physical development unevenness such as a heterocyclic mercapto compound (e.g., sodium 3-(5-mercaptotetrazol-1-yl)benzenesulfonate or 1-phenyl-5-mercaptotetrazole) and the compounds described in JP-A-62-212651.

Further, a mercapto based compound, an indazole based compound, a benzotriazole based compound and a benzimidazole based compound can be used as an antifoggant or a black pepper inhibitor in the developing solution. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]-butanesulfonate, 5-amino-1,3,4-thiadiazole-2-thiol, 5-methylbenzotriazole, and 2-mercaptobenzotriazole.

The amount of such an additive is, in general, preferably from 0.01 to 10 mmol, more preferably from 0.1 to 2 mmol, per liter of the developing solution.

Further, various kinds of organic and inorganic chelating agents can be used alone or in combination in the developing solution for use in the present invention.

Examples of the inorganic chelating agents include sodium tetrapolyphosphate and sodium hexametaphosphate.

On the other hand, examples of the organic chelating agents include an organic carboxylic acid, an aminopolycarboxylic acid, an organic phosphonic acid, an aminophosphonic acid, and an organic phosphonocarboxylic acid.

Examples of the organic carboxylic acid include acrylic acid, oxalic acid, malonic acid, succinic acid, glutaric acid, gluconic acid, adipic acid, pimelic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and the compounds described in JP-A-52-25632, JP-A-55-67747, JP-A-57-102624, and JP-B-53-40900.

Examples of the organic phosphonic acids include the hydroxyalkylidenediphosphonic acids described in U.S. Pat. Nos. 3,214,454, 3,794,591 and West German Patent Application Laid Open No. 2,227,639, and the compounds described in *Research Disclosure*, Vol. 181, Item 18170 (May, 1979).

Examples of the aminophosphonic acids include aminotris(methylenephosphonic acid), ethylenediaminetetramethylenephosphonic acid, aminotrimethylenephosphonic acid, and the compounds described in *Research Disclosure*, Vol. 181, Item 18170, JP-A-57-208554, JP-A-54-61125, JP-A-55-29883 and JP-A-56-97347.

Examples of the organic phosphonocarboxylic acids include the compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure*, Vol. 181, Item 18170.

The organic and/or inorganic chelating agents are not limited to the above-described compounds and they may be used in the form of an alkali metal salt or an ammonium salt. The amount of the chelating agent used is preferably from $1\times10^{-4}$ to $1\times10^{-1}$ mol, more preferably from $1\times10^{-3}$ to $1\times10^{-2}$ mol, per liter of the developing solution.

Further, the developing solution can contain the following compounds as a silver contamination preventing agent. Specifically, in addition to the compounds described in JP-A-56-24347, JP-B-56-46585, JP-B-62-2849, JP-A-4-362942 and JP-A-8-6215, a triazine having one or more mercapto groups (e.g., the compounds described in JP-B-6-23830, JP-A-3-282457 or JP-A-7-175178), a pyrimidine having one or more mercapto groups (e.g., 2-mercaptopyrimidine, 2,6-dimercaptopyrimidine, 2,4-dimercaptopyrimidine, 5,6-diamino-2,4-dimercaptopyrimidine or 2,4,6-trimercaptopyrimidine), a pyridine having one or more mercapto groups (e.g., 2-mercaptopyridine, 2,6-dimercaptopyridine, 3,5-dimercaptopyridine, 2,4,6-trimercaptopyridine or the compounds described in JP-A-7-248587), a pyrazine having one or more mercapto groups (e.g., 2-mercaptopyrazine, 2,6-dimercaptopyrazine, 2,3-dimercaptopyrazine or 2,3,5-trimercaptopyrazine), a pyridazine having one or more mercapto groups (e.g., 3-mercaptopyridazine, 3,4-dimercaptopyridazine, 3,5-dimercaptopyridazine or 3,4,6-trimercaptopyridazine), the compounds described in JP-A-7-175177, and a polyoxyalkylphosphonate described in U.S. Pat. No. 5,457,011 are illustrated. The silver contamination preventing agent can be used alone or in combination of two or more, and it is used in an amount of preferably from 0.05 to 10 mmol, more preferably from 0.1 to 5 mmol, per liter of the developing solution.

Moreover, the compounds described in JP-A-61-267759 can be used as a dissolution aid.

Furthermore, if desired, the developing solution may contain a toning agent, a surfactant, a defoaming agent and a hardening agent.

The pH of the developing solution is preferably in a range of from 8.0 to 12.0, and particularly preferably in a range of from 9.0 to 11.0. As an alkali agent which is used for adjusting pH, a conventional water-soluble inorganic alkali metal salt (e.g., sodium hydroxide, potassium hydroxide, sodium carbonate or potassium carbonate) can be used.

With regard to the cation in the developing solution, a potassium ion does not inhibit development so much as a sodium ion does, and provides less fringes around the blackened portion as compared with a sodium ion. Further, when the developing solution is preserved as a concentrated solution, a potassium salt has, in general, higher solubility and thus preferred. However, since a potassium ion in a fixing solution inhibits fixation in almost the same degree as a silver ion does, if the potassium ion concentration in a developing solution is high, the potassium ion concentration in a fixing solution becomes high by the developing solution carried over with a photographic material, which is not preferred. Accordingly, the molar ratio of the potassium ion to the sodium ion in the developing solution is preferably from 20/80 to 80/20. The ratio of the potassium ion to the sodium ion in the developing solution can be appropriately adjusted within the above described range by a counter cation of the additive, for example, a pH buffer, a pH adjustor, a preservative or a chelating agent.

A replenishing rate of the developing solution is generally 390 ml or less per $m^2$ of the photographic light-sensitive material, and preferably from 30 to 325 ml, more preferably from 120 to 180 ml, per $m^2$ of the photographic light-sensitive material. The composition and/or the concentration of the developing replenisher may be the same as or different from those of a developing starter.

For reducing transportation cost of the processing solution, reducing cost of packaging materials for the processing solution and saving storage space of the processing solution, the processing solution is preferably produced in the concentrated form and then diluted before use.

Ammonium thiosulfate, sodium thiosulfate and sodium ammonium thiosulfate can be used as a fixing agent of fixing processing chemicals in the present invention. The amount of the fixing agent used can be varied appropriately and is generally from about 0.7 to about 3.0 mol/liter.

The fixing solution for use in the present invention may contain a water-soluble aluminum salt and a water-soluble chromium salt, which functions as a hardening agent. Preferred compound is a water-soluble aluminum salt, e.g., aluminum chloride, aluminum sulfate, potassium alum, aluminum ammonium sulfate, aluminum nitrate or aluminum lactate. The salt compounds is preferably contained in an amount of from 0.01 to 0.15 mol/liter in terms of an aluminum ion concentration in the working solution.

When the fixing solution is preserved as a concentrated solution or a solid agent, it may comprise a plurality of parts with a hardening agent being a separate part, or it may comprise one part type including all the components.

The fixing processing chemicals can contain, if desired, a preservative (e.g., sulfite, bisulfite or metabisulfite, in an amount of 0.015 mol/liter or more, preferably from 0.02 mol/liter to 0.3 mol/liter), a pH buffer (e.g., acetic acid, sodium acetate, sodium carbonate, sodium hydrogencarbonate, phosphoric acid, succinic acid or adipic acid, in an amount of from 0.1 mol/liter to 1 mol/liter, preferably from 0.2 mol/liter to 0.7 mol/liter), and a compound having capability of stabilizing aluminum and capability of softening hard water (e.g., gluconic acid, iminodiacetic acid, 5-sulfosalicylic acid, glucoheptanic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, a derivative thereof and a salt thereof, a saccharide and boric acid, in an amount of from 0.001 mol/liter to 0.5 mol/liter, preferably from 0.005 mol/liter to 0.3 mol/liter).

The fixing processing chemicals may contain, if desired, the compounds described in JP-A-62-78551, a pH adjustor (e.g., sodium hydroxide, ammonia or sulfuric acid), a surfactant, a wetting agent and a fixing accelerator. Specific examples of the surfactants include an anionic surfactant (e.g., a sulfated product or a sulfonated product), a polyethylene based surfactant, or an amphoteric surfactant described in JP-A-57-6840. Also, a known defoaming agent can be used. Specific examples of the wetting agents include an alkanolamine and an alkylene glycol. Specific examples of the fixing accelerators include an alkyl- or aryl-substituted thiosulfonic acid and the salt thereof, the thiourea derivative described in JP-B-45-35754, JP-B-58-122535 and JP-B-58-122536, an alcohol having a triple bond in the molecule, the thioether compound described in U.S. Pat. No. 4,126,459, the mercapto compound described in JP-A-1-4739, JP-A-1-159645 and JP-A-3-101728, the mesoionic compound described in JP-A-4-170539, and a thiocyanate.

The pH of the fixing solution for use in the present invention is 4.0 or more and preferably from 4.5 to 6.0. The pH of the fixing solution rises in processing by mixing of a developing solution thereinto. In such a case the pH of a hardening fixing solution is 6.0 or less, preferably 5.7 or less, and that of a non-hardening fixing solution is 7.0 or less, preferably 6.7 or less.

A replenishing rate of the fixing solution is generally 500 ml/m$^2$ or less, preferably 390 ml/m$^2$ or less, more preferably from 80 to 320 ml/m$^2$, of the photographic light-sensitive material processed. The compositions and/or the concentration of the fixing replenisher may be the same as or different from those of a fixing starter.

Silver recovery from the fixing solution can be carried out according to a known regeneration method of fixing solution, such as electrolytic silver recovery, and the regenerated solution after the silver recovery can be used in the present invention. As such a regenerating device, Reclaim R-60 manufactured by Fuji Hunt Co., Ltd. can be exemplified.

Further, removal of dyes and the like using an adsorptive filter such as an activated carbon is also preferred.

The photographic material is subjected to washing or stabilization processing after being developed and fixed (hereinafter "washing" includes stabilization processing therein and the solution used therefor is called water or washing water, unless otherwise indicated). The water which is used for washing may be any of tap water, ion exchange water, distilled water and a stabilizing solution. A replenishing rate thereof is, in general, from about 8 liters to about 17 liters per m$^2$ of the photographic material, but the washing can be carried out with the less replenishing rate. In particular, with a replenishing rate of 3 liters or less (including zero, i.e., washing in a reservoir), not only water saving processing can be carried out but also piping for installation of an automatic processor is not required. When the washing is carried out with a reduced amount of water, it is preferred to use a washing tank equipped with a squeeze roller or a crossover roller described in JP-A-63-18350 and JP-A-62-287252. The addition of various kinds of oxidizing agents (e.g., ozone, hydrogen peroxide, sodium hypochlorite, activated halogen, chlorine dioxide or sodium carbonate hydrogen peroxide) and the provision of filter for filtration may be combined in order to reduce load for prevention of environmental pollution which becomes a problem when washing is carried out with a small amount of water and in order to prevent the generation of scale.

As a means of reducing the replenishing rate of the washing water, a multistage countercurrent system (e.g., two stages or three stages) has been known. The replenishing rate of the washing water in this system is preferably from 50 to 200 ml per m$^2$ of the photographic material. This is also achieved in an independent multistage system (a method which is not a countercurrent system and fresh solution is replenished separately to multistage washing tanks).

Further, a means of preventing the generation of scale may be included in the washing process according to the present invention. The means of preventing the generation of scale is not particularly limited and a known method can be used, such as a method of adding an antimold agent (a scale preventive), a method of electroconduction, a method of irradiating with ultraviolet ray, infrared ray or far infrared ray, a method of applying a magnetic field, a method of processing by ultrasonic wave, a method of applying a heat, and a method of emptying tanks when they are not used. The scale preventing means may be conducted in accordance with the progress of the processing of photographic materials, may be conducted at regular intervals irrespective of usage conditions, or may be conducted only during the time when processing is not conducted, for example, during night. Alternatively, washing water previously subjected to such a means may be replenished. It is also preferred to conduct different scale preventing means for every given period of time for inhibiting the propagation of resistive fungi.

An antimold agent is not particularly limited and known antimold agents can be used. Examples thereof include, for example, a chelating agent such as glutaraldehyde and an aminopolycarboxylic acid, a cationic surfactant and a mercaptopyridine oxide (e.g., 2-mercaptopyridine-N-oxide), in addition to the above-described oxidants, and they can be used alone or in combination of two or more.

The method of electroconduction described in JP-A-3-224685, JP-A-3-224687, JP-A-4-16280 and JP-A-4-18980 can be used in the present invention.

Moreover, a known water-soluble surfactant or defoaming agent may be added to the washing water for preventing the generation of water spots and transfer of stains. In addition, the dye-adsorbent described in JP-A-63-163456 may be included in a washing tank to inhibit contamination by dyes eluted out of the photographic materials.

The whole or a part of the overflow from the washing process can be mixed with a processing solution having fixing ability to utilize the mixture as described in JP-A-60-235133. It is also preferred from the viewpoint of environmental protection for the washing solution to be processed by various processes before draining, for example, biochemical oxygen demand (BOD), chemical oxygen demand (COD) or iodine consumption is decreased by a microorganism process (e.g., a process using sulfur oxide fungus or activated sludge, a process using a filter of a porous carrier, such as activated carbon or ceramic, carrying a microorganism) or an oxidation process by electroconduction or an oxidant, or silver is precipitated by adding a compound which forms a hardly soluble silver complex such as trimercaptotriazine and then filtrated or filtered using a filter of a polymer having affinity with silver to reduce the silver concentration in drained water.

Also, when the photographic material is subjected to stabilization processing after washing processing, a bath containing the compound described in JP-A-2-201357, JP-A-2-132435, JP-A-1-102553 and JP-A-46-44446 may be used as a final bath. This stabilizing bath may also contain, if desired, an ammonium compound, a metal compound such as Bi or Al, a brightening agent, various kinds of chelating agents, a film pH adjustor, a hardening agent, a sterilizer, an antimold agent, an alkanolamine and a surfactant.

Additives such as an antimold agent and a stabilizing agent which are added to a washing bath and a stabilizing bath can also be solid agents similar to the above-described developing or fixing processing chemicals.

Waste solutions of the developing solution, fixing solution, washing water and stabilizing solution for use in the present invention are preferably subjected to incineration disposal. These waste solutions are also possible to be discarded as concentrated solutions made using a concentrator as described in JP-B-7-83867 and U.S. Pat. No. 5,439,560, or as solids.

In a case wherein the replenishing rate is reduced, it is preferred to prevent evaporation and air oxidation of the solution by minimizing the open area of the processing tank. An automatic processor of roller transporting type is described in U.S. Pat. Nos. 3,025,779 and 3,545,971 and referred to as merely a roller transporting type processor hereinafter. A roller transporting type processor comprises four steps of development, fixing, washing and drying and, although the method of the present invention does not exclude other steps (e.g., stopping step), it is most preferred to follow this four step system. Further, a rinsing bath may be provided between development and fixing and/or between fixing and washing.

The development processing for use in the present invention is preferably carried out by development processing of dry to dry of from 25 to 160 seconds, with development and fixing time being 40 seconds or less, preferably from 6 to 35 seconds, the temperature of each processing solution being from 25° to 50° C., preferably from 30° to 40° C. The temperature and time of washing is preferably from 0° to 50° C. and 40 seconds or less, respectively. According to the method of the present invention, the photographic material having been developed, fixed and washed may be dried after the washing water is squeezed out of the photographic material, that is, through squeeze rollers. The drying step is carried out at a temperature of from about 40° to about 100° C. and the time therefor can be appropriately varied depending upon the surrounding conditions. The drying method is not particularly limited and any known methods can be used, such as a warm air drying method, the heated roller drying method and the far infrared ray drying method described in JP-A-4-15534, JP-A-5-2256 and JP-A-5-289294 and a plurality of methods can be used in combination.

When the developing and fixing processing chemicals of the present invention are each in a solution form, they are preferably preserved in packaging materials having a low oxygen permeation as described, for example, in JP-A-61-73147. Further, when they are each in a concentrated solution form, they are diluted prior to use with water to a predetermined concentration in the ratio of from 0.2 parts to 3 parts of water per one part of the concentrated solutions.

Where the developing processing chemicals and fixing processing chemicals of the present invention are each in a solid form, the same effects as in where they are each in a solution form can be obtained. Solid processing chemicals are described below.

The solid chemicals for use in the present invention may be made into a known shape such as powder, pellet, granule, lump, tablet, compactor, briquette, sheet, bar or paste. These solid chemicals may be covered with a water-soluble coating agent or a film to separate components which react with each other on contact, or they may have a multilayer structure to separate components which react with each other, or both types may be used in combination.

Known coating agents and auxiliary granulating agents can be used, but polyvinylpyrrolidone, polyethylene glycol, polystyrene sulfonic acid and vinyl compounds are preferred. The description of from line 48, column 2 to line 13, column 3 of JP-A-5-45805 can be referred to.

When a multilayer structure is used, a component which does not react with the components which react with each other on contact may be sandwiched therebetween and this is made into tablets and briquettes, or components of known structures may be made to similar layer structure and packaged. Methods therefor are described, for example, in JP-A-61-259921, JP-A-4-16841, JP-A-4-78848 and JP-A-5-93991.

The bulk density of the solid processing chemicals is preferably from 0.5 to 6.0 g/cm$^3$, in particular, the bulk density of tablets is preferably from 1.0 to 5.0 g/cm$^3$ and that of granules is preferably from 0.5 to 1.5 g/cm$^3$.

The solid processing chemicals according to the present invention can be produced using any known method, for example, those described in JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605 and JP-A-8-286329.

Specifically, a rolling granulating method, an extrusion granulating method, a compression granulating method, a cracking granulating method, a stirring granulating method, a spray drying method, a dissolution coagulation method, a briquetting method, and a roller compacting method can be used.

The solubility of the solid chemicals for use in the present invention can be adjusted by changing the state of the surface (e.g., smooth or porous) and the partial thickness, or making the shape to a hollow doughnut type. Further, it is possible to impart different solubilities to a plurality of granulated products, or it is also possible for materials having different solubilities to take various shapes to coincide with solubilities one another. Multilayer granulated products having different compositions between the inside and the surface can also be used.

Packaging materials of the solid chemicals preferably have low oxygen and water permeability, and those having a bag-like, cylindrical or box-like shape can be used. Packaging materials of foldable shapes as described in JP-A-6-242585 to JP-A-6-242588, JP-A-6-247432, JP-A-6-247448, JP-A-6-301189, JP-A-7-5664, and JP-A-7-5666 to JP-A-7-5669 are preferred for saving storage space of waste materials. The packaging materials may be provided with a screw cap, a pull-top or an aluminum seal on takeout ports thereof for processing chemicals, or may be heat-sealed, or other known types may be used, and there are no particular limitations. Waste packaging materials are preferably recycled for regeneration or reused from the environmental protection view.

Methods of dissolution and replenishment of the solid processing chemicals for use in the present invention are not particularly limited and known methods can be used. Examples of these known methods include a method in which a certain amount of processing chemicals are dissolved and replenished by a dissolving device having a stirring function, a method in which processing chemicals are dissolved by a dissolving device having a dissolving zone and a zone where a finished solution is stocked and the solution is replenished from the stock zone as described in JP-A-9-80718, and a method in which processing chemicals are fed to a circulating system of an automatic processor and dissolved and replenished or a method in which processing chemicals are fed to a dissolving tank equipped in an automatic processor in accordance with the progress of the processing of photographic materials as described in JP-A-5-119454, JP-A-6-19102 and JP-A-7-261357. In addition to the above methods, any of known methods can be used. The charge of processing chemicals may be conducted by hands, or automatic opening and automatic charge may be conducted by a dissolving device or automatic processor provided with opening mechanism as described in JP-A-9-138495. The latter is preferred in view of the working environment. Specifically, there are methods of pushing through, unsealing, cutting off or bursting the takeout port of a package, and the methods described in JP-A-6-19102 and JP-A-6-95331.

The present invention will be described in greater detail below with reference to the following examples, but the present invention should not be construed as being limited thereto.

EXAMPLE 1

An emulsified dispersion of the hydrazine compound was prepared in the following manner. A mixture of the hydrazine compound shown in Table 1 below, 6.0 g of the polymer shown in Table 1 below, 48 ml of ethyl acetate and 2 ml of water was heated at 60° C. to dissolve, the resulting solution was added to 120 ml of an aqueous solution containing 12 g of gelatin and 0.7 g of sodium dodecylbenzenesulfonate and the mixture was finely dispersed using a high speed stirrer (homogenizer manufactured by Nippon Seiki Seisakusho) to prepare the emulsified dispersion having an average grain size of 0.3 $\mu$m. Then, proxel was added as a preservative to the emulsified dispersion in an amount of 2,000 ppm based on gelatin. Finally, ascorbic acid was added to the emulsified dispersion to adjust the pH value thereof to 5.0.

Addition of the emulsified dispersion containing the hydrazine compound to a coating solution is called polymer dispersion addition. On the other hand, addition of the hydrazine compound dissolved in methanol to a coating solution is called methanol solution addition.

EXAMPLE 2

Preparation of Silver Halide Photographic Light-Sensitive Material

| Preparation of Emulsion A | |
|---|---|
| Solution 1 | |
| Water | 1 liter |
| Gelatin | 20 g |
| Sodium Chloride | 3.0 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 27.1 g |
| Potassium Bromide | 21.0 g |
| Ammonium Hexachloroiridate(III) (0.001% aqueous solution) | 20 ml |
| Potassium Hexachlororhodate(III) (0.001% aqueous solution) | 6 ml |

Solution 2 and Solution 3 were simultaneously added to Solution 1 maintained at 42° C. and at a pH of 4.5 with stirring over a period of 15 minutes to form nuclear grains. Subsequently, Solution 4 and Solution 5 shown below were added thereto over a period of 15 minutes. Further, 0.15 g of potassium iodide was added thereto and the grain formation was terminated.

| | |
|---|---|
| Solution 4 | |
| Water | 400 ml |
| Silver Nitrate | 100 g |
| Solution 5 | |
| Water | 400 ml |
| Sodium Chloride | 27.1 g |
| Potassium Bromide | 21.0 g |
| Potassium Hexacyanoferrate (II) (0.1% aqueous solution) | 10 ml |

Then, the mixture was washed with water according to a conventional flocculation method, and 40 g of gelatin was added thereto.

After adjusting the pH thereof to 5.7 and the pAg thereof to 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization at 55° C. so as to provide optimum sensitivity.

Further, 100 mg of 4-hydroxy-6-methyl-1,3,3a,7-tetraazaindene was added as a stabilizer, and 10 mM of phenoxyethanol was added as a preservative to finally obtain a cubic silver chloroiodobromide emulsion (Emulsion A) having an average grain size of 0.25 $\mu$m and a silver chloride content of 70 mol %.

Preparation of Coated Samples

Sensitizing Dye (1) shown below was added to Emulsion A in an amount of $3.8\times10^{-4}$ mol/mol-Ag, and spectral sensitization was conducted. Then, $3.4\times10^{-4}$ mol/mol-Ag of KBr, $3.2\times10^{-4}$ mol/mol-Ag of Compound (1) shown below, $8.0\times10^{-4}$ mol/mol-Ag of Compound (2) shown below, $1.2\times10^{-2}$ mol/mol-Ag of hydroquinone, $3.0\times10^{-3}$ mol/mol-Ag of citric acid and each of the hydrazine compounds shown in Table 1 in the amount shown in Table 1 and according to the method for addition shown in Table 1. Further, $6.0\times10^{-4}$ mol/mol-Ag of Compound (4) shown below, 35% by weight based on gelatin of a polyethyl acrylate latex, 20% by weight based on gelatin of colloidal silica having a grain size of 10 μm, and 4% by weight based on gelatin of Compound (5) shown below were added thereto. The thus obtained coating solution was applied onto a polyester support so as to provide a silver coating amount of 2.7 g/m$^2$ of and a gelatin coating amount of 1.6 g/m$^2$. An upper protective layer and a lower protective layer having the following compositions, respectively, were provided on the emulsion layer, and an UL layer having the following composition had been provided beneath the lower protective layer.

| | |
|---|---|
| Upper Protective Layer | |
| Gelatin | 0.3 g/m$^2$ |
| Silica Matting Agent (average grain size: 3.5 μm) | 25 mg/m$^2$ |
| Compound (6) (gelatin dispersion) | 20 mg/m$^2$ |
| Colloidal Silica (grain size: 10–20 μm) | 30 mg/m$^2$ |
| Compound (7) | 5 mg/m$^2$ |
| Sodium Dodecylbenzenesulfonate | 20 mg/m$^2$ |
| Compound (8) | 20 mg/m$^2$ |
| Lower Protective Layer | |
| Gelatin | 0.5 g/m$^2$ |
| Compound (9) | 15 mg/m$^2$ |
| 1,5-Dihydroxy-2-benzaldoxime | 10 mg/m$^2$ |
| Polyethyl Acrylate Latex | 150 mg/m$^2$ |
| UL Layer | |
| Gelatin | 0.5 g/m$^2$ |
| Polyethyl Acrylate Latex | 150 mg/m$^2$ |
| Compound (5) | 40 mg/m$^2$ |
| Compound (10) | 10 mg/m$^2$ |

The supports of the samples used in the present invention each has a back layer and a conductive layer having the following compositions, respectively.

| | |
|---|---|
| Back Layer | |
| Gelatin | 3.3 g/m$^2$ |
| Sodium Dodecylbenzenesulfonate | 80 mg/m$^2$ |
| Compound (11) | 40 mg/m$^2$ |
| Compound (12) | 20 mg/m$^2$ |
| Compound (13) | 90 mg/m$^2$ |
| 1,3-Divinylsulfonyl-2-propanol | 60 mg/m$^2$ |
| Fine Grain of Polymethyl Methacrylate (average grain size: 6.5 μm) | 30 mg/m$^2$ |
| Compound (5) | 120 mg/m$^2$ |
| Conductive Layer | |
| Gelatin | 0.1 g/m$^2$ |
| Sodium Dodecylbenzenesulfonate | 40 mg/m$^2$ |
| $SnO_2$/Sb (weight ratio: 9/1, average grain size: 0.25 μm) | 200 mg/m$^2$ |

Sensitizing Dye (1)

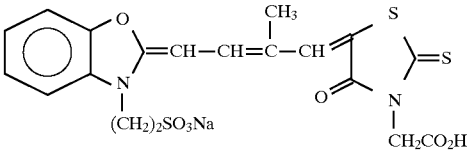

Compound (1)

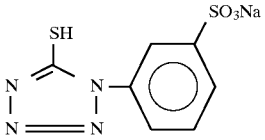

-continued

Compound (2)

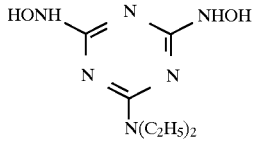

Compound (4)

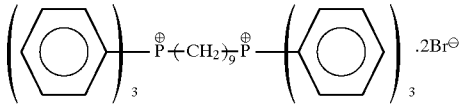

Compound (5)

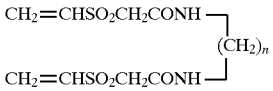

A 3:1 mixture of n = 2 and n = 3

Compound (6)

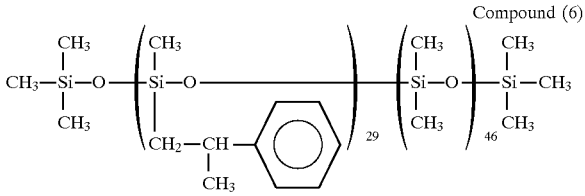

Compound (7)

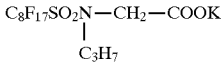

Compound (8)

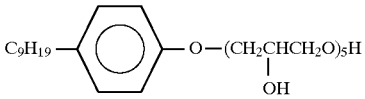

Compound (9)

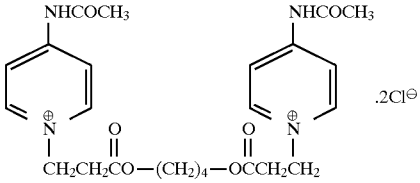

Compound (10)

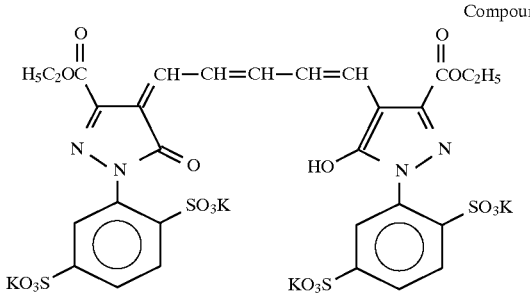

Compound (11)

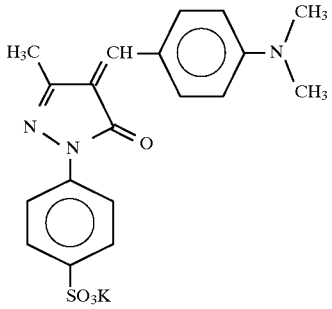

-continued

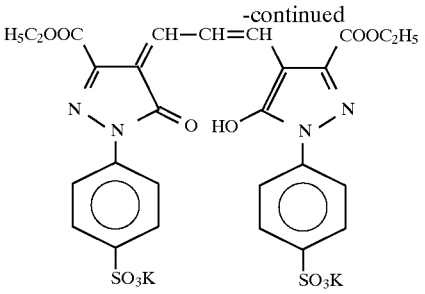

Compound (12)

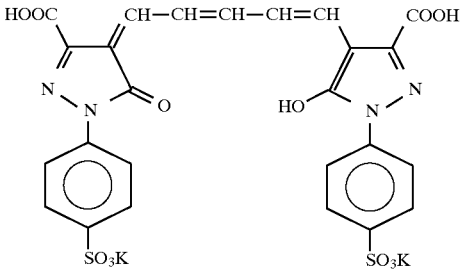

Compound (13)

The following compounds were used for comparison with the hydrazine compounds according to the present invention.

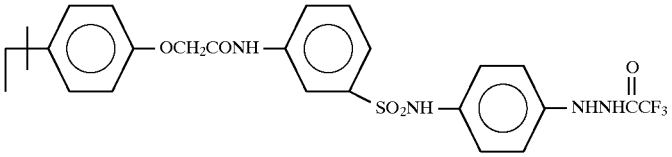

Comparative Compound 1

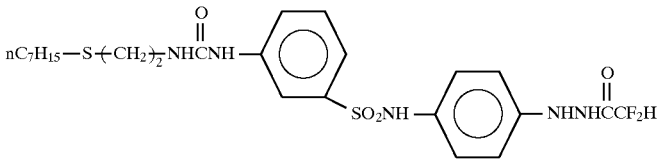

Comparative Compound 2

Developing Solutions A, B and C shown below were prepared.

| Developing Solution A | |
|---|---|
| Diethylenetriaminepentaacetic Acid | 2 g |
| Potassium Carbonate | 33 g |
| Sodium Carbonate | 28 g |
| Sodium Hydrogencarbonate | 25 g |
| Sodium Erythorbate | 45 g |
| N-Methyl-p-aminophenol | 7.5 g |
| Potassium Bromide | 2 g |
| 5-Methylbenzotriazole | 0.004 g |
| 1-Phenyl-5-mercaptotetrazole | 0.02 g |
| Sodium Sulfite | 5 g |

Water was added to make 1 liter, and the pH was adjusted to 9.7.

Developing Solution B

The composition was the same as that of Developing Solution A, but the pH thereof was adjusted to 9.2 with acetic acid.

Developing Solution C

The composition was the same as that of Developing Solution A, but the pH thereof was adjusted to 10.2 with sodium hydroxide.

Various characteristics of each sample were evaluated in the following manner.

(1) Exposure and Development Processing

The above described samples were exposed to xenon flash light having a light-emitting time of $10^{-5}$ second through an interference filter having a peak at 633 nm and a step wedge. The exposed samples were developed with an automatic processor (AP-560 manufactured by Fuji Photo Film Co., Ltd.) at 38° C. for 15 seconds using Developing Solution A described above, followed by fixing, washing and drying.

As the fixing solution, a solution having the following composition was used.

| Fixing Solution | |
|---|---|
| Ammonium Thiosulfate | 120 g |
| Disodium Ethylenediaminetetraacetate Dihydrate | 0.03 g |
| Sodium Thiosulfate Pentahydrate | 11 g |
| Sodium Metasulfite | 19 g |
| Sodium Hydroxide | 12.4 g |
| Acetic Acid (100%) | 30 g |
| Tartaric Acid | 2.9 g |
| Sodium Gluconate | 1.7 g |
| Aluminum Sulfate | 8.4 g |

Water was added to make 1 liter, and the pH was adjusted to 4.8.

(2) Evaluation

Gamma

The slope of a straight line connecting a point of fog +0.1 (density) and a point of fog +3.0 (density) in the characteristic curve of the sample is expressed as the gamma value, an index showing a contrast of an image. Specifically, the gamma value is indicated by gamma =(3.0−0.1)/ [log(an exposure amount giving a density of 3.0)−log (an exposure amount giving a density of 0.1)]. The larger the gamma value, the higher is the contrast of photographic characteristics. In a practical use, a gamma value of 15 or more is required.

Developing Solution pH Dependency of Photographic Sensitivity

The exposure and development processing were conducted using the above described samples and Developing Solutions B and C in the same manner as described above.

The dependency of photographic sensitivity on pH of developing solution was calculated by the following equation: pH dependency ($\Delta S_{1.5}$)=

$$S_{1.5}(\text{Developing Solution B})-S_{1.5}(\text{Developing Solution C})$$

The sensitivity ($S_{1.5}$) is represented by the logarithm of an exposure amount giving a density of 1.5.

The larger the value, the larger is the dependency of photographic sensitivity on pH of developing solution. In a practical use, a $\Delta S_{1.5}$ value of 0.10 or less is required, and a $\Delta S_{1.5}$ value of 0.05 or less is preferred.

Storage Stability of Hydrazine Compound in Photographic Light-Sensitive Material A photographic light-sensitive material which had been refrigerated after coating and a photographic light-sensitive material which had been stored at a temperature of 60° C. and a relative humidity of 65% for 3 days were each treated with an organic solvent to extract the hydrazine compound which was then determined by HPLC (high speed liquid chromatography). The storage stability of hydrazine compound was evaluated according to the following equation:

Storage Stability of Hydrazine Compound (%) = {(amount of hydrazine compound extracted from the thermally treated photographic light-sensitive material)/(amount of hydrazine compound extracted from the refrigerated photographic light-sensitive material)} × 100

In order to guarantee the properties of the photographic light-sensitive material for a long time under storage of normal temperature and normal humidity conditions, it is necessary that this value be not less than 90%.

The results obtained are shown in Table 1. It can be seen that ultrahigh contrast photographic light-sensitive materials which exhibit a very small dependency on pH of a developing solution and a high storage stability of hydrazine compound can be specially obtained only when the requirements of the photographic light-sensitive material according to the present invention are fulfilled.

TABLE 1

| Sample No. | Hydrazine Compound | Amount Added (mg/m$^2$) | Method for Addition | Polymer | Gamma | Developing Solution pH Dependency ($\Delta S_{1.5}$) | Storage Stability of Hydrazine Compound (%) | Remarks |
|---|---|---|---|---|---|---|---|---|
| 1 | Comparative Compounds 1 | 20 | Methanol Solution Addition | — | 19 | 0.19 | 41 | Comparison |
| 2 | Comparative Compounds 2 | 10 | Methanol Solution Addition | — | 18 | 0.28 | 69 | Comparison |
| 3 | Comparative Compounds 1 | 60 | Polymer Dispersion Addition | P-57 | 17 | 0.25 | 40 | Comparison |
| 4 | Comparative Compounds 2 | 30 | Polymer Dispersion Addition | P-57 | 17 | 0.36 | 67 | Comparison |
| 5 | 24c | 6 | Methanol Solution Addition | — | 23 | 0.01 | 16 | Comparison |
| 6 | 4e | 3 | Methanol Solution Addition | — | 24 | 0.01 | 61 | Comparison |
| 7 | 24c | 20 | Polymer Dispersion Addition | P-57 | 20 | 0.01 | 90 | Present Invention |
| 8 | 4e | 10 | Polymer Dispersion Addition | P-57 | 21 | 0.02 | 95 | Present Invention |
| 9 | 4e | 10 | Polymer Dispersion Addition | P-3 | 20 | 0.03 | 93 | Present Invention |
| 10 | 4e | 10 | Polymer Dispersion Addition | P-27 | 20 | 0.02 | 94 | Present Invention |
| 11 | 4e | 10 | Polymer Dispersion Addition | P-33 | 21 | 0.03 | 93 | Present Invention |
| 12 | 4e | 10 | Polymer Dispersion Addition | P-56 | 21 | 0.03 | 93 | Present Invention |
| 13 | 11 | 20 | Polymer Dispersion Addition | P-57 | 22 | 0.01 | 90 | Present Invention |
| 14 | 5c | 20 | Polymer Dispersion Addition | P-57 | 20 | 0.02 | 91 | Present Invention |
| 15 | 26c | 20 | Polymer Dispersion Addition | P-57 | 20 | 0.01 | 90 | Present Invention |
| 16 | 12e | 10 | Polymer Dispersion Addition | P-57 | 21 | 0.03 | 93 | Present Invention |
| 17 | 13e | 10 | Polymer Dispersion Addition | P-57 | 22 | 0.03 | 94 | Present Invention |
| 18 | 15e | 10 | Polymer Dispersion Addition | P-57 | 20 | 0.02 | 94 | Present Invention |
| 19 | 23e | 10 | Polymer Dispersion Addition | P-57 | 21 | 0.03 | 94 | Present Invention |

EXAMPLE 3

The same procedure as in Example 2 was repeated except for using a photographic light-sensitive material and an exposure method shown below. As a result, ultrahigh contrast photographic light-sensitive materials which exhibit a very small dependency on pH of a developing solution and a high storage stability of hydrazine compound can be specially obtained only when the requirements of the photographic light-sensitive material according to the present invention are fulfilled.

Preparation of Photographic Light-Sensitive Material

| Preparation of Emulsion B | |
|---|---|
| Solution 1 | |
| Water | 1 liter |
| Gelatin | 20 g |
| Sodium Chloride | 1.5 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 27.1 g |
| Potassium Bromide | 21.0 g |
| Ammonium Hexachloroiridate(III) (0.001% aqueous solution) | 20 ml |
| Potassium Hexachlororhodate(III) (0.001% aqueous solution) | 10 ml |

Solution 2 and Solution 3 were simultaneously added to Solution 1 maintained at 40° C. and at a pH of 4.5 with stirring over a period of 15 minutes to form nuclear grains. Subsequently, Solution 4 and Solution 5 shown below were added thereto over a period of 15 minutes, and 0.15 g of potassium iodide was added thereto and the grain formation was terminated.

| Solution 4 | |
|---|---|
| Water | 400 ml |
| Silver Nitrate | 100 g |

-continued

| Solution 5 | |
|---|---|
| Water | 400 ml |
| Sodium Chloride | 27.1 g |
| Potassium Bromide | 21.0 g |

Then, the mixture was washed with water according to a conventional flocculation method, and 40 g of gelatin was added thereto.

After adjusting the pH to 5.7 and the pAg to 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization at 55° C. so as to provide optimum sensitivity.

Further, 100 mg of 4-hydroxy-6-methyl-1,3,3a,7-tetrazaindene was added as a stabilizer, and 10 mM of phenoxyethanol was added as a preservative to finally obtain a cubic silver chloroiodobromide emulsion (Emulsion B) having an average grain size of 0.22 μm and a silver chloride content of 70 mol %.

Preparation of Coated Samples

Sensitizing Dye (1A) shown below was added to Emulsion B in an amount of $8.0\times10^{-5}$ mol/mol-Ag, and spectral sensitization was conducted. Then, $3.4\times10^{-4}$ mol/mol-Ag of KBr, $2.0\times10^{-4}$ mol/mol-Ag of Compound (1A) shown below, $1.0\times10^{-3}$ mol/mol-Ag of Compound (2A) shown below, $2.0\times10^{-2}$ mol/mol-Ag of hydroquinone, $2.0\times10^{-3}$ mol/mol-Ag of citric acid, $1.5\times10^{-4}$ mol/mol-Ag of each of the hydrazine compounds shown in Table 1 in the amount shown in Table 1 and according to the method for addition shown in Table 1. Further, $9.0\times10^{-4}$ mol/mol-Ag of Compound (4A) shown below, $2.3\times10^{-4}$ mol/mol-Ag of Compound (5A) shown below, $1.4\times10^{-4}$ mol/mol-Ag of Compound (6A) shown below, 35% by weight based on gelatin of a polyethyl acrylate latex, 20% by weight based on gelatin of colloidal silica having a grain size of 10 μm, and 4% by weight based on gelatin of Compound (7A) shown below were added thereto. The thus obtained coating solution was applied onto a polyester support so as to provide a silver coating amount of 2.6 g/m$^2$ and a gelatin coating amount of 1.4 g/m$^2$. An upper protective layer and a lower protective layer having the following compositions, respectively, were provided on the emulsion layer.

| Upper Protective Layer | |
|---|---|
| Gelatin | 0.3 g/m$^2$ |
| Silica Matting Agent (average grain size: 3.5 μm) | 25 mg/m$^2$ |
| Compound (8A) (gelatin dispersion) | 20 mg/m$^2$ |
| Colloidal Silica (grain size: 10–20 μm) | 30 mg/m$^2$ |
| Compound (9A) | 5 mg/m$^2$ |
| Sodium Dodecylbenzenesulfonate | 20 mg/m$^2$ |
| Compound (10A) | 20 mg/m$^2$ |
| Lower Protective Layer | |
| Gelatin | 0.8 g/m$^2$ |
| Compound (11A) | 20 mg/m$^2$ |
| Compound (12A) | 7 mg/m$^2$ |
| 1,5-Dihydroxy-2-benzaldoxime | 10 mg/m$^2$ |
| Polyethyl Acrylate Latex | 150 mg/m$^2$ |

The supports of the samples used in the present invention each has a back layer and a conductive layer having the following compositions, respectively.

| Back Layer | |
|---|---|
| Gelatin | 3.0 g/m$^2$ |
| Sodium Dodecylbenzenesulfonate | 40 mg/m$^2$ |
| Compound (12A) | 60 mg/m$^2$ |
| Compound (13A) | 30 mg/m$^2$ |
| 1,3-Divinylsulfonyl-2-propanol | 60 mg/m$^2$ |
| Fine Grain of Polymethyl Methacrylate (average grain size: 6.5 μm) | 6 mg/m$^2$ |
| Fine Grain of Polymethyl Methacrylate (average grain size: 3.5 μm) | 25 mg/m$^2$ |
| Sodium Sulfate | 150 mg/m$^2$ |
| Compound (7A) | 110 mg/m$^2$ |
| Conductive Layer | |
| Gelatin | 0.1 g/m$^2$ |
| Sodium Dodecylbenzenesulfonate | 20 mg/m$^2$ |
| $SnO_2$/Sb (weight ratio: 9/1, average grain size: 0.25 μm) | 200 mg/m$^2$ |

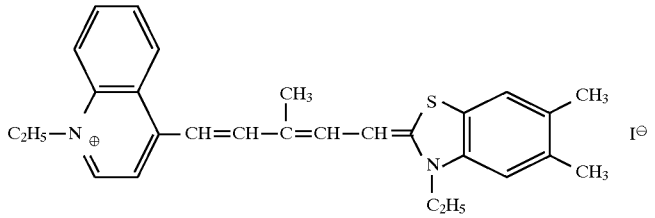

Sensitizing Dye (1A)

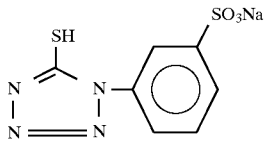

Compound (1A)

-continued
Compound (2A)
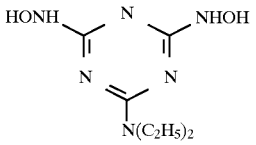
Compound (4A)
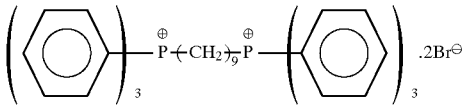
Compound (5A)
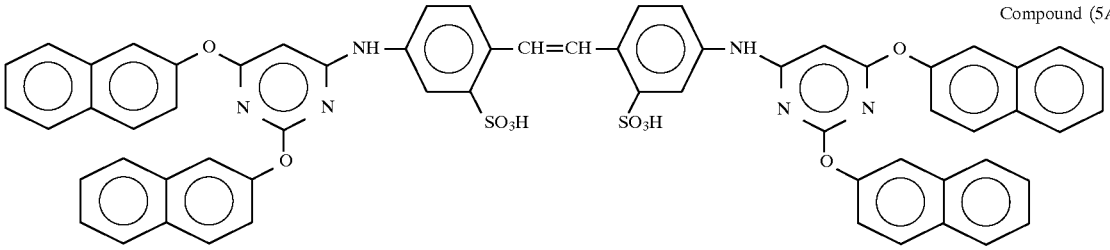
Compound (6A)
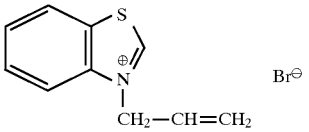
Compound (7A)
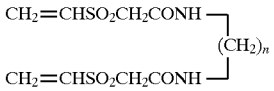
A 3:1 mixture of n = 2 and n = 3
Compound (8A)
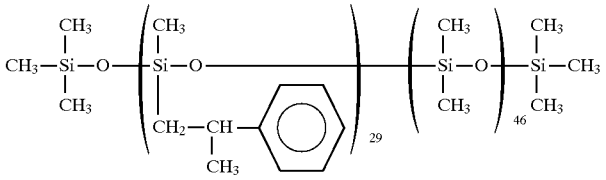
Compound (9A)
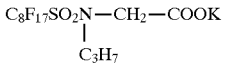
Compound (9A)
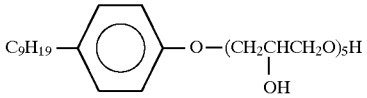
Compound (11A)
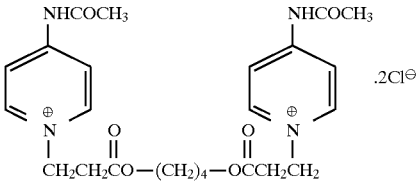
Compound (12A)
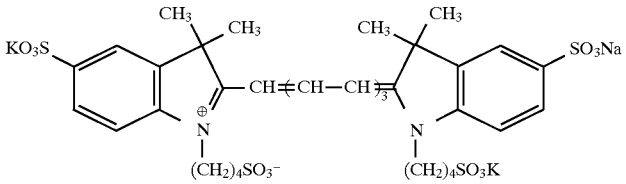

-continued

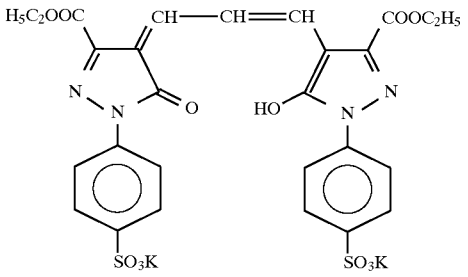

Compound (13A)

Exposure Method

The above described samples were exposed to xenon flash light having a light-emitting time of $10^{-5}$ second through an interference filter having a peak at 780 nm and a step wedge.

EXAMPLE 4

Developing Solutions D, E and F shown below were prepared.

| Developing Solution D | |
|---|---|
| Potassium Hydroxide | 40 g |
| Diethylenetriaminepentaacetic Acid | 2 g |
| Potassium Carbonate | 60 g |
| Sodium Metabisulfate | 70 g |
| Potassium Bromide | 7 g |
| Hydroquinone | 40 g |
| 5-Methylbenzotriazole | 0.35 g |
| 4-Hydroxymethyl-4-methyl-1-phenyl-3-pyrazolidone | 1.5 g |
| Sodium 2-Mercaptobenzimidazole-5-sulfonate | 0.3 g |
| Sodium 3-(5-Mercaptotetrazol-1-yl)-benzenesulfonate | 0.1 g |
| Sodium Erythorbate | 6 g |
| Diethylene Glycol | 5 g |

Water was added to make 1 liter, and the pH was adjusted to 10.65.

Developing Solution E

The composition was the same as that of Developing Solution D, but the pH thereof was adjusted to 10.15 by addition of acetic acid.

Developing Solution F

The composition was the same as that of Developing Solution D, but the pH thereof was adjusted to 11.15 by addition of sodium hydroxide.

The same procedure as in Example 2 was repeated except for using Developing Solutions D, E and F in place of Developing Solutions A, B and C, respectively. As a result, ultrahigh contrast photographic light-sensitive materials which exhibit a very small dependency on pH of a developing solution and a high storage stability of hydrazine compound can be specially obtained only when the requirements of the photographic light-sensitive material according to the present invention are fulfilled, similar to Example 2.

EXAMPLE 5

Preparation of Photographic Light-Sensitive Material

| Preparation of Emulsion C | |
|---|---|
| Solution 1 | |
| Water | 1 liter |
| Gelatin | 20 g |
| Sodium Chloride | 3.0 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 27.1 g |
| Potassium Bromide | 21.0 g |
| Ammonium Hexachloroiridate(III) (0.001% aqueous solution) | 20 ml |
| Potassium Hexachlororhodate(III) (0.001% aqueous solution) | 6 ml |

-continued

Solution 2 and Solution 3 were simultaneously added to Solution 1 maintained at 42° C. and at a pH of 4.5 with stirring over a period of 15 minutes to form nuclear grains. Subsequently, Solution 4 and Solution 5 shown below were added thereto over a period of 15 minutes, and 0.15 g of potassium iodide was added thereto and the grain formation was terminated.

| Solution 4 | |
|---|---|
| Water | 400 ml |
| Silver Nitrate | 100 g |
| Solution 5 | |
| Water | 400 ml |
| Sodium Chloride | 27.1 g |
| Potassium Bromide | 21.0 g |
| Potassium Hexacyanoferrate(II) (0.1% aqueous solution) | 10 ml |

Then, the mixture was washed with water according to a conventional flocculation process, and 40 g of gelatin was added thereto.

After adjusting the pH thereof to 5.7 and the pAg thereof to 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization at 55° C. so as to give optimum sensitivity.

Further, 100 mg of 4-hydroxy-6-methyl-1,3,3a,7-tetrazaindene was added as a stabilizer, and 10 mM of phenoxyethanol was added as a preservative to finally obtain a cubic silver chloroiodobromide emulsion (Emulsion C) having an average grain size of 0.25 $\mu$m and a silver chloride content of 70 mol %.

Method for Addition of Hydrazine Compound

An emulsified dispersion of the hydrazine compound was prepared in the following manner. A mixture of 1.0 g of the hydrazine compound shown in Table 3 below, 6.0 g of poly(N-tert-butylacrylamide), 48 ml of ethyl acetate and 2 ml of water was heated at 60° C. to dissolve, the resulting solution was added to 120 ml of an aqueous solution containing 12 g of gelatin and 0.7 g of sodium dodecylbenzenesulfonate and the mixture was finely dispersed using a high speed stirrer (Homogenizer manufactured by Nippon Seiki Seisakusho) to prepare the emulsified dispersion having an average grain size of 0.3 $\mu$m. Then, proxel was added as a preservative to the emulsified dispersion in an amount of 2,000 ppm based on gelatin. Finally, ascorbic acid was added to the emulsified dispersion to adjust the pH value thereof to 5.0.

Addition of the emulsified dispersion containing the hydrazine compound to a coating solution is called polymer dispersion addition. On the other hand, addition of the hydrazine compound dissolved in methanol to a coating solution is called methanol solution addition.

Preparation of Coated Samples

Sensitizing Dye (1B) shown below was added to Emulsion C in an amount of $3.8\times10^{-4}$ mol/mol-Ag, and spectral sensitization was conducted. Then, $3.4\times10^{-4}$ mol/mol-Ag of KBr, $3.2\times10^{-4}$ mol/mol-Ag of Compound (1B) shown below, $8.0\times10^{-4}$ mol/mol-Ag of Compound (2B) shown below, $1.2\times10^{-2}$ mol/mol-Ag of hydroquinone, $3.0\times10^{-3}$ mol/mol-Ag of citric acid and each of the hydrazine compounds shown in Table 3 in the amount shown in Table 3 and according to the method for addition shown in Table 3. Further, $6.0\times10^{-4}$ mol/mol-Ag of Compound (4B) shown below, 35% by weight based on gelatin of a polyethyl acrylate latex, 20% by weight based on gelatin of colloidal silica having a grain size of 10 $\mu$m, and 4% by weight based on gelatin of Compound (5B) shown below were added thereto. The thus obtained coating solution was applied onto a polyester support so as to provide a silver coating amount of 2.9 $gm^2$ and a gelatin coating amount of 1.6 $g/m^2$. An upper protective layer and a lower protective layer having the following compositions, respectively, were provided on the emulsion layer, and an UL layer having the following composition had been provided beneath the emulsion layer.

| Upper Protective Layer | |
|---|---|
| Gelatin | 0.3 $g/m^2$ |
| Silica Matting Agent (average grain size: 3.5 $\mu$m) | 25 $mg/m^2$ |
| Compound (6B) (gelatin dispersion) | 20 $mg/m^2$ |
| Colloidal Silica (grain size: 10–20 $\mu$m) | 30 $mg/m^2$ |
| Compound (7B) | 5 $mg/m^2$ |
| Sodium Dodecylbenzenesulfonate | 20 $mg/m^2$ |
| Compound (8B) | 20 $mg/m^2$ |
| **Lower Protective Layer** | |
| Gelatin | 0.5 $g/m^2$ |
| Compound (9B) | 15 $mg/m^2$ |
| 1,5-Dihydroxy-2-benzaldoxime | 10 $mg/m^2$ |
| Polyethyl Acrylate Latex | 150 $mg/m^2$ |
| **UL Layer** | |
| Gelatin | 0.5 $g/m^2$ |
| Polyethyl Acrylate Latex | 150 $mg/m^2$ |
| Compound (5B) | 40 $mg/m^2$ |
| Compound (10B) | 10 $mg/m^2$ |

The supports of the samples used in the present invention each has a back layer and a conductive layer having the following compositions, respectively.

| Back Layer | |
|---|---|
| Gelatin | 3.3 $g/m^2$ |
| Sodium Dodecylbenzenesulfonate | 80 $mglm^2$ |
| Compound (11B) | 40 $mg/m^2$ |
| Compound (12B) | 20 $mg/m^2$ |
| Compound (13B) | 90 $mg/m^2$ |
| 1,3-Divinylsulfonyl-2-propanol | 60 $mg/m^2$ |
| Fine Grain of Polymethyl Methacrylate (average grain size: 6.5 $\mu$m) | 30 $mg/m^2$ |
| Compound (5B) | 120 $mg/m^2$ |
| **Conductive Layer** | |
| Gelatin | 0.1 $g/m^2$ |
| Sodium Dodecylbenzenesulfonate | 20 $mg/m^2$ |
| $SnO_2$/Sb (weight ratio: 9/1, average grain size: 0.25 $\mu$m) | 200 $mg/m^2$ |

Sensitizing Dye (1B)

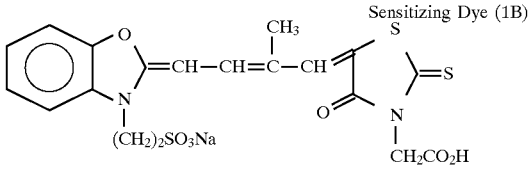

Compound (1B)

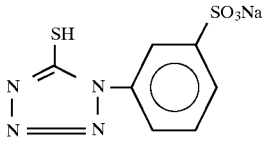

Compound (2B)

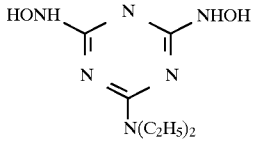

Compound (4B)

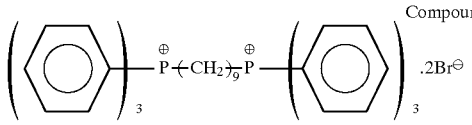

Compound (5B)

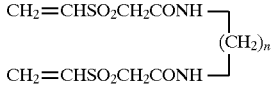

A 3:1 mixture of n = 2 and n = 3

Compound (6B)

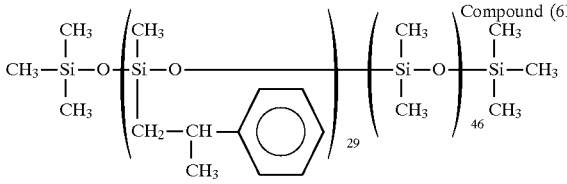

Compound (7B)

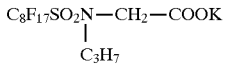

Compound (8B)

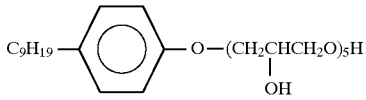

-continued

Compound (9B)

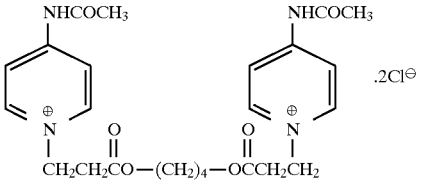

Compound (10B)

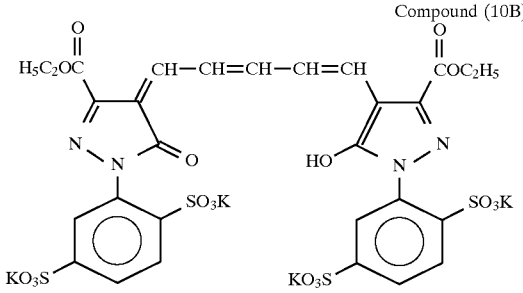

Compound (11B)

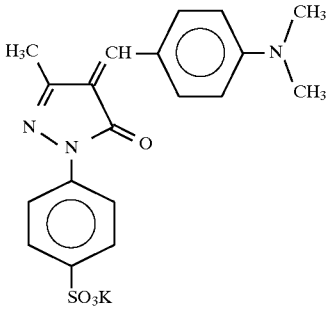

-continued

Compound (12B)

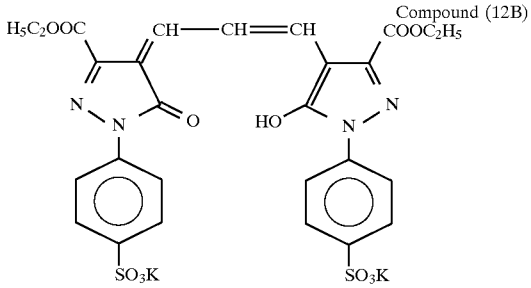

Compound (13B)

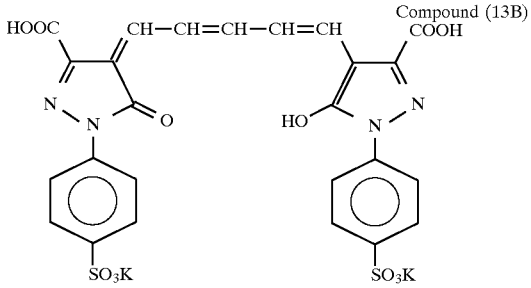

The following compound was used for comparison with the hydrazine compounds according to the present invention.

Developing solutions having the compositions shown in Table 2 were used.

Comparative Compound 3

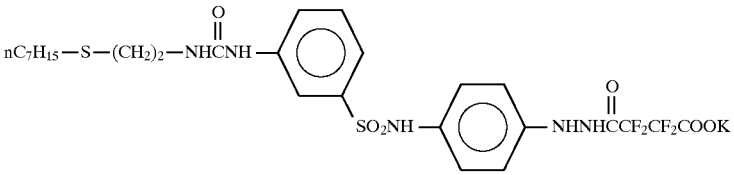

TABLE 2

Composition of Developing Solution

| | 1 | 2 | 3 | 4 | 5 | 6 | 7 | 8 |
|---|---|---|---|---|---|---|---|---|
| Diethylenetriaminepentaacetic Acid | 2 g | " | " | " | " | " | " | " |
| Potassium Carbonate | 33 g | " | " | " | " | " | " | " |
| Sodium Carbonate | 28 g | " | " | " | " | " | " | " |
| Sodium Hydrogen Carbonate | 25 g | " | " | " | " | " | " | " |
| Sodium Erythorbate | 45 g | " | " | " | " | " | " | " |
| N-Methyl-p-aminophenol | 7.5 g | — | — | — | — | 2 g | — | — |
| Compound (A-2) | — | 2 g | — | — | — | — | — | — |
| Compound (A-23) | — | — | 2 g | — | — | — | 2 g | " |
| Compound (A-24) | — | — | — | 2 g | — | — | — | — |
| Compound (A-25) | — | — | " | 2 g | — | — | — | — |
| Potassium Bromide | 2 g | " | " | " | " | " | " | " |
| 5-Methylbenzotriazole | 0.004 g | " | " | " | " | " | " | " |
| 1-Phenyl-5-mercaptotetrazole | 0.02 g | " | " | " | " | " | " | " |
| Sodium sulfite | 2 g | " | " | " | " | " | " | " |
| pH (adjusted with sodium hydroxide or acetic acid) | 9.7 | " | " | " | " | " | 10.6 | 8.9 |
| Water to make 1 liter | | | | | | | | |

A fixing solution was prepared by diluting a concentrated fixing solution having the composition shown below with water in a ratio of two parts of water per one part of the concentrated fixing solution. The pH of the fixing solution used was 4.8.

| Concentrated Fixing Solution (Composition per one liter). | |
|---|---|
| Ammonium Thiosulfate | 360 g |
| Disodium Ethylenediaminetetraacetate Dihydrate | 0.09 g |
| Sodium Thiosulfate Pentahydrate | 33 g |
| Sodium Metasulfite | 57 g |
| Sodium Hydroxide | 37.2 g |
| Acetic Acid (100%) | 90.0 g |
| Tartaric Acid | 8.7 g |
| Sodium Gluconate | 5.1 g |
| Aluminum Sulfate | 25.2 g |
| pH | 4.85 |

Various characteristics of each sample were evaluated in the following manner.

Photographic Characteristics

The sample was exposed to xenon flash light having a light-emitting time of $10^{-5}$ second using an optical wedge through an interference filter having a peak at 633 nm. The development was conducted at a temperature of 35° C. for 20 seconds.

The sensitivity is shown by a reciprocal of the exposure amount required for obtaining a density of 1.5 when developed with Developing Solution 1 described in Table 2, and the sensitivity of Sample 1 is taken as 100 and the other sensitivities are shown relatively. The larger the value, the higher is the sensitivity. The gradation (gamma) is determined by the following equation:

Gamma=(3.0−0.3) / [log(exposure amount giving a density of 3.0)−log(exposure amount giving a density-of 0.3)]

The larger the gamma value, the higher is the contrast of photographic characteristics.

Processing Unevenness

A 96% dot pattern of 175 lpi was outputted on the sample using a color scanner having a helium-neon light source (SG-608 manufactured by Dainippon Screen Mfg. Co., Ltd.), and the development processing was conducted under the condition described above. The processing unevenness of the sample was then functionally evaluated by five grades of from 5 (good) to 1 (bad). The grade "3" or less is practically problem and not acceptable.

Running Stability

Running processing of the sample was conducted using an automatic processor (AP-560 manufactured by Fuji Photo Film Co., Ltd.). Specifically, 16 sheets of the sample having a size of 50.8 cm×61.0 cm half exposed were processed per day, and such a running work was performed for 6 days and stopped for one day to complete a round. The round was repeated 6 times.

With respect to the processing conditions, the time of development, and the temperatures of development and fixing were 20 seconds, 35° C. and 34° C., respectively. The developing solutions shown in Table 2 were used as mother solutions. Developing solutions prepared from the respective mother solution by adjusting its pH as shown in Table 3 were used as replenishers. The-replenishing amount of the fixing solution during the running processing was 1.5 times of the replenishing amount of the developing solution. The sensitivity with the exhausted running solution is practically required within a range of from 95 to 105.

Further, in order to evaluate dot quality after the running processing, on the sample was outputted a 50% dot pattern of 175 lpi using a color scanner having a helium light source (SG-608 manufactured by Dainippon Screen Mfg. Co., Ltd.), and the sample was conducted the development processing under the conditions described above. The quality of dot obtained were visually observed using a magnifying glass of 200 magnifications and evaluated by five grades of from 5 (good) to 1 (bad). In a practical use, the grade "3" or more is required.

The results obtained are shown in Table 3. It can be seen that reduction of processing unevenness, decrease in fluctuation of sensitivity and gradation at the running processing, and excellent dot quality are specially achieved by the photographic light-sensitive material according to the present invention.

TABLE 3

| Sample No. | Hydraxine Compound | Amount Added ($\times 10^{-4}$ mol/mol-Ag) | Method for Addition | Nucleation Accelerator | Amount Added ($\times 10^{-4}$ mol/mol-Ag) | pH of Replenisher |
|---|---|---|---|---|---|---|
| 1 | Comparative Compound (3) | 1 | Methanol Solution Addition | Compound (4) | 6 | 9.7 |
| 2 | Comparative Compound (3) | 2 | Polymer Dispersion Addition | Compound (4) | 6 | 9.7 |
| 3 | 4e | 2.5 | Polymer Dispersion Addition | Compound (4) | 6 | 9.7 |
| 4 | 4e | 0.5 | Methanol Solution Addition | Compound (4) | 6 | 9.7 |
| 5 | 4e | 2.5 | Polymer Dispersion Addition | Compound (4) | 6 | 9.7 |
| 6 | 4e | 2.5 | Polymer Dispersion Addition | Compound (4) | 6 | 9.7 |
| 7 | 4e | 2.5 | Polymer Dispersion Addition | Compound (4) | 6 | 9.7 |
| 8 | 4e | 2.5 | Polymer Dispersion Addition | Compound (4) | 6 | 9.7 |
| 9 | 23e | 2.5 | Polymer Dispersion Addition | Compound (4) | 6 | 9.7 |
| 10 | 23e | 2.5 | Polymer Dispersion Addition | Compound (4) | 6 | 10.1 |
| 11 | 24c | 5 | Polymer Dispersion Addition | Compound (4) | 6 | 9.7 |
| 12 | 24c | 5 | Polymer Dispersion Addition | Compound (4) | 6 | 10.1 |
| 13 | 4e | 4 | Polymer Dispersion Addition | Compound (4) | 4 | 9.7 |
| 14 | 4e | 4 | Polymer Dispersion Addition | Compound (4) | 4 | 9.7 |
| 15 | 4e | 4 | Polymer Dispersion Addition | Compound (4) | 4 | 9.7 |

TABLE 3-continued

| Sample No. | Developing Solution | Replenishing Amount of Solution (ml/m$^2$) | Fresh Solution Sensitivity | Fresh Solution Gradation | Fresh Solution Processing Unevenness | After Running Processing Sensitivity | After Running Processing Gradation | After Running Processing Dot Quality | Remarks |
|---|---|---|---|---|---|---|---|---|---|
| 1 | 2 | 160 | 100 | 22.0 | 2.0 | 87 | 12.3 | 2.5 | Comparison |
| 2 | 2 | 160 | 101 | 21.0 | 5.0 | 90 | 15.6 | 3.5 | Comparison |
| 3 | 2 | 160 | 100 | 22.1 | 4.5 | 98 | 21.0 | 5.0 | Present Invention |
| 4 | 2 | 80 | 101 | 22.5 | 1.0 | 92 | 12.9 | 3.0 | Comparison |
| 5 | 2 | 80 | 100 | 22.3 | 4.5 | 97 | 19.8 | 4.5 | Present Invention |
| 6 | 3 | 80 | 101 | 22.3 | 4.5 | 97 | 19.5 | 4.5 | Present Invention |
| 7 | 4 | 80 | 100 | 22.1 | 4.5 | 96 | 19.0 | 4.5 | Present Invention |
| 8 | 5 | 80 | 100 | 21.9 | 4.5 | 97 | 19.3 | 4.5 | Present Invention |
| 9 | 2 | 80 | 100 | 22.5 | 4.5 | 96 | 18.8 | 4.5 | Present Invention |
| 10 | 2 | 80 | 100 | 22.0 | 4.5 | 99 | 21.0 | 5.0 | Present Invention |
| 11 | 2 | 80 | 101 | 22.3 | 4.5 | 96 | 19.0 | 4.5 | Present Invention |
| 12 | 2 | 80 | 101 | 22.3 | 4.5 | 100 | 21.5 | 5.0 | Present Invention |
| 13 | 1 | 80 | 100 | 22.5 | 3.0 | 95 | 18.5 | 3.5 | Present Invention |
| 14 | 2 | 80 | 100 | 22.3 | 4.0 | 96 | 19.1 | 4.5 | Present Invention |
| 15 | 3 | 80 | 100 | 22.6 | 4.5 | 96 | 19.3 | 4.5 | Present Invention |

EXAMPLE 6

The same procedure as in Example 5 was repeated except for using a photographic light-sensitive material, an exposure method and an output machine using for the evaluation of processing unevenness shown below. As a result, ultra-high contrast images having decreased fluctuation of sensitivity and gradation at the running processing, excellent dot quality and reduced processing unevenness are specially obtained by the photographic light-sensitive material according to the present invention.

Preparation of Photographic Light-Sensitive Material

| Preparation of Emulsion D | |
|---|---|
| Solution 1 | |
| Water | 1 liter |
| Gelatin | 20 g |
| Sodium Chloride | 1.5 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 27.1 g |
| Potassium Bromide | 21.0 g |
| Ammonium Hexachloroiridate(III) (0.001% aqueous solution) | 20 ml |
| Potassium Hexachlororhodate(III) (0.001% aqueous solution) | 10 ml |

Solution 2 and Solution 3 were simultaneously added to Solution 1 maintained at 40° C. and at a pH of 4.5 with stirring over a period of 15 minutes to form nuclear grains. Subsequently, Solution 4 and Solution 5 shown below were added thereto over a period of 15 minutes, and 0.15 g of potassium iodide was added thereto and the grain formation was terminated.

| Solution 4 | |
|---|---|
| Water | 400 ml |
| Silver Nitrate | 100 g |

-continued

| Solution 5 | |
|---|---|
| Water | 400 ml |
| Sodium Chloride | 27.1 g |
| Potassium Bromide | 21.0 g |

Then, the mixture was washed with water according to a conventional flocculation method, and 40 g of gelatin was added thereto.

After adjusting the pH thereof to 5.7 and the pAg thereof to 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization at 55° C. so as to provide optimum sensitivity.

Further, 100 mg of 4-hydroxy-6-methyl-1,3,3a,7-tetrazaindene was added as a stabilizer, and 10 mM of phenoxyethanol was added as a preservative to finally obtain a cubic silver chloroiodobromide emulsion (Emulsion D) having an average grain size of 0.22 $\mu$m and a silver chloride content of 70 mol %.

Preparation of Coated Samples

Sensitizing Dye (1C) shown below was added to Emulsion D in an amount of $8.0\times10^{-5}$ mol/mol-Ag and spectral sensitization was conducted. Then, $3.4\times10^{-4}$ mol/mol-Ag of KBr, $2.0\times10^{-4}$ mol/mol-Ag of Compound (1C) shown below, $1.0\times10^{-3}$ mol/mol-Ag of Compound (2C), $2.0\times10^{-2}$ mol/mol-Ag of hydroquinone, $2.0\times10^{-3}$ mol/mol-Ag of citric acid and each of the hydrazine compounds shown in Table 3 in the amount shown in Table 3 and according to the method for addition shown in Table 3. Further, $6\times10^{-4}$ mol/mol-Ag of Compound (4C) shown below, $2.3\times10^{-4}$ mol/mol-Ag of Compound (5C) shown below, $1.4\times10^{-4}$ mol/mol-Ag of Compound (6C) shown below, 35% by weight based on gelatin of a polyethyl acrylate latex, 20% by weight based on gelatin of colloidal silica having a grain size of 10 $\mu$m, and 4% by weight based on gelatin of Compound (7C) shown below were added thereto. The thus obtained coating solution was applied onto a polyester support so as to provide a silver coating amount of 3.25 g/m$^2$ and a gelatin coating amount of 1.4 g/m$^2$. An upper protective layer and a lower protective layer having the following compositions, respectively, were provided on the emulsion layer.

| Upper Protective Layer | |
|---|---|
| Gelatin | 0.3 g/m$^2$ |
| Silica Matting Agent (average grain size: 3.5 μm) | 25 mg/m$^2$ |
| Compound (8C) (gelatin dispersion) | 20 mg/m$^2$ |
| Colloidal Silica (grain size: 10–20 μm) | 30 mg/m$^2$ |
| Compound (9C) | 5 mg/m$^2$ |
| Sodium Dodecylbenzenesulfonate | 20 mg/m$^2$ |
| Compound (10C) | 20 mg/m$^2$ |
| **Lower Protective Layer** | |
| Gelatin | 0.8 g/m$^2$ |
| Compound (11C) | 20 mg/m$^2$ |
| Compound (12C) | 7 mg/m$^2$ |
| 1,5-Dihydroxy-2-benzaldoxime | 10 mg/m$^2$ |
| Polyethyl Acrylate Latex | 150 mg/m$^2$ |

| Back Layer | |
|---|---|
| Gelatin | 3.3 g/m$^2$ |
| Sodium Dodecylbenzenesulfonate | 40 mg/m$^2$ |
| Compound (12C) | 60 mg/m$^2$ |
| Compound (13C) | 30 mg/m$^2$ |
| 1,3-Divinylsulfonyl-2-propanol | 60 mg/m$^2$ |
| Fine Grain of Polymethyl Methacrylate (average grain size: 6.5 μm) | 6 mg/m$^2$ |
| Fine Grain of Polymethyl Methacrylate (average grain size: 3.5 μm) | 25 mg/m$^2$ |
| Sodium sulfate | 150 mg/m$^2$ |
| Compound (7C) | 110 mg/m$^2$ |
| **Conductive Layer** | |
| Gelatin | 0.1 g/m$^2$ |
| Sodium Dodecylbenzenesulfonate | 20 mg/m$^2$ |
| $SnO_2$/Sb (weight ratio: 9/1, average grain size: 0.25 [m) | 200 mg/m$^2$ |

The supports of the samples used in the present invention each has a back layer and a conductive layer having the following compositions, respectively.

Sensitizing Dye (1C)

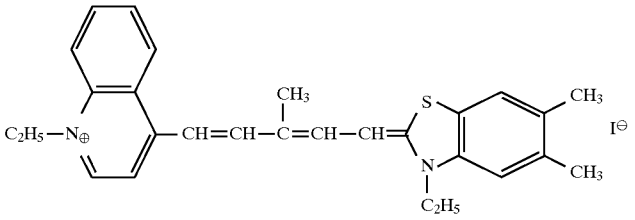

Compound (1C)

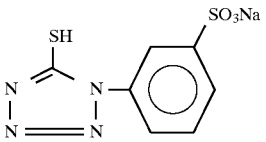

Compound (2C)

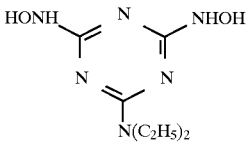

Compound (4C)

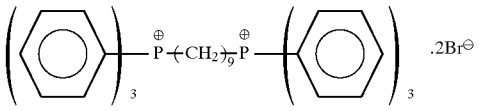

Compound (5C)

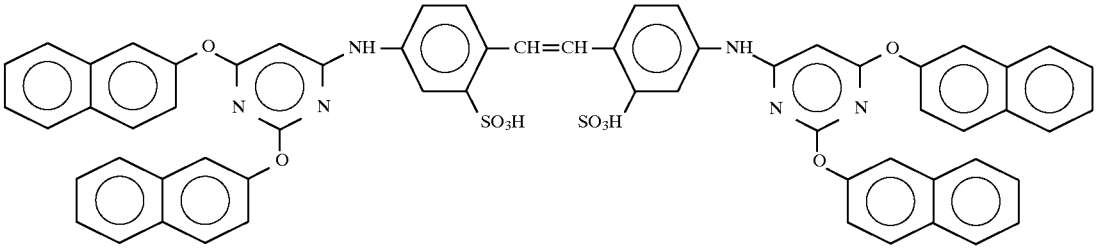

-continued
Compound (6C)
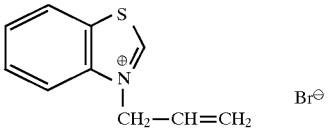
Compound (7C)
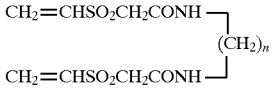
Compound (8C)
A 3:1 mixture of n = 2 and n = 3
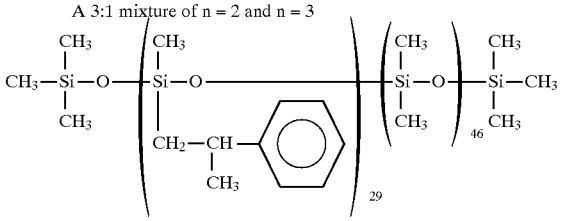
Compound (9C)
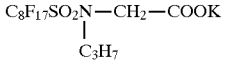
Compound (10C)
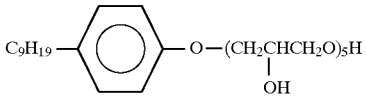
Compound (11C)
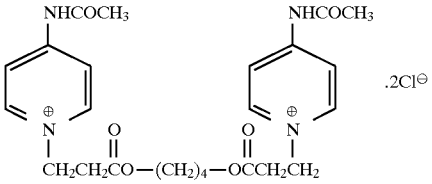
Compound (12C)
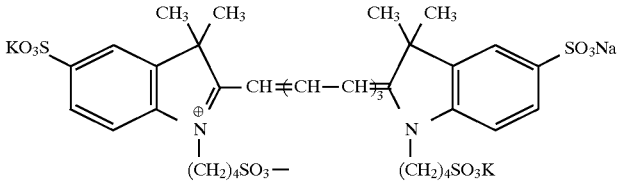
Compound (13C)
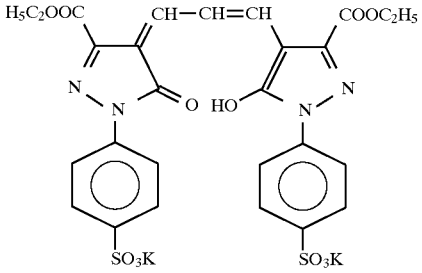
The following compound was used for comparison with the hydrazine compounds according to the present invention.
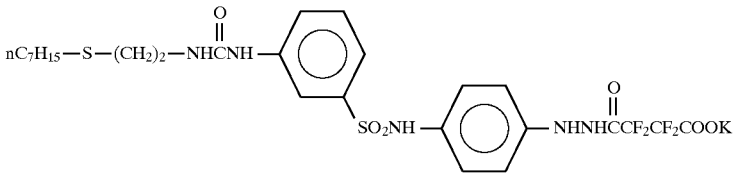

Exposure Method

The above described samples were exposed to xenon flash light having a light-emitting time of $10^{-5}$ second through an interference filter having a peak at 780 nm and a step wedge.

Output Machine for Evaluation of Processing Unevenness

A semiconductor laser scanner (MTR-1100 manufactured by Dainippon Screen Mfg. Co., Ltd.) was used.

While the invention has been described in detail and with reference to specific examples thereof, it will be apparent to one skilled in the art that various changes and modifications can be made therein without departing from the spirit and scope thereof.

What is claimed is:

1. A silver halide photographic light-sensitive material comprising a support having thereon at least one light-sensitive silver halide emulsion layer, wherein at least one of the silver halide emulsion layer and other hydrophilic colloid layers comprises fine polymer particles containing at least one hydrazine compound represented by the following general formula (NB):

$$A—(B)_m \qquad \text{(NB)}$$

wherein A represents a connecting group; m represents an integer of from 2 to 6; and B represents a group represented by the following general formula (B-1):

$$—(L_2—Ar_2)_n—L_1—Ar_1—NHNH—G_1—R_1 \qquad \text{(B-1)}$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an —$SO_2$— group, an —SO— group, a

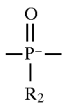

group, a —CO—CO— group, a thiocarbonyl group or an iminomethylene group; $R_2$ represents a group selected from those defined above for $R_1$, and may be different from $R_1$.

2. The silver halide photographic light-sensitive material as claimed in claim 1, wherein the fine polymer particles comprises a vinyl polymer.

3. The silver halide photographic light-sensitive material as claimed in claim 1, wherein the fine polymer particles further contains a melting point decreasing agent which functions as decreasing a melting point of the hydrazine compound.

4. The silver halide photographic light-sensitive material as claimed in claim 1, wherein at least one of the silver halide emulsion layer and other hydrophilic colloid layers contains a nucleation accelerator.

5. The silver halide photographic light-sensitive material as claimed in claim 4, wherein the nucleation accelerator is an amine derivative, an onium salt, a disulfide derivative or a hydroxymethyl derivative.

6. The silver halide photographic light-sensitive material as claimed in claim 5, wherein the onium salt is a compound represented by the following general formula (A-1), (A-2), (A-3) or (A-4):

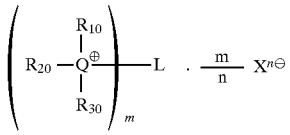

(A-1)

wherein $R_{10}$, $R_{20}$ and $R_{30}$ each represents an alkyl group, a cycloalkyl group, an aralkyl group, an aryl group, an alkenyl group, a cycloalkenyl group, an alkynyl group or a heterocyclic group; Q represents a nitrogen atom or a phosphorus atom; L represents an m-valent organic group bonded to $Q^+$ with its carbon atom, wherein m represents an integer of from 1 to 4; and $X^{n-}$ represents an n-valent counter anion, wherein n represents an integer of from 1 to 3, providing that when $R_{10}$, $R_{20}$, $R_{30}$ or L has an anion group in its substituent to form an internal salt with $Q^+$, $X^{n-}$ is not needed;

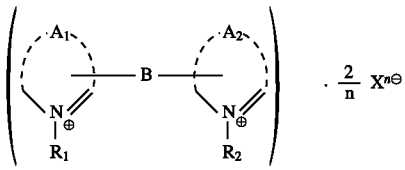

(A-2)

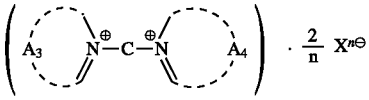

(A-3)

wherein $A_1$, $A_2$, $A_3$ and $A_4$ each represents an organic residue which contains a quaternized nitrogen atom and is for completing a substituted or unsubstituted unsaturated heterocyclic ring; B and C each represents a divalent connecting group; $R_1$ and $R_2$ each represents an alkyl group or an aralkyl group; and $X^{n-}$ represents an n-valent counter anion, wherein n represents an integer of from 1 to 3, providing that when an internal salt can be formed, $X^{n-}$ is not needed; and

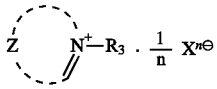

(A-4)

wherein Z represents an organic residue which contains a quaternized nitrogen atom and is for completing a substituted or unsubstituted unsaturated heterocyclic ring; $R_3$ represents an alkyl group, an alkenyl group, an alkynyl group or an aralkyl group; and $X^{n-}$ represents an n-valent counter anion, wherein n represents an integer of from 1 to 3, providing that when an internal salt can be formed, $X^{n-}$ is not needed.

7. The silver halide photographic light-sensitive material as claimed in claim 1, wherein the silver halide emulsion layer contains a silver halide emulsion having a silver chloride content of not less than 30 mol %.

8. The silver halide photographic light-sensitive material as claimed in claim 1, wherein the silver halide emulsion layer contains a chemically sensitized silver halide emulsion.

9. A method for processing a silver halide photographic light-sensitive material, which comprises the steps of:

imagewise exposing the silver halide photographic light-sensitive material; and developing the exposed silver halide photographic light-sensitive material with a developing solution, wherein the silver halide photographic light-sensitive material comprises a support having thereon at least one light-sensitive silver halide emulsion layer, wherein at least one of the silver halide emulsion layer and other hydrophilic colloid layers comprises fine polymer particles containing at least one hydrazine compound represent ed by the following general formula (NB):

$$A—(B)_m \quad \text{(NB)}$$

wherein A represents a connecting group; B represents a group represented by the following general formula (B-1); and m represents an integer of from 2 to 6:

$$—(L_2—Ar_2)_n—L_1—Ar_1—NHNH—G_1—R_1 \quad \text{(B-1)}$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an —$SO_2$— group, an —SO— group, a

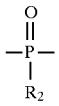

group, a —CO—CO— group, a thiocarbonyl group or an iminomethylene group; $R_2$ represents a group selected from those defined above for $R_1$, and may be different from $R_1$.

10. The method for processing a silver halide photographic light-sensitive material as claimed in claim 9, wherein the developing solution is substantially free of a dihydroxybenzene developing agent and contains a developing agent represented by the following general formula (1):

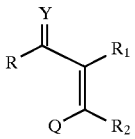

(1)

wherein $R_1$ and $R_2$ each represents a hydroxy group, an amino group, an acylamino group, an alkylsulfonylamino group, an arylsulfonylamino group, an alkoxycarbonylamino group, a mercapto group or an alkylthio group; P and Q each represents a hydroxy group, a hydroxyalkyl group, a carboxy group, a carboxyalkyl group, a sulfo group, a sulfoalkyl group, an amino group, an aminoalkyl group, an alkyl group, an alkoxy group or a mercapto group, or P and Q represent atomic groups which are connected to each other to form a 5- to 7-membered ring with the two vinyl carbon atoms on which $R_1$ and $R_2$ are substituted and the carbon atom on which Y is substituted; and Y represents =O or =N—$R_3$ wherein $R_3$ represents a hydrogen atom, a hydroxy group, an alkyl group, an acyl group, a hydroxyalkyl group, a sulfoalkyl group or a carboxyalkyl group.

11. The method for processing a silver halide photographic light-sensitive material as claimed in claim 10, wherein the developing solution further contains a compound represented by the following general formula (A):

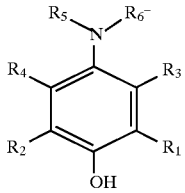

(A)

wherein $R_1$, $R_2$, $R_3$ and $R_4$, which may be the same or different, each represents a hydrogen atom or a substituent, and $R_5$ and $R_6$, which may be the same or different, each represents an alkyl group, an aryl group, an aralkyl group or a heterocyclic group.

12. The method for processing a silver halide photographic light-sensitive material as claimed in claim 9, wherein the developing solution contains a dihydroxybenzene developing agent.

13. The method for processing a silver halide photographic light-sensitive material as claimed in claim 12, wherein the developing solution further contains a compound represented by the following general formula (A):

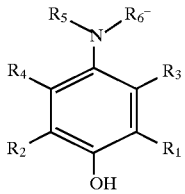

(A)

wherein $R_1$, $R_2$, $R_3$ and $R_4$, which may be the same or different, each represents a hydrogen atom or a substituent, and $R_5$ and $R_6$, which may be the same or different, each represents an alkyl group, an aryl group, an aralkyl group or a heterocyclic group.

14. The method for processing a silver halide photographic light-sensitive material as claimed in claim 11, wherein the compound represented by general formula (A) is a compound represented by the following general formula (B):

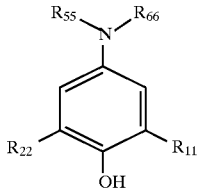

(B)

wherein $R_{11}$ and $R_{22}$ may be the same or different and each represents a hydrogen atom or a substituent; $R_{55}$ and $R_{66}$ may be the same or different and each represents an alkyl group, an aryl group, an aralkyl group or a heterocyclic group.

15. The method for processing a silver halide photographic light-sensitive material as claimed in claim 13, wherein the compound represented by general formula (A) is a compound represented by the following general formula (B):

(B)
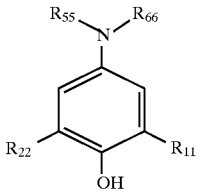
wherein $R_{11}$ and $R_{22}$ may be the same or different and each represents a hydrogen atom or a substituent; $R_{55}$ and $R_{66}$ may be the same or different and each represents an alkyl group, an aryl group, an aralkyl group or a heterocyclic group.
* * * * *